US008327589B2

(12) United States Patent
Sutton et al.

(10) Patent No.: US 8,327,589 B2
(45) Date of Patent: Dec. 11, 2012

(54) WALL-MOUNTED MODULAR ACCESSORY SYSTEM

(75) Inventors: Todd A. Sutton, Grand Rapids, MI (US); Noel J. Bodkins, Ada, MI (US)

(73) Assignee: Raspberry Med, Inc., Grand Rapids, MI (US)

( * ) Notice: Subject to any disclaimer, the term of this patent is extended or adjusted under 35 U.S.C. 154(b) by 174 days.

(21) Appl. No.: 12/713,547

(22) Filed: Feb. 26, 2010

(65) Prior Publication Data

US 2010/0223857 A1 Sep. 9, 2010

Related U.S. Application Data

(60) Provisional application No. 61/157,742, filed on Mar. 5, 2009.

(51) Int. Cl.

| | |
|---|---|
| ***E04H 6/06*** | (2006.01) |
| ***E04H 14/00*** | (2006.01) |
| ***E04F 19/00*** | (2006.01) |
| ***E04B 1/346*** | (2006.01) |

(52) U.S. Cl. ..... 52/29; 52/27; 52/32; 52/36.1; 52/64; 52/65

(58) Field of Classification Search ..... 52/27, 29, 52/32, 36.1, 36.4, 36.5, 64, 65, 69, 302.1, 52/220.1, 220.7, 220.8

See application file for complete search history.

(56) References Cited

U.S. PATENT DOCUMENTS

| | | | | |
|---|---|---|---|---|
| 4,177,612 | A | | 12/1979 | Tochihara |
| 5,038,539 | A | | 8/1991 | Kelley et al. |
| 5,642,593 | A | * | 7/1997 | Shieh ..... 52/239 |
| 5,695,261 | A | | 12/1997 | Slesinger et al. |
| 6,000,180 | A | * | 12/1999 | Goodman et al. ..... 52/239 |
| 6,101,773 | A | * | 8/2000 | Chau et al. ..... 52/220.7 |
| 6,151,835 | A | * | 11/2000 | Hallsten ..... 52/5 |
| 6,201,687 | B1 | | 3/2001 | Murray |
| 6,256,936 | B1 | | 7/2001 | Swensson et al. |
| 6,349,516 | B1 | * | 2/2002 | Powell et al. ..... 52/239 |
| 6,405,491 | B1 | | 6/2002 | Gallant |
| 6,457,278 | B1 | * | 10/2002 | Fleming ..... 52/37 |
| 6,497,075 | B1 | * | 12/2002 | Schreiner et al. ..... 52/36.1 |
| 6,557,310 | B2 | * | 5/2003 | Marshall et al. ..... 52/220.1 |
| 6,681,529 | B1 | * | 1/2004 | Baloga et al. ..... 52/29 |
| 6,877,824 | B2 | | 4/2005 | Winkless |
| 2002/0017066 | A1 | * | 2/2002 | Marshall et al. ..... 52/220.2 |
| 2002/0112443 | A1 | * | 8/2002 | Shipman et al. ..... 52/745.13 |
| 2004/0020137 | A1 | * | 2/2004 | Battey et al. ..... 52/36.1 |
| 2004/0211127 | A1 | * | 10/2004 | Wiechecki et al. ..... 52/36.1 |
| 2004/0250480 | A1 | | 12/2004 | Matthai |

(Continued)

*Primary Examiner* — Mark Wendell
(74) *Attorney, Agent, or Firm* — Gardner, Linn, Burkhart & Flory, LLP

(57) ABSTRACT

A modular accessory system is supportable on a vertical surface such as a wall, an office divider, or the like and includes a framework that support panels and/or functional modules to provide a desired appearance and/or functions for use in an area. The panels and modules are repositionable, and some may be oriented in two or more different orientations on the framework. Engaging members are provided at spaced intervals along each panel and module, with additional engaging members provided at spaced intervals along the framework. The engaging members along the framework releasably engage the engaging members on the panels and modules to support them on the framework. In addition, brackets may be coupled to the framework in either a vertical or horizontal orientation, such as alongside any panel or module, to support accessories thereon. Electrical wiring may be routed through the framework to supply certain panels, modules, or accessories.

35 Claims, 34 Drawing Sheets

U.S. PATENT DOCUMENTS

| | | | | |
|---|---|---|---|---|
| 2005/0005527 | A1 | 1/2005 | Metcalf et al. | |
| 2005/0011138 | A1* | 1/2005 | Ball et al. | 52/36.1 |
| 2005/0034378 | A1* | 2/2005 | Underwood et al. | 52/36.1 |
| 2005/0086871 | A1 | 4/2005 | MacGregor et al. | |
| 2005/0144855 | A1* | 7/2005 | Waalkes et al. | 52/36.1 |
| 2006/0048457 | A1* | 3/2006 | Yang | 52/36.1 |
| 2006/0214072 | A1* | 9/2006 | Lee | 248/200 |
| 2006/0277834 | A1* | 12/2006 | Roh | 52/36.1 |
| 2007/0125016 | A1* | 6/2007 | Yu et al. | 52/220.7 |
| 2007/0193124 | A1 | 8/2007 | Thompson | |
| 2007/0227079 | A1* | 10/2007 | Waalkes et al. | 52/36.1 |
| 2007/0277449 | A1* | 12/2007 | Burns | 52/36.4 |
| 2007/0289225 | A1 | 12/2007 | Kern et al. | |
| 2008/0040982 | A1 | 2/2008 | Durand et al. | |
| 2008/0134601 | A1 | 6/2008 | Cruz | |
| 2008/0236054 | A1 | 10/2008 | Gallant et al. | |
| 2010/0024317 | A1* | 2/2010 | Pope | 52/79.5 |
| 2010/0205868 | A1* | 8/2010 | Williams et al. | 52/36.4 |
| 2011/0197519 | A1* | 8/2011 | Henriott et al. | 52/36.1 |
| 2011/0219706 | A1* | 9/2011 | Bates et al. | 52/36.1 |

* cited by examiner

WALL-MOUNTED MODULAR ACCESSORY SYSTEM

CROSS REFERENCE TO RELATED APPLICATION

The present invention claims the benefit of U.S. provisional application Ser. No. 61/157,742, filed Mar. 5, 2009, which is hereby incorporated herein by reference in its entirety.

FIELD OF THE INVENTION

The present invention relates generally to modular accessory systems, and in particular, to wall-mounted modular accessory systems for providing various functions.

BACKGROUND OF THE INVENTION

Hospital rooms, meeting rooms, and other work areas are often equipped with many different devices that provide or perform various functions. For example, a typical hospital room may be equipped with a television, a clock, file storage, work/writing surfaces, computers, and the like. These devices are typically separate and distinct from one another, not conveniently or centrally located, and are not interchangeable, such that the area can become cluttered with devices, many of which may have power of data wires that need to be separately routed to respective power or data sources.

SUMMARY OF THE INVENTION

The present invention provides a wall-mounted modular accessory system that permits various panels and functional modules to be positioned along a framework for convenient usage at a defined location. The panels and modules are generally interchangeable and may be positioned substantially anywhere along the framework, and some of the panels or modules may be installed at the framework in different orientations. The framework may be adapted to mount other items via brackets that are received in channels along the framework, so that the items can be mounted alongside or between panels or modules. In addition, the framework may provide routing paths and retainers for wiring in order to provide an uncluttered appearance while facilitating access to the wiring along the framework and behind the various panels and modules. The panels and modules may be mounted to the framework by snap-fitting them into place without using any tools, and may be manually removed without tools, or with the aid of a simple pry bar or the like.

According to one form of the present invention, a modular accessory system is provided for mounting on a vertical surface such as a wall, an office divider, or the like. The system includes a framework, at least one panel, at least one functional modular insert, and a plurality of engaging members for coupling the module insert and panel to the framework. The framework includes vertically spaced top and bottom frame members and horizontally spaced left and right frame members. The frame members cooperate to form a rectangular frame that can be supported at a substantially vertical planar surface such as a wall, an office divider, or the like. The panel or panels comprise surfaces, and include a first plurality of engaging members in spaced arrangement. The functional module or modules are adapted to perform functions for a user, and include a second plurality of engaging members in spaced arrangement. A third plurality of engaging members is positioned along at least two of the frame members in spaced arrangement, for releasably engaging the first and second pluralities of engaging members of the panels and module inserts. The panels are repositionable at the framework at two or more different orientations by engaging the first plurality of engaging members with the third plurality of engaging members. A first orientation is at least about ninety degrees of rotation different from a second orientation.

In one aspect, the framework includes at least one intermediate vertical frame member between the left and right frame members, and at least one intermediate horizontal frame member spaced between the top and bottom frame members. The intermediate frame members present substantially coplanar support surfaces that are spaced from the vertical planar surface when the framework is supported on the vertical planar surface. Optionally, each of the top and bottom frame members, the left and right frame members, and the intermediate vertical and horizontal frame members, present substantially coplanar support surfaces, and all of the frame members are adapted to receive brackets for supporting accessories therefrom.

In another aspect, the bracket-supported accessory is a soap dispenser, an articulated arm, a television, a computer keyboard, a shelf, a sharps container, or a towel dispenser.

In yet another aspect, the first plurality of engaging members on the panels and the second plurality of engaging members on the functional modules are arranged in an evenly spaced manner. Optionally, the first and second pluralities of engaging members are evenly spaced in square (or repeating-square) patterns to facilitate installation of the panels and modules in multiple positions (and, optionally, in multiple orientations) along the framework.

In still another aspect, the panel or panels include a writing surface, a tack board, a translucent panel, an illuminated panel, or a decorative surface.

In a further aspect, the functional module or modules include a clock module, a lockable storage module, a file storage module, a power module, a workstation module, a video game module, an entertainment module, and/or a video conferencing module.

According to a still further aspect, the functional module is a power module including a housing, a movable cover, and at least one electrical coupler. The housing of the power module defines an interior cavity, which is selectively closeable by the movable cover, which in turn forms an outer surface of the power module. The electrical coupler is positioned at the interior cavity of the housing, and the housing is at least partially insertable and removable from a cavity defined by the rectangular frame.

According to a still further aspect, the modular accessory system includes a bracket for engaging the frame members. An accessory is coupled to the bracket. At least one of the frame members is adapted to receive the bracket for supporting the accessory at the framework. Optionally, the intermediate vertical and/or the intermediate horizontal frame members include recessed rear surfaces that define spaces between the rear surfaces and the vertical planar surface, for passing wiring through the spaces. Optionally, the rear surfaces of the intermediate vertical frame members and/or the intermediate horizontal frame members include wire notches for passing the wiring through the frame members so that the frame member(s) support the wiring at the wire notches.

In another aspect, the panels and the modules are attachable to the frame by aligning the first and second pluralities of engaging members with corresponding ones of the third plurality of engaging members, and by urging the panels and the modular inserts solely perpendicularly to a plane defined by the rectangular frame. Optionally, the first and second pluralities of engaging members are non-cylindrical pins or studs, and the third plurality of engaging members are clips for engaging portions of the pins.

In yet another aspect, the frame members include pass-throughs for conducting wiring from outside the framework into an interior cavity of the framework. A trim piece may be provided at least one of the frame members. The system may further include at least one chosen from (i) a flexible flange at the frame member, the flexible flange adapted to be displaced to create a gap between the flexible flange and the trim piece for routing a wire through the gap and into at least one of the pass-throughs of the frame member, and (ii) a wiring pass-through in the trim piece for routing a wire through the pass-through and into the pass-through of the frame members.

According to another form of the present invention, a modular accessory system is provided for mounting on a vertical surface and includes a framework and at least one power module insert. The framework includes vertically-spaced top and bottom frame members and horizontally-spaced left and right frame members that cooperate to form a rectangular frame defining a cavity. At least one intermediate frame member is installed in the cavity defined by the rectangular frame, and is coupled either to the top and bottom frame members, or to the left and right frame members. The rectangular frame is supported at a substantially vertical planar surface, such as a wall, an office divider, or the like. The power module insert includes a housing defining an interior cavity, a movable cover at the housing, and at least one electrical coupler. The movable cover forms an outer surface of the power module insert. The electrical coupler is positioned at the interior cavity of the housing. The housing of the power module insert is supported by top and/or bottom and/or intermediate frame members, and is at least partially insertable and removable from the cavity of rectangular frame, and is repositionable at different locations along the frame.

In one aspect, the power module insert includes a conduit in the housing for conducting high voltage wiring to the electrical coupler. Optionally, the electrical coupler is a 110 volt or 220 volt outlet. Optionally, the electrical coupler is an electronic data connector.

In another aspect, the power module includes a wiring retainer for retaining wires within the housing. Optionally, the movable panel is a door that is pivotably mounted to the housing by a hinge.

According to a still further aspect, the system includes a first plurality of engaging members in spaced arrangement on the power module insert and a second plurality of engaging members along the frame members. The second plurality of engaging members are in spaced arrangement along the frame members and configured to releasably engage the first plurality of engaging members. The power module insert is repositionable along the framework in different portions of the cavity, and is coupled to the framework by the first plurality of engaging members engaging different ones of the second plurality of engaging members.

According to yet another form of the present invention, a modular accessory system is provided for mounting on a vertical surface such as a wall, an office divider, or the like. The system includes a framework, at least one panel, and a plurality of engaging members for coupling the module insert and panel to the framework. The framework includes vertically spaced top and bottom frame members and horizontally spaced left and right frame members. The frame members cooperate to form a rectangular frame that can be supported at a substantially vertical planar surface such as a wall, an office divider, or the like. The panel or panels comprise surfaces, and include a first plurality of engaging members in spaced arrangement. A second plurality of engaging members is positioned along at least two of the frame members in spaced arrangement, for releasably engaging the first plurality of engaging members of the panels and module inserts. The panels are repositionable at the framework at two or more different orientations by engaging the first plurality of engaging members with the third plurality of engaging members. A first orientation is at least about ninety degrees of rotation different from a second orientation.

According to yet another form of the present invention, a load-supporting arrangement includes a bracket and a frame member for supporting the bracket. The bracket includes a frame-engaging plate having slot-engaging projections extending outwardly therefrom. The slot-engaging projections include distal and proximal end portions, with side projections extending from the slot-engaging projections between the distal and proximal end portions. The frame member includes a first plurality of slots for receiving the slot-engaging projections of the bracket. The frame member further includes recessed slots that are spaced from and substantially aligned with the first plurality of slots, and are configured to engage the distal ends of the slot-engaging projections. The slot-engaging projections extend through the first plurality of slots while the distal end portions of the slot-engaging projections engage the recessed slots, which permits the bracket to resist gravitational loads and bending moments applied to the bracket. Thus, the bracket is adapted to support the accessory at either of a horizontal orientation and a vertical orientation, depending on the orientation of the slots.

Thus, the present invention provides a wall-mounted modular accessory system that is adapted to receive many different panels or functional modules in different locations and/or orientations along the framework. The panels and modules are repositionable without tools, and the framework allows for routing of power or data wiring between the framework and the vertical surface through which the frame is mounted. In addition, the framework includes provisions for mounting accessories equipped with brackets for engaging slots in the frame members, and is supportable on a wall-mounted rail.

These and other objects, advantages, purposes, and features of the present invention will become apparent upon review of the following specification in conjunction with the drawings.

DESCRIPTION OF THE PREFERRED EMBODIMENTS

Figure 1A:
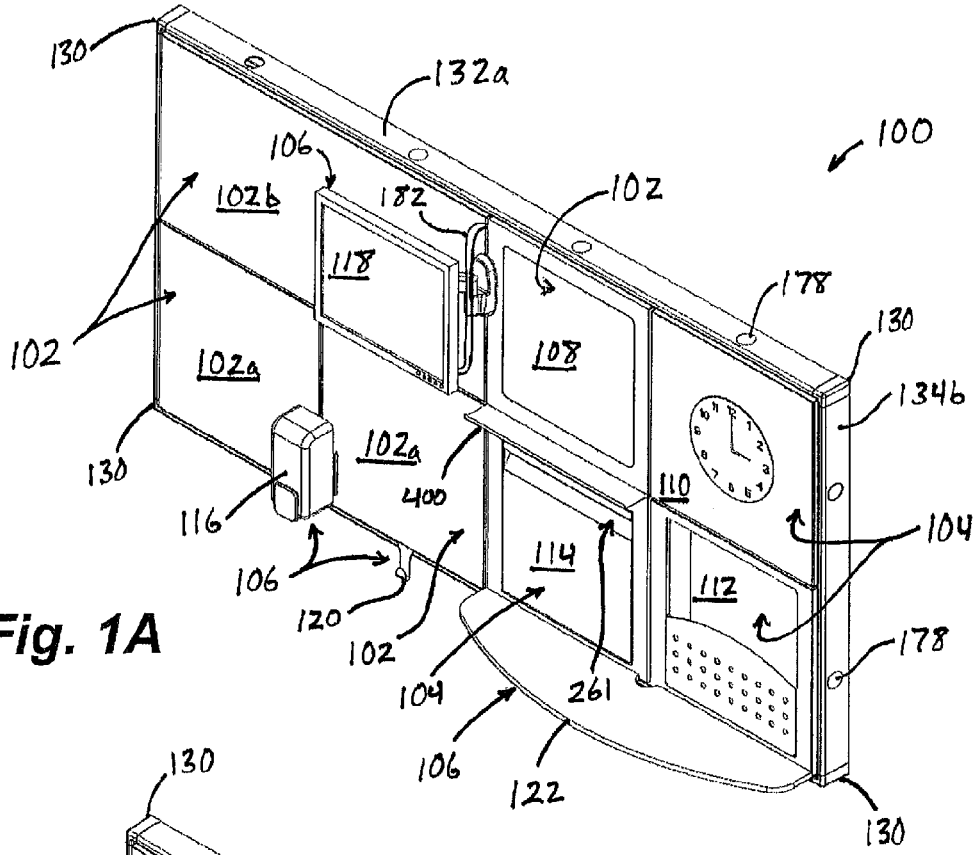
FIG. 1A is a perspective view of a wall-mounted modular accessory system in accordance with the present invention, including several modules, panels, and accessories on a framework.
Figure 1B:
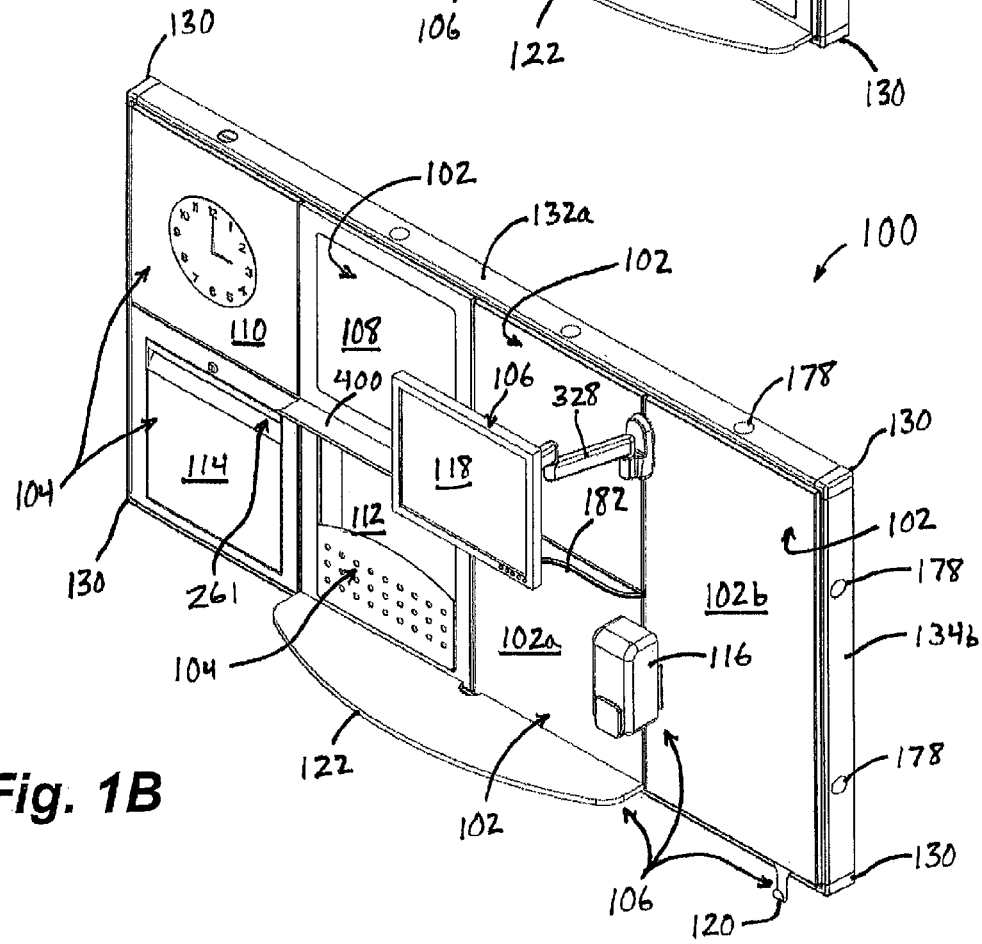
FIG. 1B is another perspective view of the system of FIG. 1A, with the modules, panels, and accessories repositioned and/or reoriented along the framework.

Referring now to the drawings and the illustrative embodiments depicted therein, a wall-mounted modular accessory system 100 supports a plurality of panels 102, functional modules 104, and accessories 106 (FIGS. 1A and 1B). Panels 102 are repositionable along system 100, and further, are typically re-orientable by removing, rotating, and re-installing them in a manner described below. Functional modules 104 are also repositionable within the system, as are accessories 106, which are typically mounted alongside or in-between panels 102 and modules 104, as will be described in greater detail below. In the illustrated embodiment of FIGS. 1A and 1B, panels 102 include square decorative panels 102*a* and a rectangular decorative panel 102*b*, plus a marker board 108. Functional modules 104 include a clock module 110, a file storage module 112, and a lockable storage module 114. Accessories 106 include a soap dispenser 116, a television 118, a coat hook 120, and a shelf 122. As will be understood by those skilled in the art, and with reference to additional descriptions below, panels 102, functional modules 104, and accessories 106 may include many different options, and are not intended to be limited to only those shown and described herein.

Modular accessory system 100 includes a framework 124 (FIGS. 1A-2D) for supporting panels 102, modules 104, and accessories 106. Framework 124 includes a top frame member 126*a* and a bottom frame member 126*b*, which are vertically spaced from one another, and which form the upper and lower portions of framework 124. Similarly, framework 124 includes a left frame member 128*a* and a right frame member 128*b*. The left and right frame members 128*a*, 128*b* are spaced horizontally from one another and form the respective left and right sides of framework 124. Top frame member 126*a*, bottom frame member 126*b*, left frame member 128*a*, and right frame member 128*b* are joined at their respective ends, such as with fasteners or by welding or the like, in order to form a generally rectangular frame. Corner moldings 130 are attached at the junctions of frame members 126*a*, 126*b*, 128*a*, 128*b*, and cooperate with top and bottom trim pieces 132*a*, 132*b* and left and right trim pieces 134*a*, 134*b* (FIGS. 1A and 1B), in order to cover the frame members and provide an aesthetically pleasing exterior perimeter appearance to framework 124.

Figure 2A:
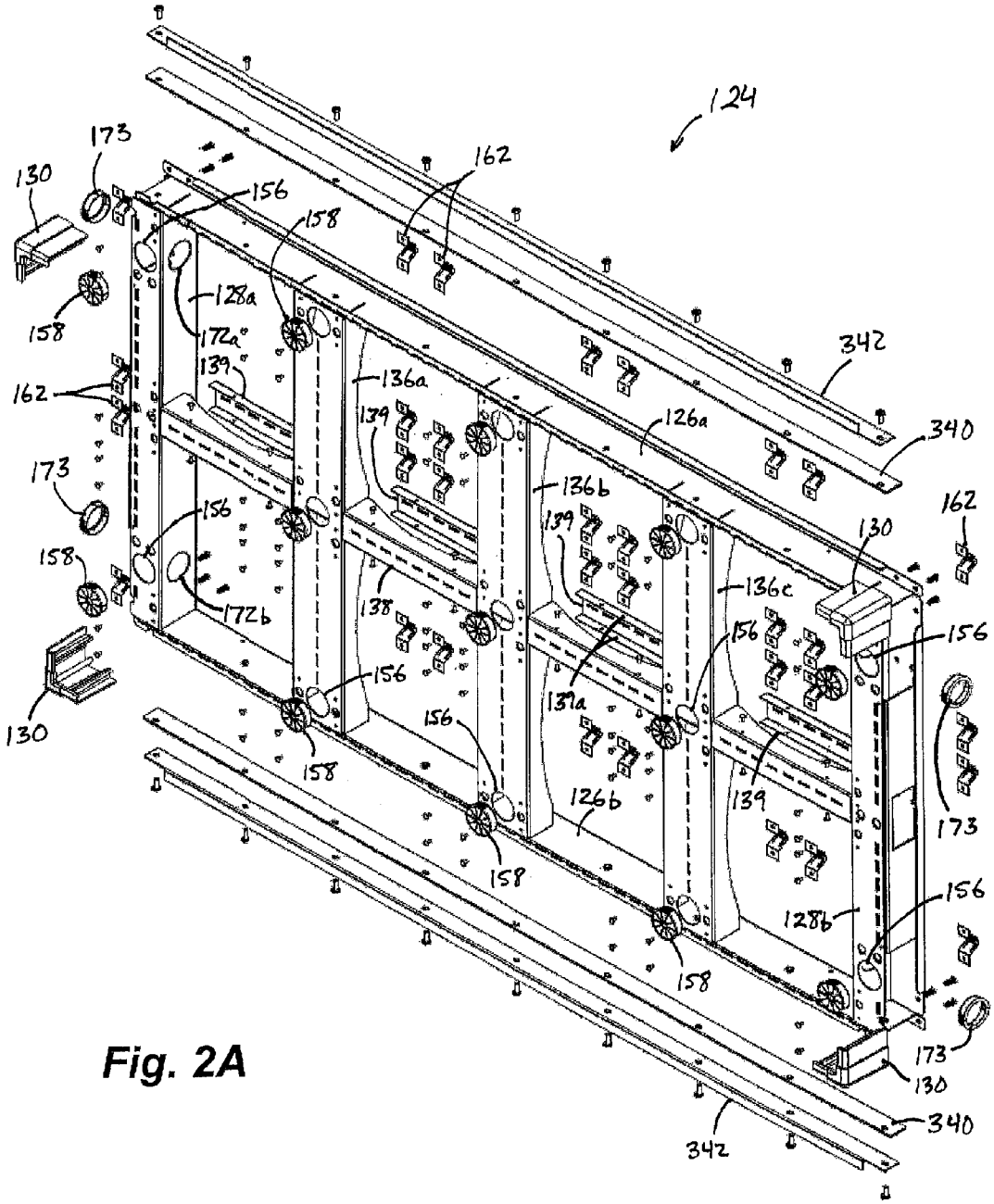
FIG. 2A is an exploded, front perspective view of the framework of FIGS. 1A and 1B.
Figure 2B:
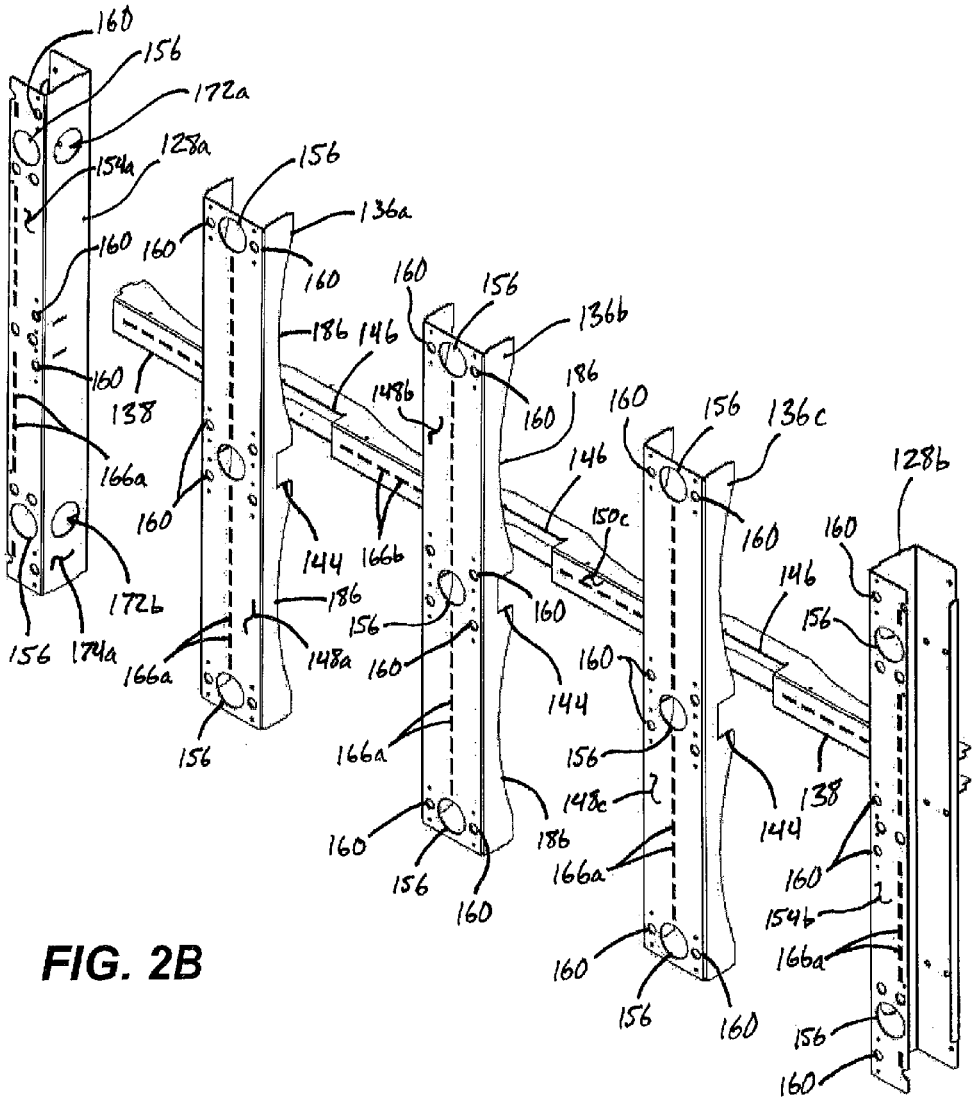
FIG. 2B is an exploded, front perspective view of the framework of FIG. 2A, showing only the left and right frame members and the intermediate frame members.
Figure 2C:
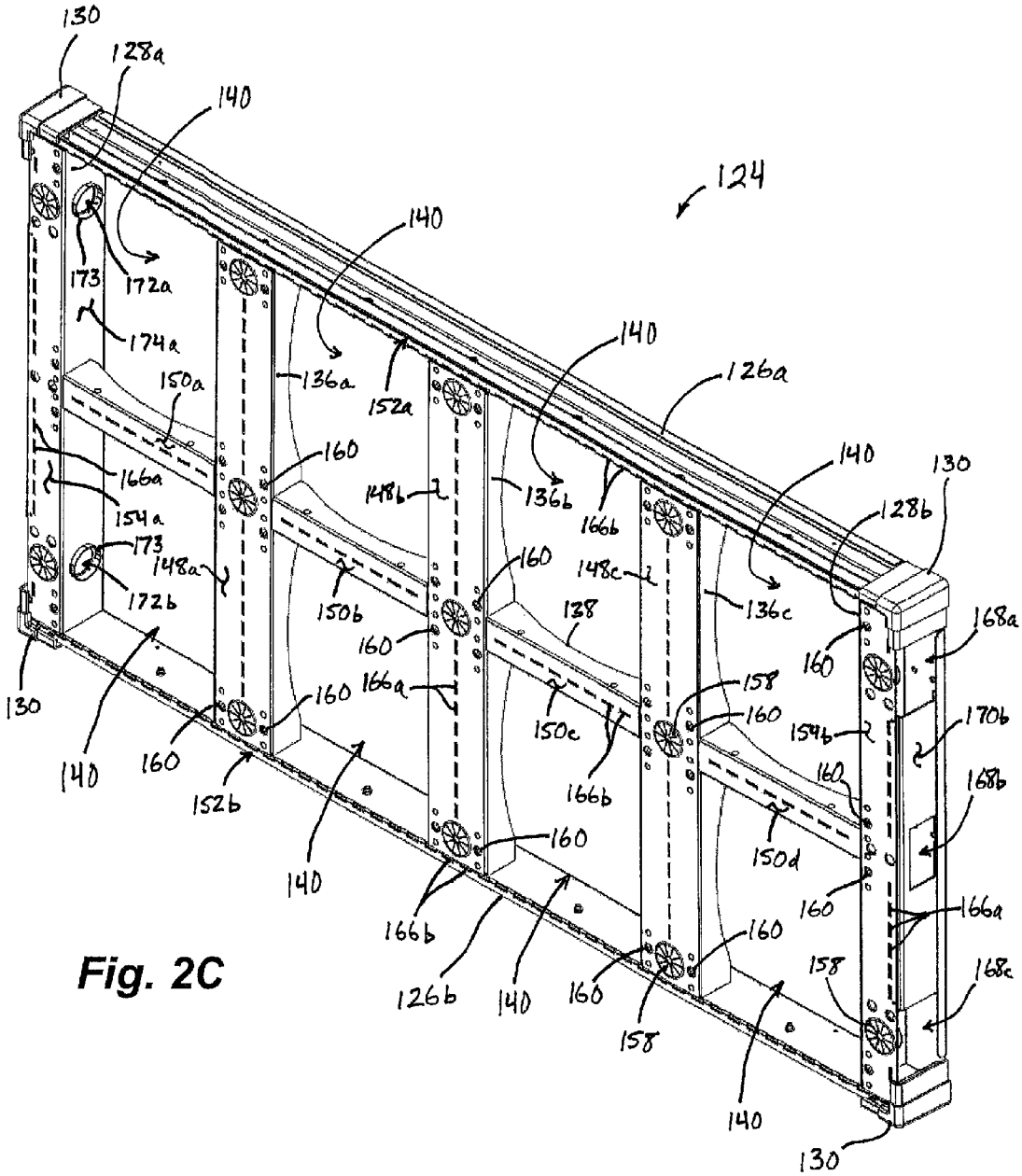
FIG. 2C is a front perspective view of the framework of FIG. 2A, shown fully assembled.
Figure 2D:
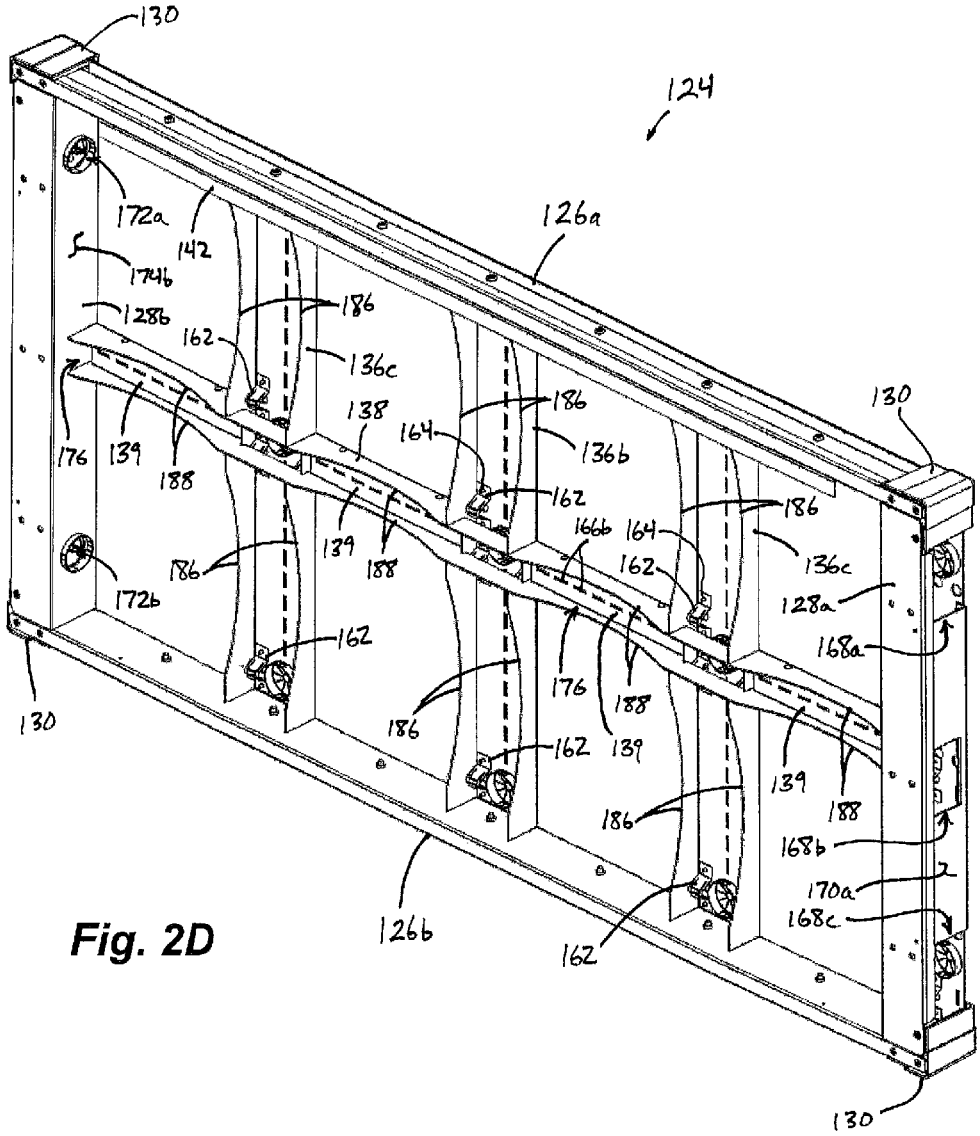
FIG. 2D is a rear perspective view of the assembly of FIG. 2C.
Figure 2E:
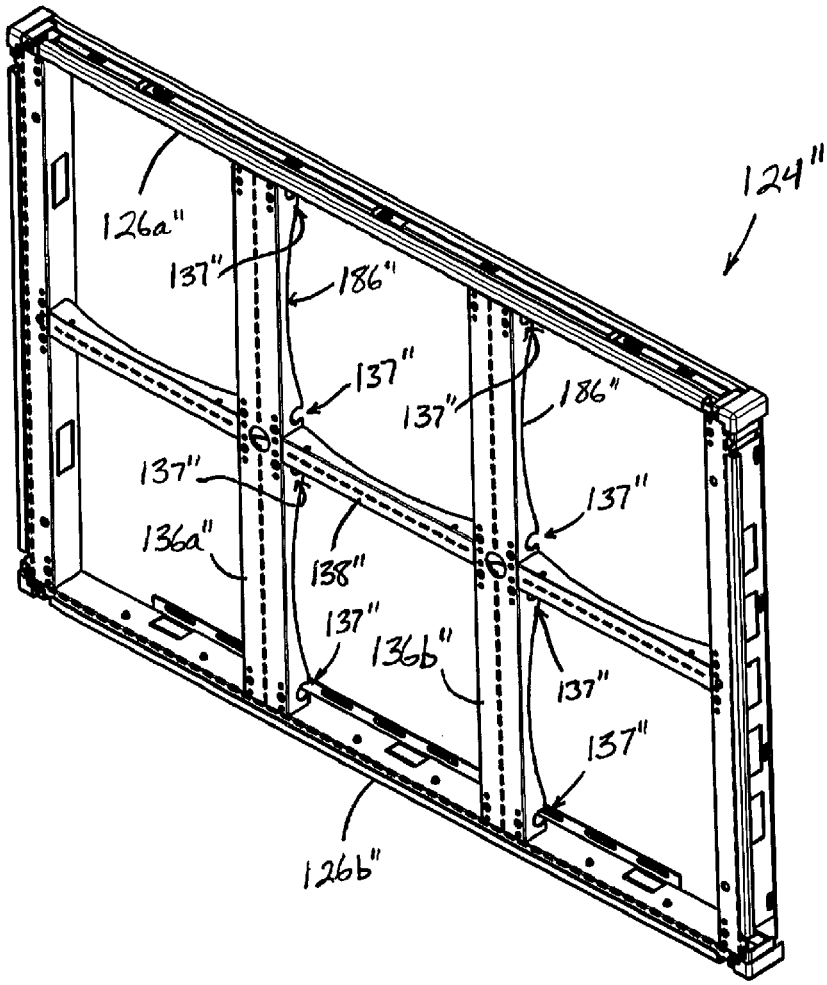
FIG. 2E is a front perspective view of another framework assembly useful with the present invention.
Figure 2F:
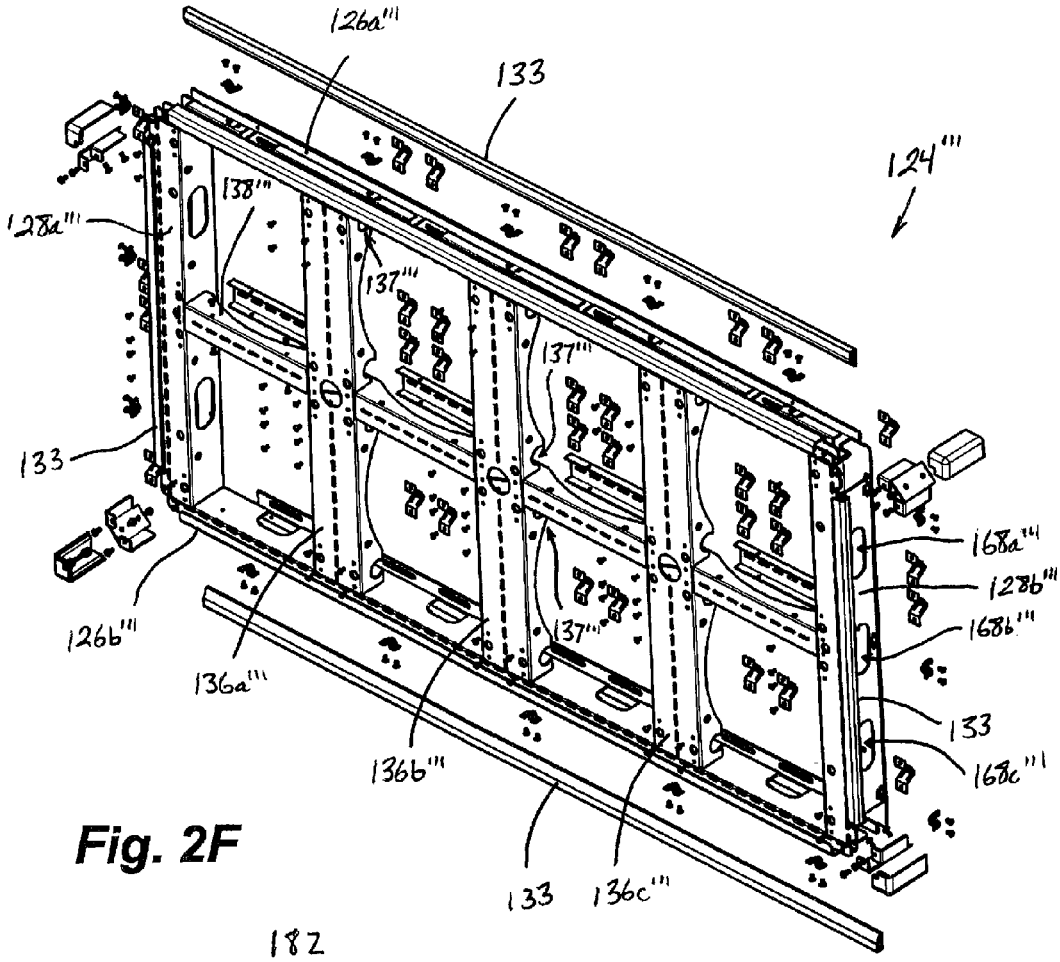
FIG. 2F is an exploded, front perspective view of another framework assembly useful with the present invention.
Figure 2I:
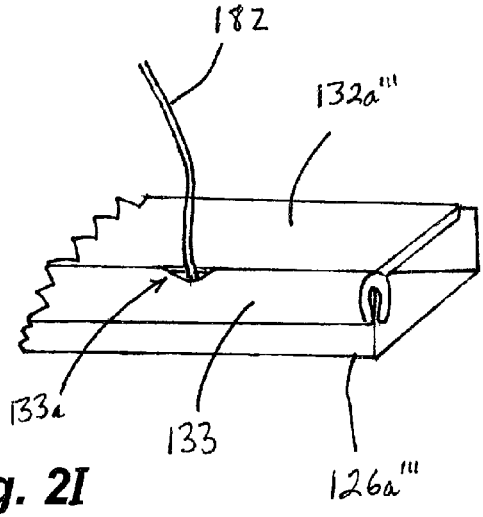
FIG. 2I is a simplified and enlarged perspective view of the top frame member of FIGS. 2F-H, including a flexible flange and a trim piece.
Figure 2G:
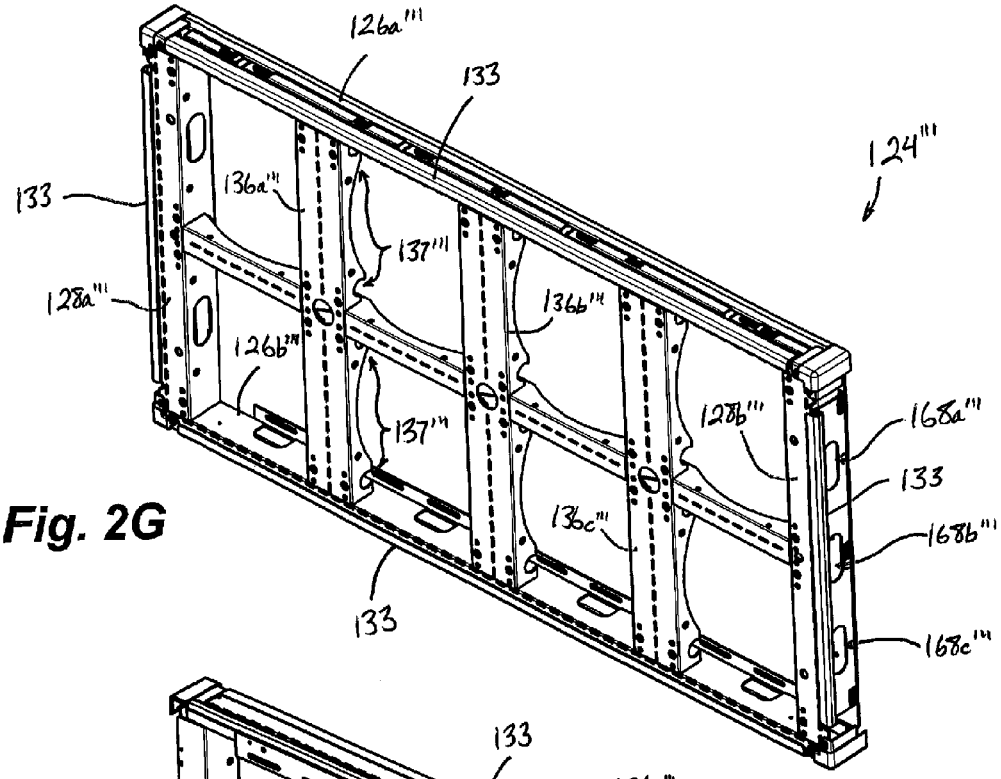
FIG. 2G is a front perspective view of the framework of FIG. 2F, shown fully assembled.
Figure 2H:
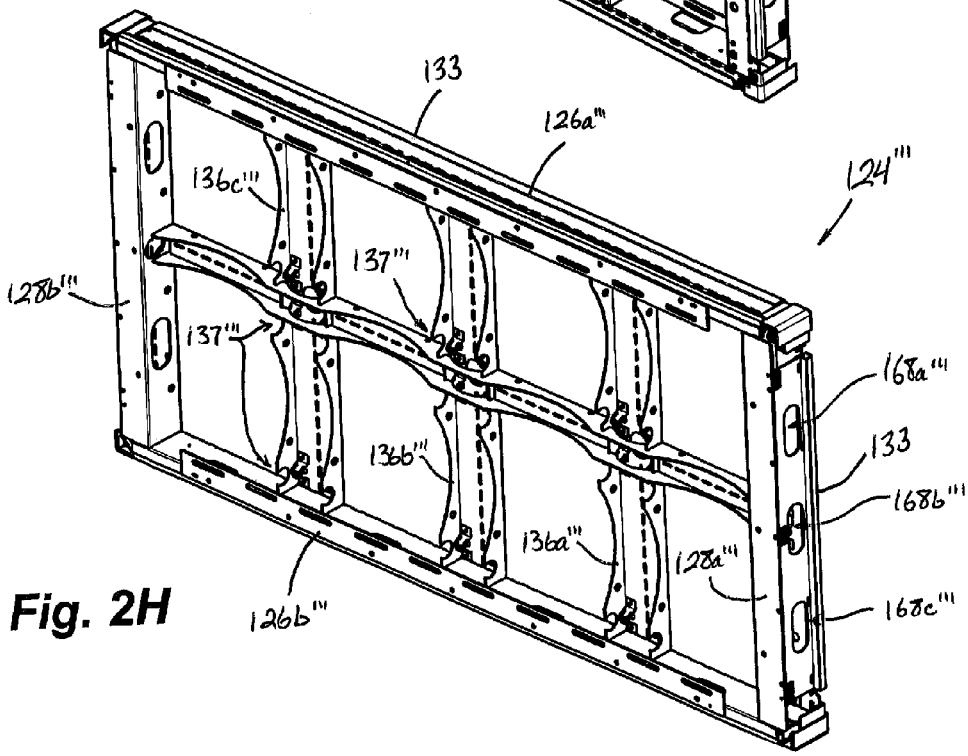
FIG. 2H is a rear perspective view of the assembly of FIG. 2G.
Figure 3:
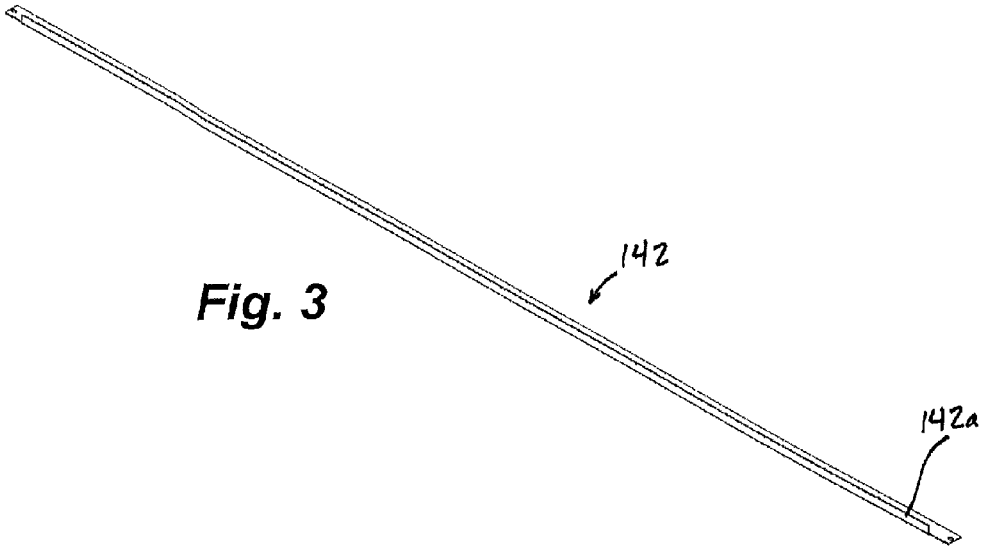
FIG. 3 is a perspective view of a support hangar bracket.
Figure 4:
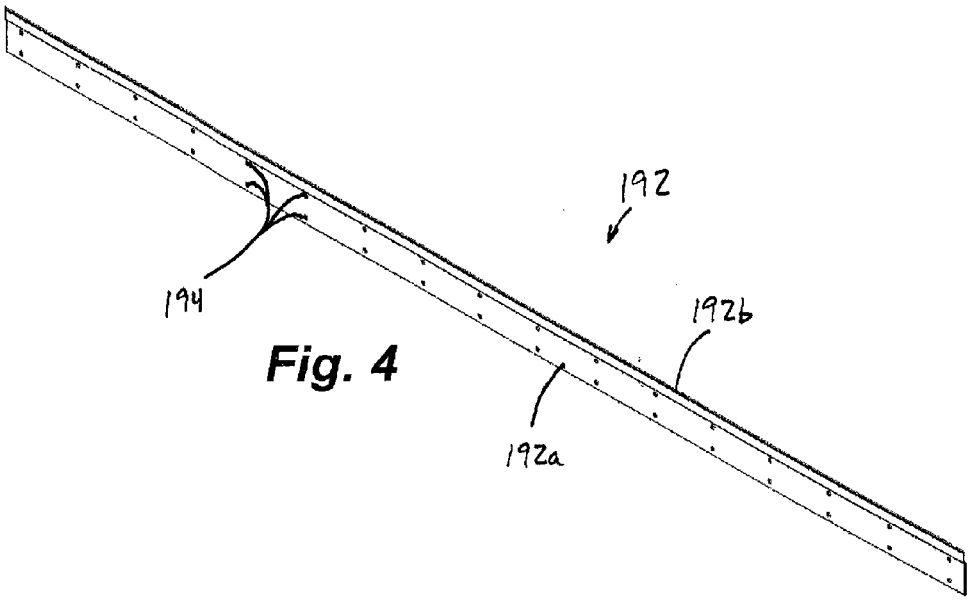
FIG. 4 is a perspective view of a wall-mountable rail for supporting the framework.

Framework 124 further includes three vertical intermediate frame members 136*a*, 136*b*, 136*c* that are preferably evenly spaced between left frame member 128*a* and right frame member 128*b*. In addition, a horizontal intermediate frame member 138 is preferably spaced evenly between top frame member 126*a* and bottom frame member 126*b*. Backing plates 139 (FIGS. 2A and 2D) are positioned in a back portion of horizontal intermediate frame member 138 for supporting brackets, as will be described below. Backing plates 139 include horizontal flanges 139*a* that are riveted or fastened to horizontal intermediate frame member 138. As best seen in FIGS. 2C and 2D, vertical intermediate frame members 136*a-c* and horizontal intermediate frame member 138 cooperate with top and bottom frame members 126*a-b* and left and right frame members 128*a-b* to define a plurality of generally square cavities 140 between the frame members. A rail-engaging member 142 (FIGS. 2A, 2D, and 4) is coupled to a lower surface of top frame member 126*a* and engages a rail, such as that shown at 192 in FIG. 4, to support the weight of modular accessory system 100.

Vertical intermediate frame members 136*a-c* include mid-span notches 144 (FIG. 2B) for receiving horizontal intermediate frame member 138 crosswise. Horizontal intermediate frame member 138 itself includes a series of notches 146 so that only outer surfaces 148*a-c* of vertical intermediate frame members 136*a-c* are exposed at the crossing locations of vertical intermediate frame members 136*a-c* and horizontal intermediate frame member 138 (FIG. 2C). Accordingly, when vertical intermediate frame members 136*a-c* and horizontal intermediate frame member 138 are assembled together at mid-span notches 144 and notches 146, outer surfaces 148*a-c* are substantially coplanar with outer surfaces 150*a-d* of horizontal intermediate frame member 138. In addition, top frame member 126*a* and bottom frame member 126*b* include respective outer surfaces 152*a*, 152*b*, and left frame member 128*a*, and right frame member 128*b* include respective outer surfaces 154*a*, 154*b*. When framework 124 is fully assembled, all of outer surfaces 148*a-c*, 150*a-d*, 152*a-b*, and 154*a-b*, are substantially flush and coplanar with one another, and define a plane that is substantially parallel to the plane of a vertical surface to which the framework 124 may be mounted.

Left and right frame members 128*a*, 128*b* and vertical intermediate frame members 136*a-c* include a plurality of wire pass-throughs 156 that permit data and/or power wiring to pass through the respective frame members at different locations. Optionally, each wire pass-thru 156 includes a grommet 158 for safely supporting wiring in pass-throughs 156 without abrading or chafing the wiring. For example, grommets 158 may include a plurality of inwardly-projecting spring fingers aligned radially around an inner surface of the grommet, such as the Part No. 2213SP grommets available from Heyco, Inc. of Toms River, N.J.

Each of left and right frame members 128*a*, 128*b* and vertical intermediate frame members 136*a-c* include a series of pin-receiving apertures 160 for mounting panels 102 and functional modules 104 in a manner that will be described more fully below. Located behind each pin-receiving aperture 160 is an engaging member or spring clip 162 (FIGS. 2A and 2D) positioned behind outer surfaces 128*a*, 128*b*, and 148*a-c*. Spring clips 162 are held in place by fasteners 164 such as rivets, bolts, or the like, as in FIGS. 2A and 2D. Spring clips 162 may be substantially any clip configured to receive a projection extending through pin-receiving apertures 160 such as, for example, Part No. 1657 available from Harrison Silverdale of Sheffield, United Kingdom. Pin-receiving apertures 160 and spring clips 162 are in spaced arrangement around each square cavity 140 defined by the frame members, with certain centrally-located apertures 160 located in relatively close proximity to one another to accommodate adjacent panels or modules, and to facilitate attachment of rectangular panels in a manner that is more fully described below.

Vertical intermediate frame members 136*a-c* and left and right members 128*a*, 128*b* each include a series of vertical slots 166*a* arranged in linear fashion and aligned so as to be accessible between panels 102, and modules 104 when the modules and panels are installed at framework 124. Similarly, horizontal intermediate frame member 138, top and bottom frame members 126*a*, 126*b*, and backing plates 139 include a plurality of horizontally-aligned slots 166*b* in linear arrangement along the outer surfaces 152*a-b*, 150*a-d* of the respective frame members and arranged so as to be accessible between the panels 102 and functional modules 104 when the panels and modules are installed at framework 124. Horizontally-aligned slots 166*b* of backing plates 139 are recessed or spaced from horizontal intermediate frame member 138 and substantially aligned with slots 166*b* of horizontal intermediate frame member 138. Vertical slots 166*a* and horizontal slots 166*b* are configured to receive portions of brackets for mounting accessories 106, as will be described in greater detail below.

Framework 124 includes a number of wire-management features, in addition to wire pass-throughs 156 and grommets 158 located in vertical intermediate frame members 136*a-c* and left and right frame members 128*a*, 128*b*. For example, left and right frame members 128*a*, 128*b* each include upper, middle, and lower outer wire pass-throughs 168*a*, 168*b*, 168*c* in outer surfaces 170*a*, 170*b* of the left and right frame members 128*a*, 128*b*. Left and right frame members 128*a*, 128*b* include upper and lower inner pass-throughs 172*a*, 172*b* along corresponding inner surfaces 174*a*, 174*b* of left and right frame members 128*a*, 128*b*, and align with upper pass-throughs 168*a* and lower pass-throughs 168*c* in outer surfaces 170*a*, 170*b*.

Figure 15:
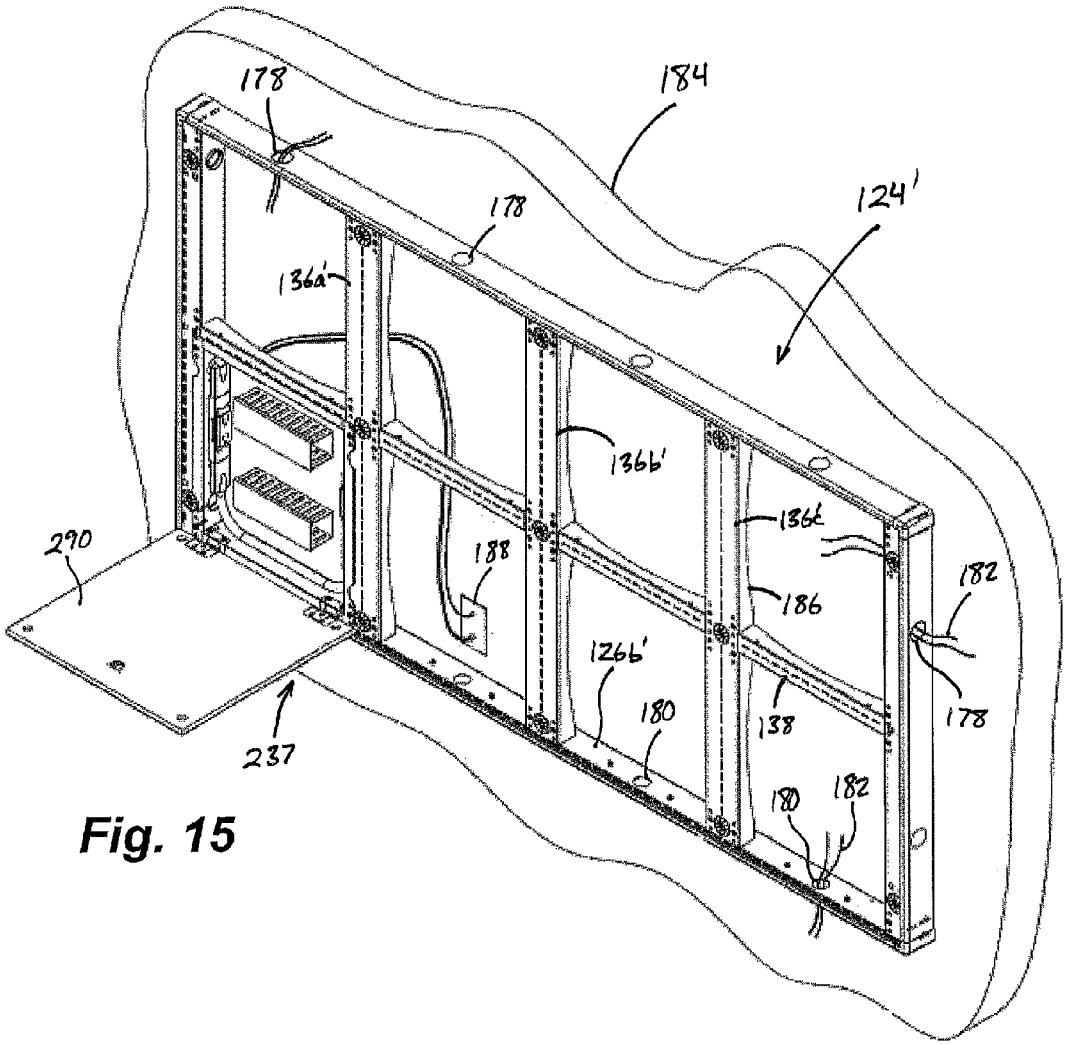
FIG. 15 is a front perspective view of a framework similar to that of FIG. 2C, shown mounted to a vertical surface and having trim pieces, a power module, and wiring passing through the vertical surface behind the framework.

Accordingly, wiring from outside framework 124 may be admitted into an interior region or cavity of the framework (such as one of square cavities 140) by passing the wiring through any of upper, middle, or lower pass-throughs 168*a-c* in left or right frame members 128*a*, 128*b*, and then through corresponding upper or lower pass-throughs 172*a*, 172*b*, as may be understood with reference to FIG. 15. Wiring that enters through middle pass-thru 168*b* of either left or right frame member 128*a*, 128*b* may be routed upward toward upper pass-thru 172*a* or downward toward lower pass-thru 172*b* for routing into an interior region of the framework 124. Upper and lower pass-throughs 172*a*, 172*b* may be fitted with grommets 173 to protect the wiring from damage, such as Part No. 2883 grommets available from Heyco, Inc. of Toms River, N.J. Optionally, a middle pass-thru (not shown) may be located along a middle portion of inner surfaces 174*a*, 174*b*, and aligned with middle pass-thru 168*b* in left and right frame members 128*a*, 128*b*, in order to receive wiring directly from middle pass-throughs 168*b* in outer surfaces 170*a*, 170*b*, so that the wiring is routed into a rearward-facing channel 176 (FIG. 2D) in horizontal intermediate frame member 138, and routed into one or more of square cavities 140 in a manner described below.

Optionally, top and bottom trim pieces 132*a*', 132*b*' and left and right trim pieces 134*a*', 134*b*' include a series of spaced pass-throughs 178 (FIG. 15) for receiving wiring from outside of a framework 124'. Optionally, and as shown in FIG. 15, framework 124' includes top and bottom frame members 126*a*', 126*b*' having pass-throughs 180 aligned with pass-throughs 178 and similar to pass-throughs 174*a*, 174*b* in left and right frame members 128*a*', 128*b*'.

In addition to permitting passage of wiring through trim pieces 132*a*'-b', 134*a*'-b', top and bottom frame members 126*a*', 126*b*', and left and right frame members 128*a*', 128*b*', horizontal intermediate frame member 138 and vertical intermediate frame members 136*a*'-c' are configured to permit passage of wiring 182 between the intermediate frame members 136*a*'-c', 138' and any substantially vertical support surface 184, such as a wall or office divider or the like (FIG. 15). Vertical intermediate frame members 136*a-c*, 136*a*'-c' each include a pair of recessed rear edges or surfaces 186. In the illustrated embodiments of FIGS. 2A-C and 15, recessed rear edges 186 are generally arcuate in shape to provide a concave surface that faces and is spaced from vertical support surface (such as surface 184 of FIG. 15) to provide a space for passage of wiring 182 between square cavities 140 (FIG. 15). Similarly, horizontal intermediate frame members 138, 138' include recessed rear edges or surfaces 188 formed of arcuate edges spaced from vertical support surface 184.

Accordingly, wiring 182 may emerge from vertical support surface 184 at a location surrounded by framework 124, 124', such as at a power/data outlet 190, to enter one of square cavities 140, and then may be routed between any of recessed rear edges 186, 188 to reach a desired location or module (such as a power module 237) positioned anywhere along framework 124, 124'. Additionally, wiring 182 may be routed along channels defined by top and bottom frame members 126*a*, 126*b*, hidden beneath top and bottom trim pieces 132*a*, 132*b*, corner moldings 130 and left and right trim pieces 134*a*, 134*b* to reach left and right frame members 128*a*, 128*b* where the wiring can then be routed into square cavities 140 via upper and lower pass-throughs 172*a*, 172*b* and inner surfaces 174*a*, 174*b* of left and right frame members 128*a*, 128*b*.

Optionally, another framework 124" (FIG. 2E) is similar to framework 124, except that vertical intermediate frame members 136*a*"-b" include generally C-shaped wire pass-throughs or notches 137" near where vertical intermediate frame members 136*a*"-b" meet intermediate horizontal frame member 138" and top and bottom frame members 126*a*", 126*b*". Wire notches 137" support wiring that is routed generally horizontally behind vertical intermediate frame members, and may be used to support wiring in the notches 137" to prevent the wiring from sagging or dropping below a desired routing path, such as due to gravitational load. Optionally, such as when it is necessary to route wiring with relatively large terminal connectors that are larger than wire notches 137", the connectors and wiring may be initially routed between recessed rear edges or surfaces 186" of vertical intermediate frame members 136*a*"-b". Once the connectors are clear of the vertical intermediate frame members, the wiring may be raised or lowered as desired and placed into a desired pair of notches 137" for retention of the wiring.

Optionally, another framework 124'" (FIGS. 2F-2I) is similar to frameworks 124 and 124", including generally C-shaped wire pass-throughs or notches 137'" near where vertical intermediate frame members 136*a*'"-c'" meet intermediate horizontal frame member 138'" and top and bottom frame members 126*a*'", 126*b*'". However, framework 124'" lacks a separate spacer plate and L-shaped member (such as spacer plate 340 and L-shaped member 342 of framework 124, described below), and instead integrates these components into top frame member 126*a*'". In addition, framework 124'" may be equipped with generally smooth, continuous trim pieces 132*a*'" (FIG. 2I) that are similar to the top and bottom trim pieces 132*a*, 132*b* and left and right trim pieces 134*a*, 134*b* described above, except that the trim pieces of framework 124'" lack wiring pass-throughs (as in pass-throughs 178 of FIGS. 1A, 1B, and 15) and thus present a smoother, more uniform appearance.

Instead of wiring pass-throughs in trim pieces, flexible flanges 133 are provided along front edges of top and bottom frame members 126*a*'", 126*b*'" and left and right frame members 128*a*'", 128*b*'" so that wiring from outside of framework 124'" may be received into the interior of framework 124'". This may be accomplished by deflecting a portion 133*a* (FIG. 2I) of a flexible flange 133 in the region where it is desirable to pass the wiring 182 into the framework. Flexible flanges 133 may comprise rubber flaps or elongate resilient elements or the like, which may be pressed and deflected inwardly toward the respective frame member, or generally away from a trim piece (such as trim piece 132*a*'" of FIG. 2I) to create a gap between the deflected portion of flange 133 and the trim piece, through which wiring 182 may be passed. Once the wiring 182 is routed between the trim piece 132*a*'" and flange 133, it may be further routed into the interior of framework 124'" via upper, middle, and lower outer wire pass-throughs 168*a*'", 168*b*'", 168*c*'" in left and right frame members 128*a*'", 128*b*'", for example. Thus, framework 124'" may be produced at lower cost due to lower parts count, and may be more aesthetically pleasing by eliminating obvious wire pass-throughs in the outer trim pieces and instead passing wiring through small gaps between flexible flanges 133 and the respective outer trim pieces.

Framework 124, 124' is supportable on vertical support surface 184 via support hanger bracket 142 (FIGS. 2A, 2D, 3, and 26) mounted to an underside of top frame member 126*a*, 126*a*'. Support hanger bracket 142 includes a downwardly projecting elongate lip or projection 142*a* along substantially the entire length of support hanger bracket 142. A hanger rail 192 (FIGS. 4 and 26) is configured for mounting to vertical support surface 184 and supporting framework 124 at the support surface by engaging rail-engaging member 142. Hanger rail 192 includes an elongate planar portion 192*a* and an elongate offset portion 192*b* along an upper end of planar portion 192*a*, Planar portion 192*a* includes a plurality of apertures 194 to receive fasteners (not shown) that are driven through elongate planar portion 192*a* and into vertical support surface 184 (such as into structural studs or supports within the vertical support surface) in order to securely fasten hanger rail 192 to vertical support surface 184. When hanger rail 192 is installed at vertical support surface 184, the elongate offset portion 192*b* is spaced from and generally parallel to the vertical support surface. The space between elongate offset portion 192*b* and vertical support surface 184 receives the elongate downward projection 142*a* of rail engaging member 142 in order to support framework 124 at vertical support surface 184. Optionally, support hanger bracket 142 and hanger rail 192 span less than the full width of framework 124, 124' so that the horizontal position of framework 124 may be adjusted by moving rail-engaging member 142 left or right relative to hanger rail 192.

Figure 5A:
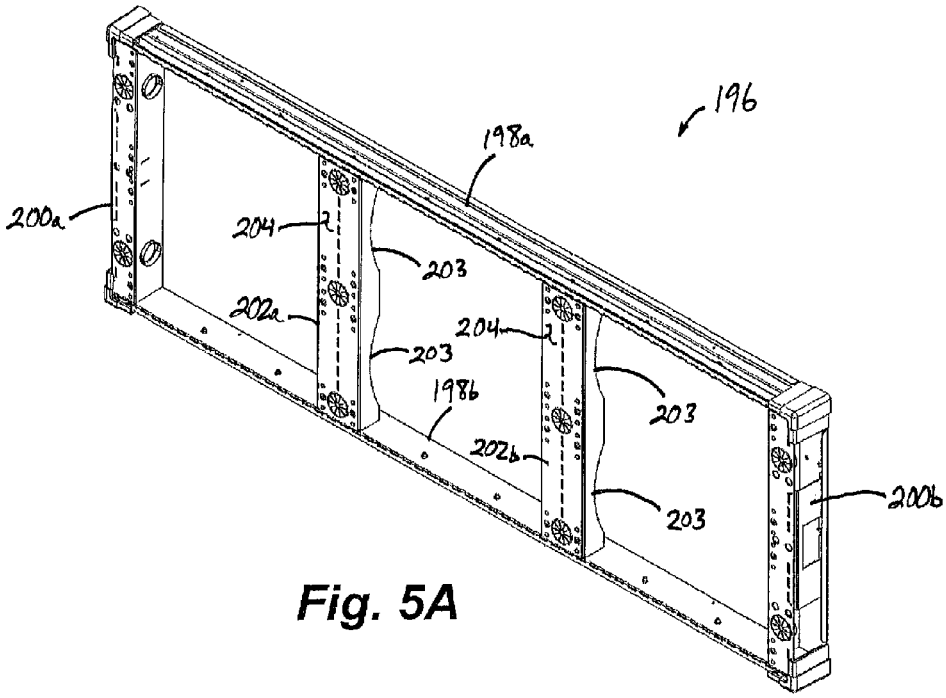
FIG. 5A is a front perspective view of another framework useful with the present invention.
Figure 5B:
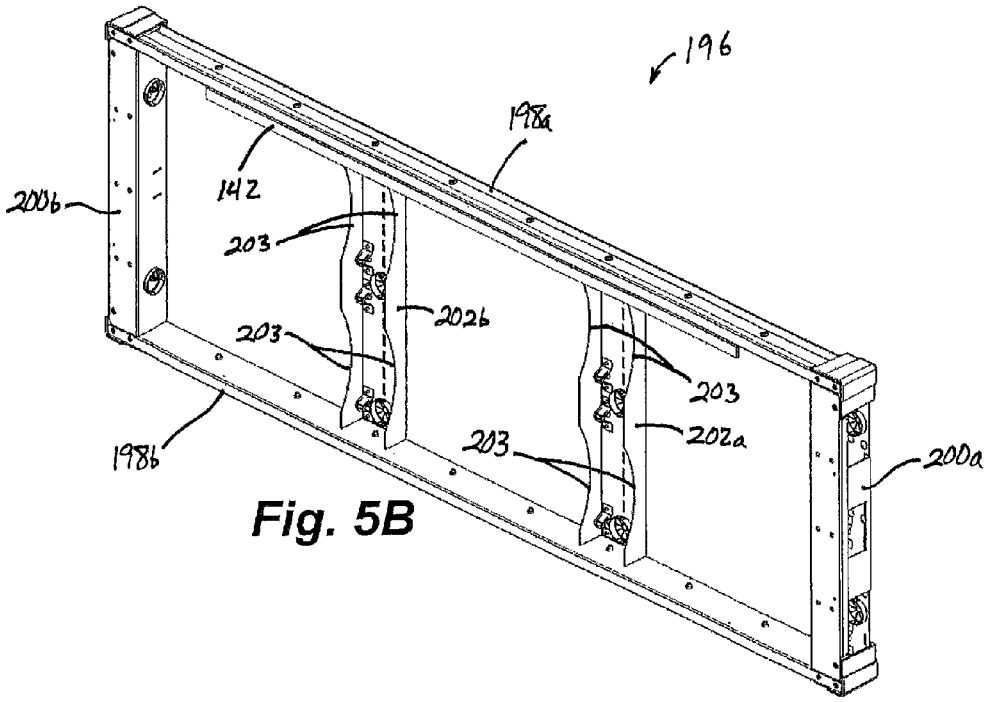
FIG. 5B is a rear perspective view of the framework of FIG. 5A.

It will be appreciated that the wall-mounted modular accessory system of the present invention is not limited to any particular shape, size, or orientation, and may in fact be formed in substantially any size or shape of rectangular (including square) configuration without departing from the spirit and scope of the present invention. For example, and with reference to FIGS. 5A and 5B, a three-cavity framework 196 includes top and bottom frame members 198*a*, 198*b* that are substantially similar or identical to top and bottom frame members 126*a*, 126*b*. Three-cavity framework 196 also includes left and right frame members 200*a*, 200*b* and vertical intermediate frame members 202*a*, 202*b*, all of which are substantially similar to left and right frame members 128*a*, 128*b* and vertical intermediate frame members 136*a-c*, except for being shorter in length, and vertical intermediate frame members 202*a*, 202*b* include contiguous outer surfaces 204, with no need to accommodate a horizontal intermediate frame member. Vertical intermediate frame members 202*a*, 202*b* include upper and lower recessed rear edges 203 for receiving and supporting substantially horizontal wiring at one of two possible vertical locations between the vertical intermediate frame members and the vertical support surface to which the three-cavity framework 196 is attached. Otherwise, three-cavity framework 196 is substantially similar to frameworks 124, 124', including wire pass-throughs, spring clips, bushings, recessed rear edges or surfaces facing a vertical support surface for passing wires between cavities, etc. such that the details of three-cavity framework 196 may be understood with reference to the above descriptions of frameworks 124, 124'.

Figure 6A:
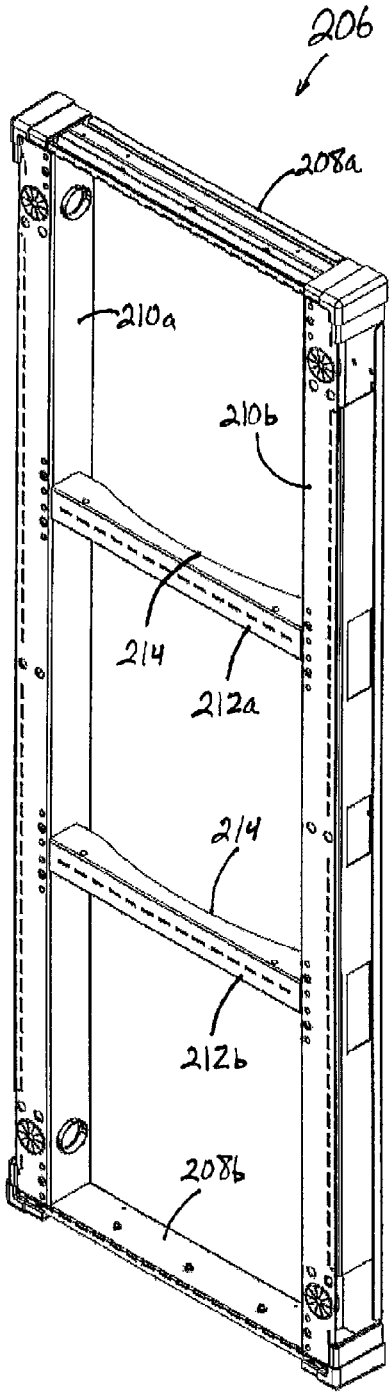
FIG. 6A is a front perspective view of a vertically-oriented framework in accordance with the present invention.
Figure 6B:
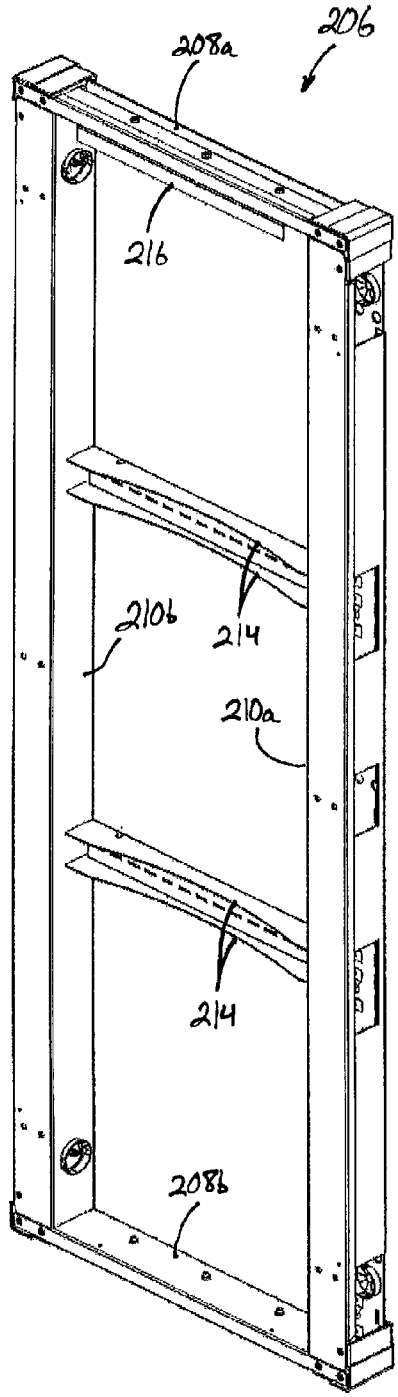
FIG. 6B is a rear perspective view of the framework of FIG. 6A.

As shown in FIGS. 6A and 6B, another three-cavity framework 206 is aligned vertically and includes top and bottom frame members 208*a*, 208*b*, left and right frame members 210*a*, 210, and horizontal intermediate frame members 212*a*, 212*b*. Three-cavity framework 206 is substantially similar to three-cavity framework 196 with exception to changes in length for the top, bottom, right, and left frame members. Horizontal intermediate frame members 212*a*, 212*b* include single, concave recessed rear edges 214 for retaining substantially vertically aligned wiring, whereas vertical intermediate frame members 202*a*, 202*b* of three-cavity framework 196 include dual-concave recessed rear edges 203 for supporting substantially horizontal wiring at one of two possible vertical locations. In addition, three-cavity framework 206 includes a shortened rail-engaging member 216 along a bottom surface of top frame member 208 for engaging a shorter-length hanger rail (not shown). The remaining components of three-cavity framework 206 are substantially similar to those of three-cavity framework 196 and framework 124, 124', such that they are readily understood with reference to the above descriptions of frameworks 124, 124'.

Accordingly, wall-mounted modular accessory systems of the present invention may include frameworks of substantially rectangular size or shape (including square), and generally include widths and heights that are proportional to one another, such as three-by-two (frameworks 124, 124'), three-by-one (three-cavity framework 196), and one-by-three (three-cavity framework 206), or substantially any other even-number ratio (including one-by-one or square), and define a plurality of generally square cavities (such as cavities 140) defined between the frame members. Optionally, it will be appreciated that frameworks in accordance with the present invention need not include intermediate frame members, but instead could include pin-receiving apertures and spring clips along the frame members forming the outer perimeter of the framework for supporting panels and functional modules, without departing from the spirit and scope of the present invention.

Figure 7A:
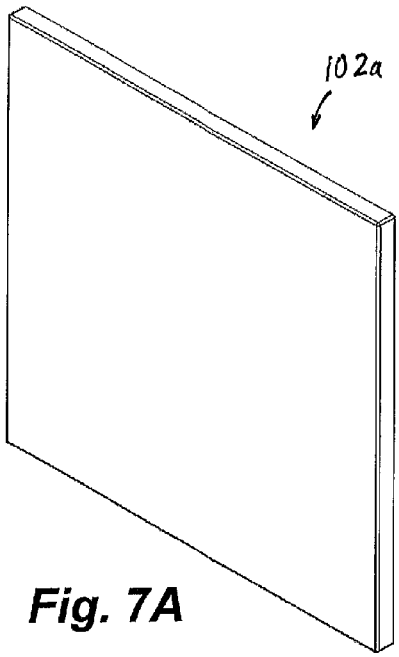
FIG. 7A is a front perspective view of a square decorative panel.
Figure 7B:
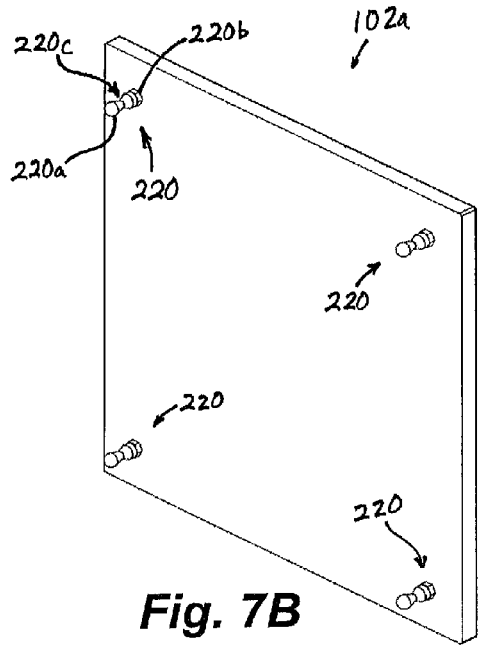
FIG. 7B is a rear perspective view of the square decorative panel of FIG. 7A.
Figure 8A:
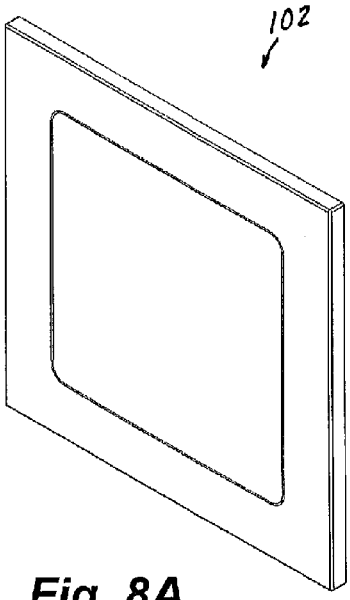
FIG. 8A is a front perspective view of a square functional panel.
Figure 8B:
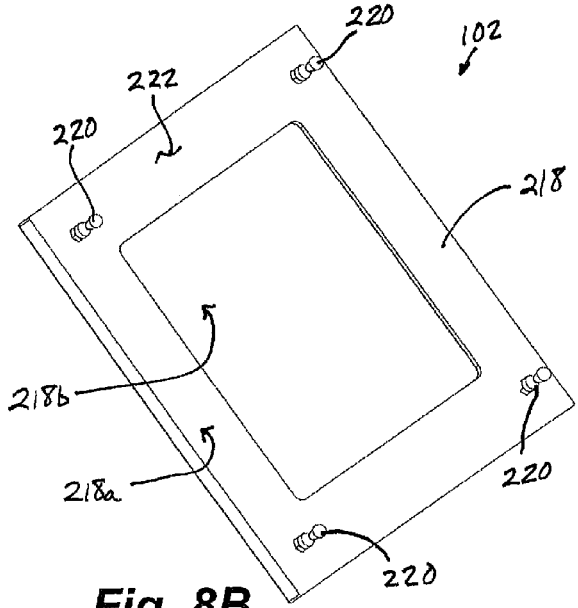
FIG. 8B is a rear perspective view of the square functional panel of FIG. 8A.
Figure 26:
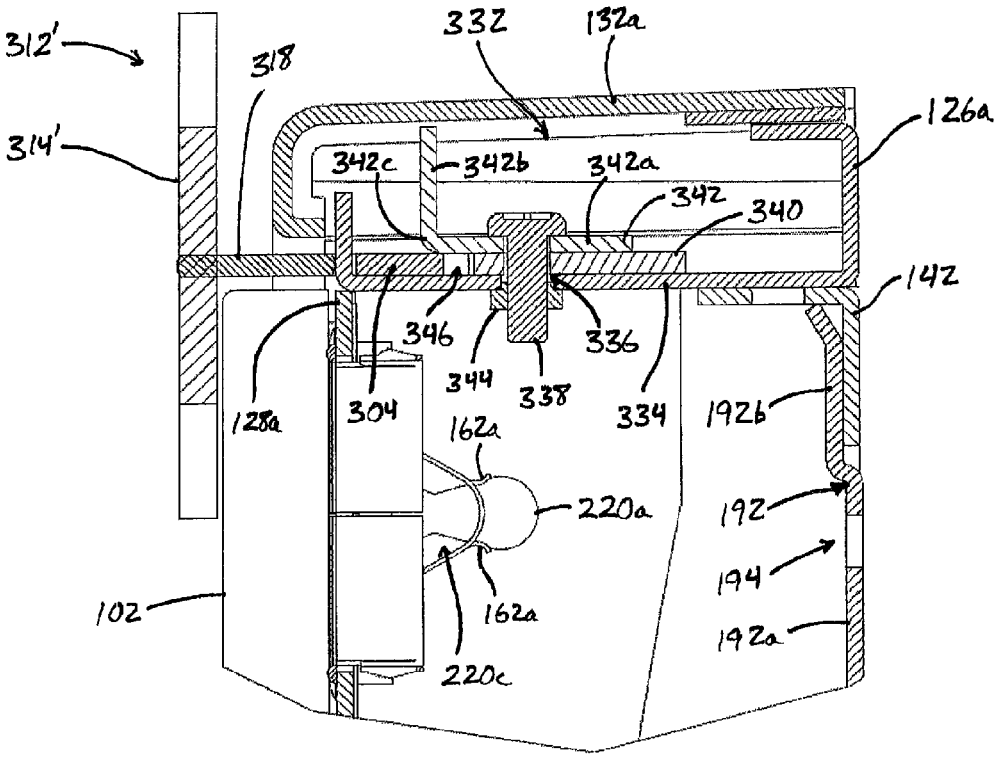
FIG. 26 is a side sectional view taken along line XXVI-XXVI of FIG. 25.

Panels 102 may include useful features, and are not merely limited to square decorative panels 102*a*, and rectangular decorative panels 102*b*. For example, a functional panel 218 may include a frame portion 218*a* and a functional portion 218*b* (FIGS. 8A and 8B). Functional portion 218*b* may be a marker board (similar to marker board 108) or chalk board or other writing surface, or may be a magnetic board or a tack board for pinning or tacking notes thereon, for example. Functional panel 218 includes four engaging members or pin members 220 in evenly-spaced arrangement (e.g., a square pattern), projecting perpendicularly outward from a substantially planar back surface 222 of a frame portion 218*a* of functional panel 218. As is best shown in FIGS. 7B and 26, pin members 220 are non-cylindrical members having a bulbous head portion 220*a*, a base portion 220*b*, a neck-down region 220*c* between bulbous end portion 220*a* and base portion 220*b*, and include a fastener end portion (such as a threaded region or the like) extending from base portion 220*b* oppositely from bulbous end portion 220*a*, for insertion into an aperture in frame portion 218*a* of functional panel 218, and are used for releasably mounting panels 102 (including functional panels 218) to any of the frameworks described herein. Pin members 220 are available, for example, from Harrison Silverdale of Sheffield, United Kingdom, as Part No. 3846 Latch Studs.

To install panels 102, 218 at framework 124, for example, pin members 220 are aligned with pin-receiving apertures 160 in one or more of vertical intermediate frame members 136*a-c* and/or one of left frame member 128*a* and right frame member 128*b*. Once the pin members are aligned, panel 102, 218 is urged straight toward framework 124 in a direction perpendicular to the plane defined by outer surfaces 148*a-c* and outer surfaces 150*a-d*. As bulbous end portions 220 pass through pin-receiving apertures 160, they engage spring fingers 162*a* (FIG. 26) of spring clips 162, which spread apart as panel 102, 218 is urged further toward framework 124. As bulbous end portions 220*a* of pin members 220 begin to pass beyond the spring fingers of spring clips 162, the spring fingers contract toward one another as they begin to engage neck-down region 220*c* of pin members 220. When panel 102, 218 is fully installed at framework 124, the spring fingers of spring clips 162 engage portions of the neck-down regions 220*c* of pin members 220 and resist pulling forces that may draw bulbous end portions 220*a* of pin members 220 back through the spring fingers of spring clips 162.

Accordingly, a person installing panels 102, 218 at framework 124 receives feedback in the form of a positive-feedback or snap-in sensations as spring fingers 162*a* of spring clips 162 initially resist insertion of pin members 220, and then draw pin members 220 further inwardly until neck-down regions 220*c* are received between the spring fingers 162*a* of spring clips 162. The retention force of each of spring clips 162 upon one pin member 220 may be approximately eleven pounds, for example, such that an eleven pound force must be applied to panel 102, 218, perpendicularly away from framework 124 and opposite to the direction of insertion, in order to overcome the retention forces of one spring clip 162 and remove the panel. Thus, for example, a panel having four pin members 220 would require approximately forty-four pounds of removal force to remove panel 102, 218 from framework 124.

Optionally, a portion of panel 102, 218 adjacent an edge thereof may be engaged or removed first so as to reduce the total installation or removal force necessary to install the panel. For example, to install functional panel 218 at framework 224 all four pin members 220 may be aligned with pin-receiving apertures 160 and held in place with a light horizontal force applied to panel 218 against framework 124 to maintain alignment. Then, the user selects one edge portion of panel 218 to apply at least twenty-two pounds force in order to urge the two corresponding pin members 220 into engagement with corresponding spring clips 162. The opposite edge portion of functional panel 218 is then urged so that its corresponding pin members 220 engage with corresponding spring clips 162. In this manner, only twenty-two pounds of force are required at any given time to install panel 218, and the panel 218 is pivoted slightly during installation by selective engagement of pin members 220 in a two-at-a-time fashion.

Figure 9A:
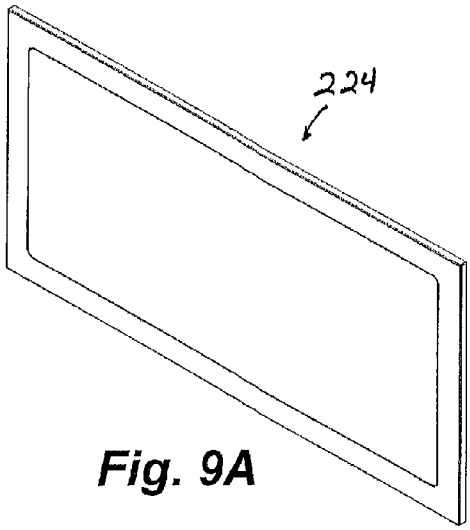
FIG. 9A is a front perspective view of a rectangular functional panel.

Rectangular panels, such as rectangular decorative panels 102*b* (FIGS. 1A, 1B, and 30A-F), and rectangular functional panels 224 (FIGS. 9A, 9B) may be installed in a similar fashion, and may include pin members 220 in spaced arrangement so that each single pin member 220 is associated with at least three other pin members to form a rectangular pattern. For example, and with reference to FIG. 9B, a top-middle pin member 220 is a part of two different rectangular patterns of pin members, one of which is defined by pin members 220 located directly below the top-middle pin member, another pin member located below and to the left of the top-middle pin member, and another pin member located directly to the left of the top-middle pin member. Top-middle pin member 220 is further associated with the rectangular pattern of pin members defined by the top-middle pin member, the bottom-middle pin member directly below, the pin member located directly to the right of top-middle pin member, and the pin member located diagonally below and to the right of top-middle pin member.

Figure 9B:
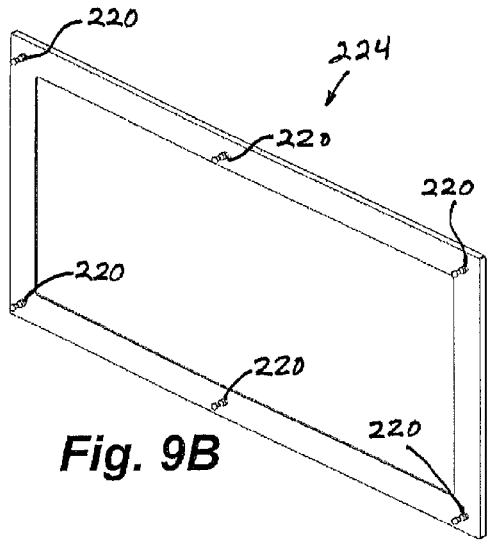
FIG. 9B is a rear perspective view of the rectangular functional panel of FIG. 9A.
Figure 10A:
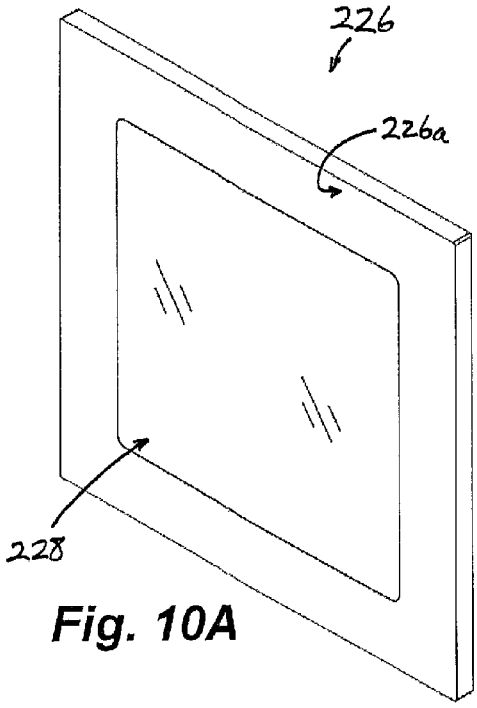
FIG. 10A is a front perspective view of a square panel having a translucent insert.
Figure 10B:
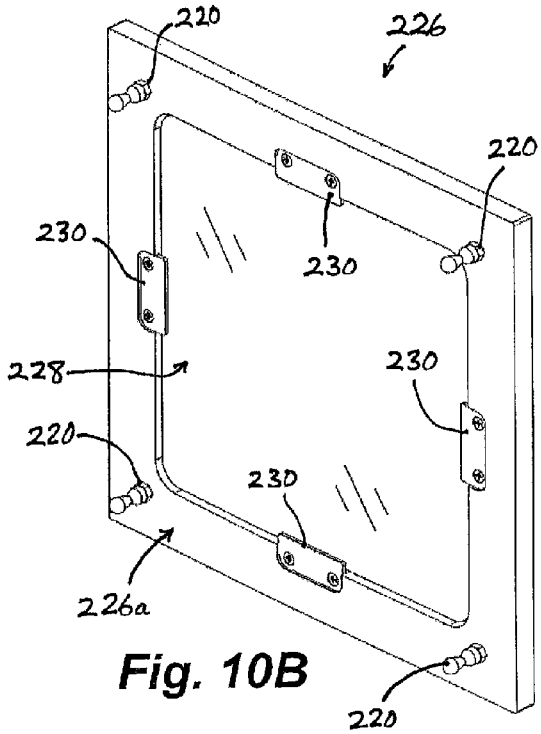
FIG. 10B is a rear perspective view of the square panel of FIG. 10A.

In the illustrated embodiment, the top-middle and bottom-middle pin members on rectangular panel 224 are positioned somewhat closer to the left-side pin members than they are to the right-side pin members, as shown in FIG. 9B. This arrangement permits rectangular panel 224 to be positioned at framework 124 in either of two vertical orientations, and in either of two horizontal orientations. When panel 224 is placed in a first vertical orientation, the top-middle and bottom-middle pin members (as viewed in FIG. 9B) engage lower-middle pin-receiving apertures 160 at framework 124, while in a second vertical orientation (rotated 180 degrees from the first vertical orientation) the top-middle and bottom-middle pin members engage upper-middle pin-receiving apertures 160 at the framework. Similarly, when panel 224 is placed in a first horizontal orientation, the top-middle and bottom-middle pin members engage left-middle pin-receiving apertures 160 at framework 124, while in a second horizontal orientation (rotated 180 degrees from the first horizontal orientation) the top-middle and bottom-middle pin members engage right-middle pin-receiving apertures 160 at the framework. Accordingly, even with pin members 220 in partially-unevenly spaced arrangement on rectangular panel 224, the panel may be positioned at any of four different orientations because of the locations of pin-receiving apertures 160 on framework 124.

Rectangular functional panel 224 is substantially identical to square functional panel 218, with exception to it having double the width (or height, depending on its orientation) and an extra two pin members 220 along its back surface. It will be appreciated that the more pin members 220 there are to engage spring clips 162, the greater the force required to install or remove the panels from framework 124. For example, if the engagement/removal force for pin members 220 from spring clips 162 is eleven pounds force each, it will require approximately sixty-six pounds force to insert all six pin members 220 of rectangular functional panel 224 into corresponding spring clips 162 in framework 124. Of course, this force may be reduced somewhat by inserting pin members 220 into spring clips 162 either two or three at a time by applying force to only one edge portion of rectangular functional panel 224 at a time. Therefore, it may be desirable, for example, to use a small pry bar along one edge of rectangular functional panel 224 for removal of the panel from framework 124, because removal is typically more difficult than installation owing to the lack of gripping surfaces on the panel.

Square decorative panels 102*a* (FIGS. 1A, 1B, 7A, 7B, and 30F) are substantially similar to functional panels 218, but generally do not provide any functional features, and may instead include aesthetic designs, patterns, wood grains, textures, or the like to present a pleasing surface on the module accessory system, or simply to cover an otherwise blank portion of framework 124 that is not occupied by a functional module 104 or a functional panel. Optionally, square decorative panels 102*a* (or rectangular decorative panels 102*b*) may provide some level of function, such as comprising acoustical tiles for sound absorption, or other functions that may be accomplished independently of the outward appearance of the panel.

Still another type of panel 102 is a functional panel 226 incorporating a translucent pane or window 228. Translucent panels 228 may be substantially transparent and clear, partially opaque (such as "frosted"), textured, or incorporate aesthetic objects or patterns to present a pleasing appearance, and may transmit light from behind panel 226. Translucent panel 228 is held in place by brackets 230 that hold panel 228 against a lip along the inner surface of a frame portion 226*a* of the functional panel 226.

Figure 12:
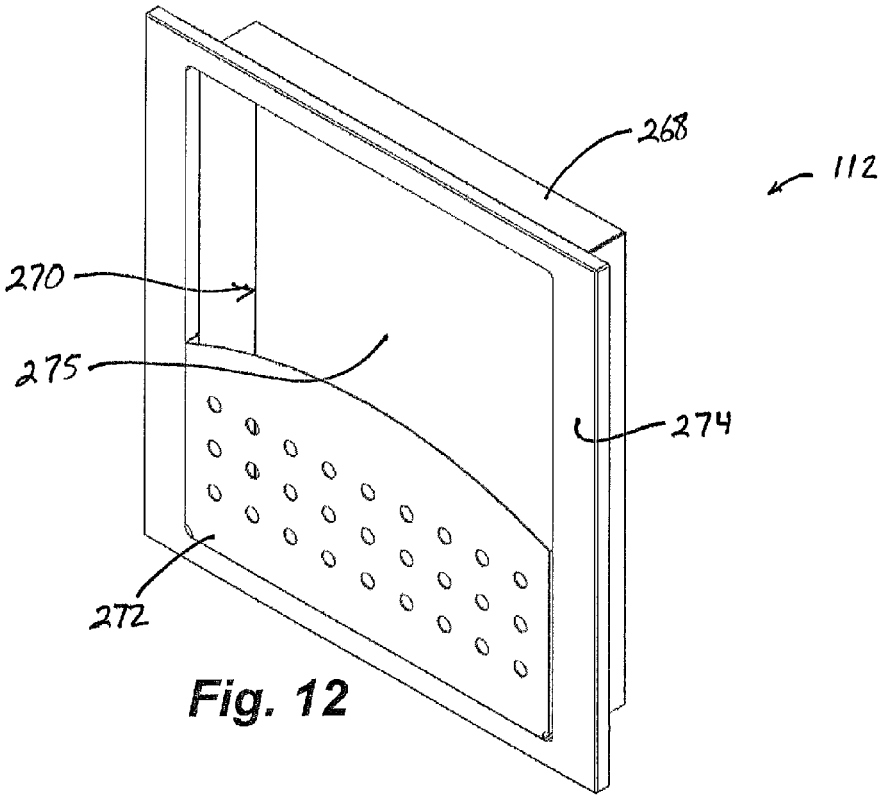
FIG. 12 is a front perspective view of a file storage module.
Figure 13A:
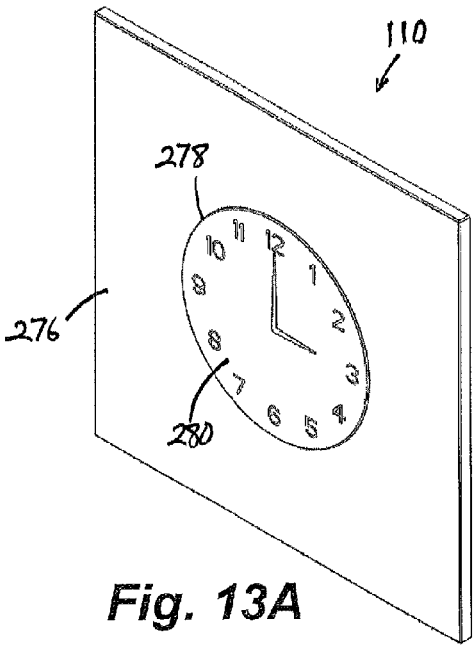
FIG. 13A is a front perspective view of a clock module.
Figure 13B:
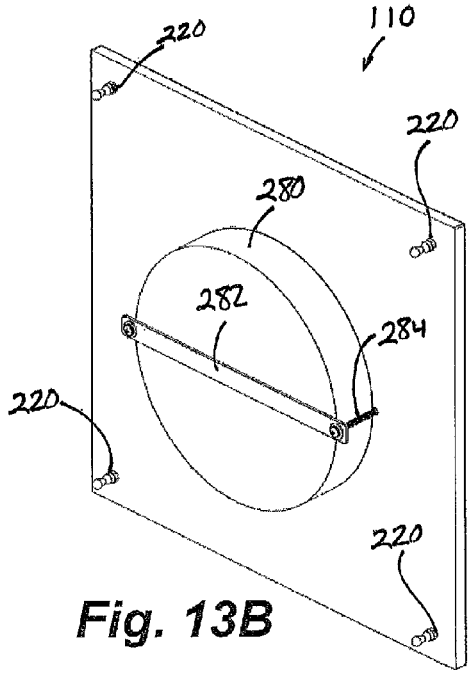
FIG. 13B is a rear perspective view of the clock module of FIG. 13A.
Figure 14A:
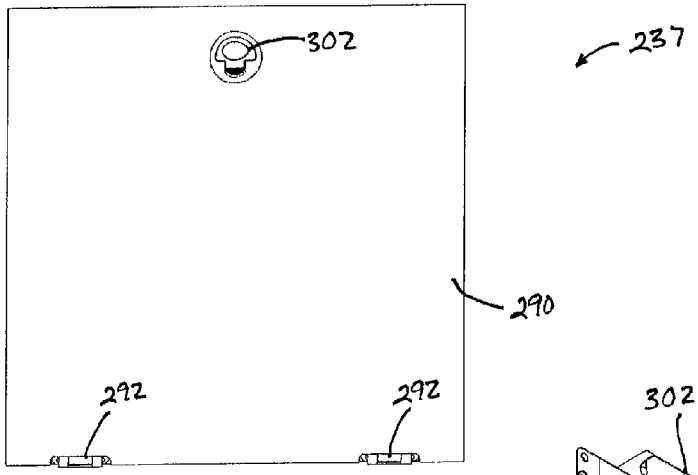
FIG. 14A is a front plan view of a power module with the door closed.
Figure 14B:
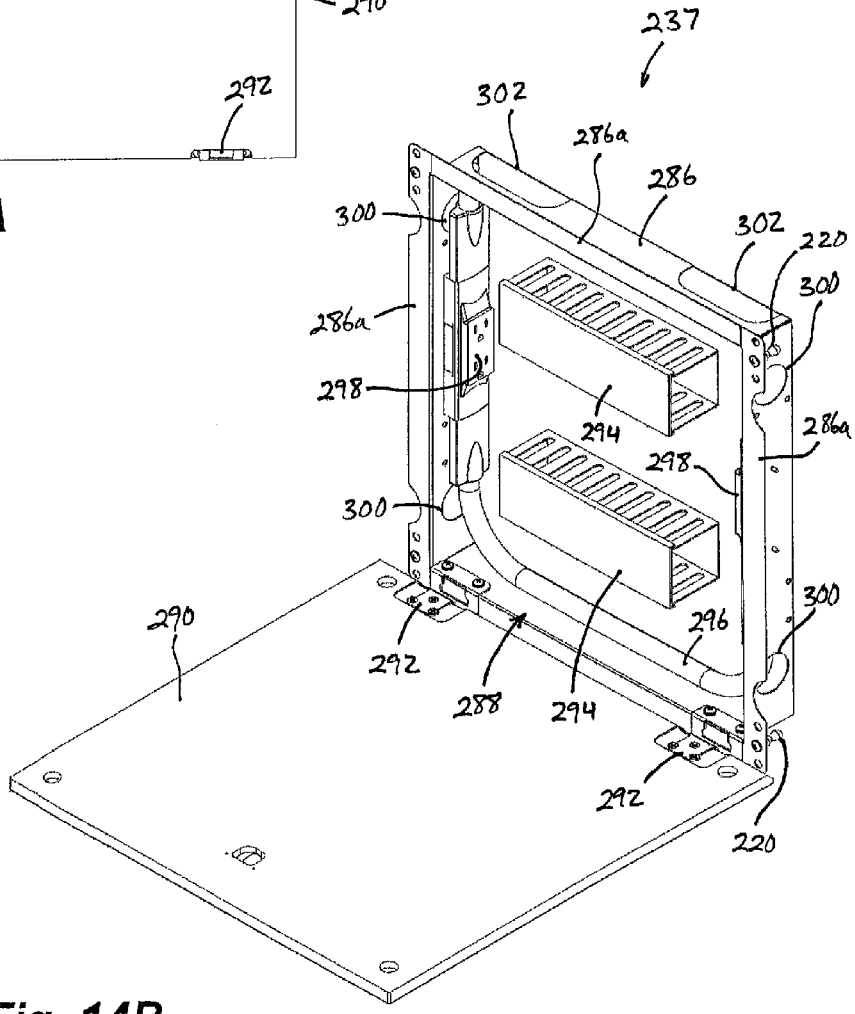
FIG. 14B is a front perspective view of the power module of FIG. 14A, with the door in an open position.
Figure 16A:
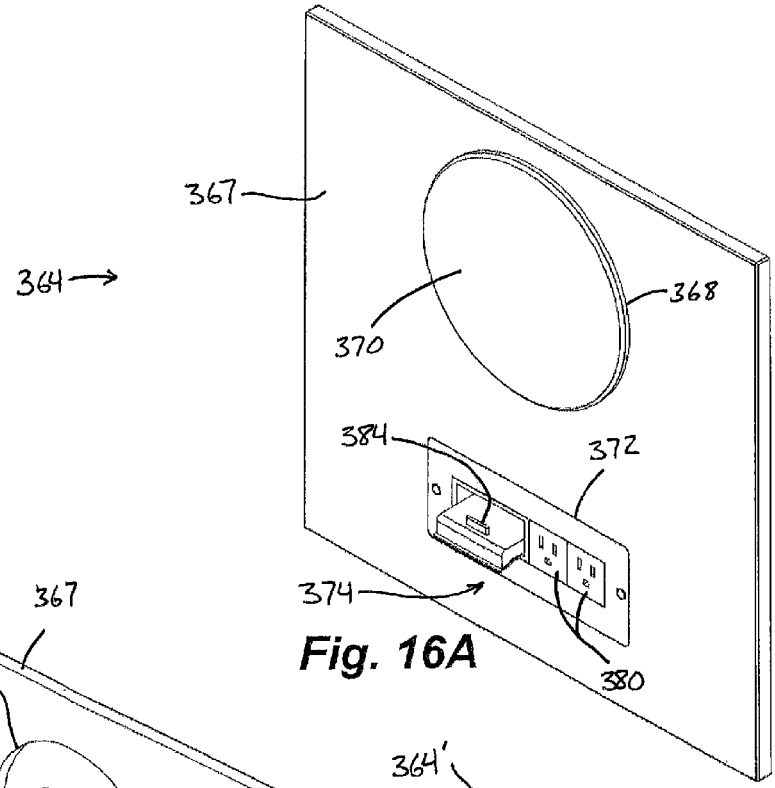
FIG. 16A is a front perspective view of an entertainment module.
Figure 16B:
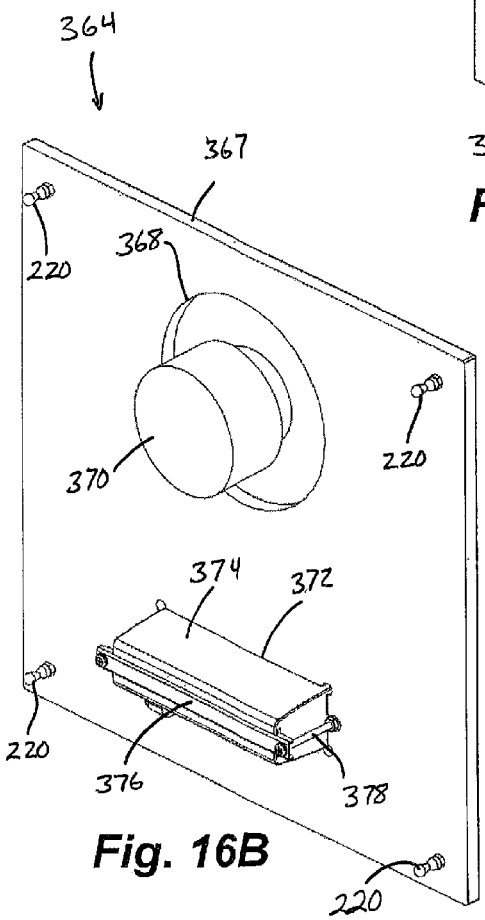
FIG. 16B is a rear perspective view of the entertainment module of FIG. 16A.
Figure 18A:
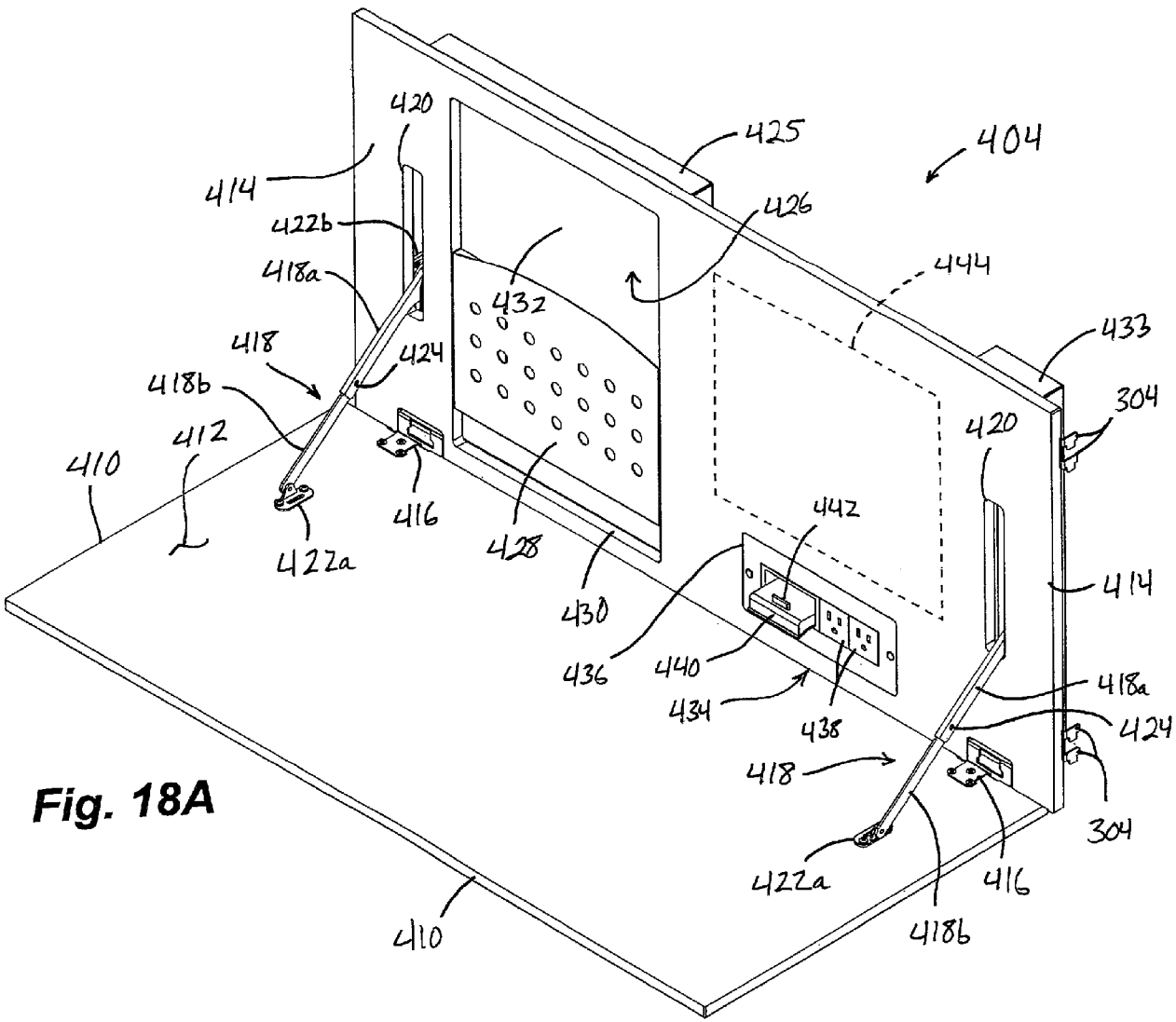
FIG. 18A is a front perspective view of a workstation module.
Figure 19A:
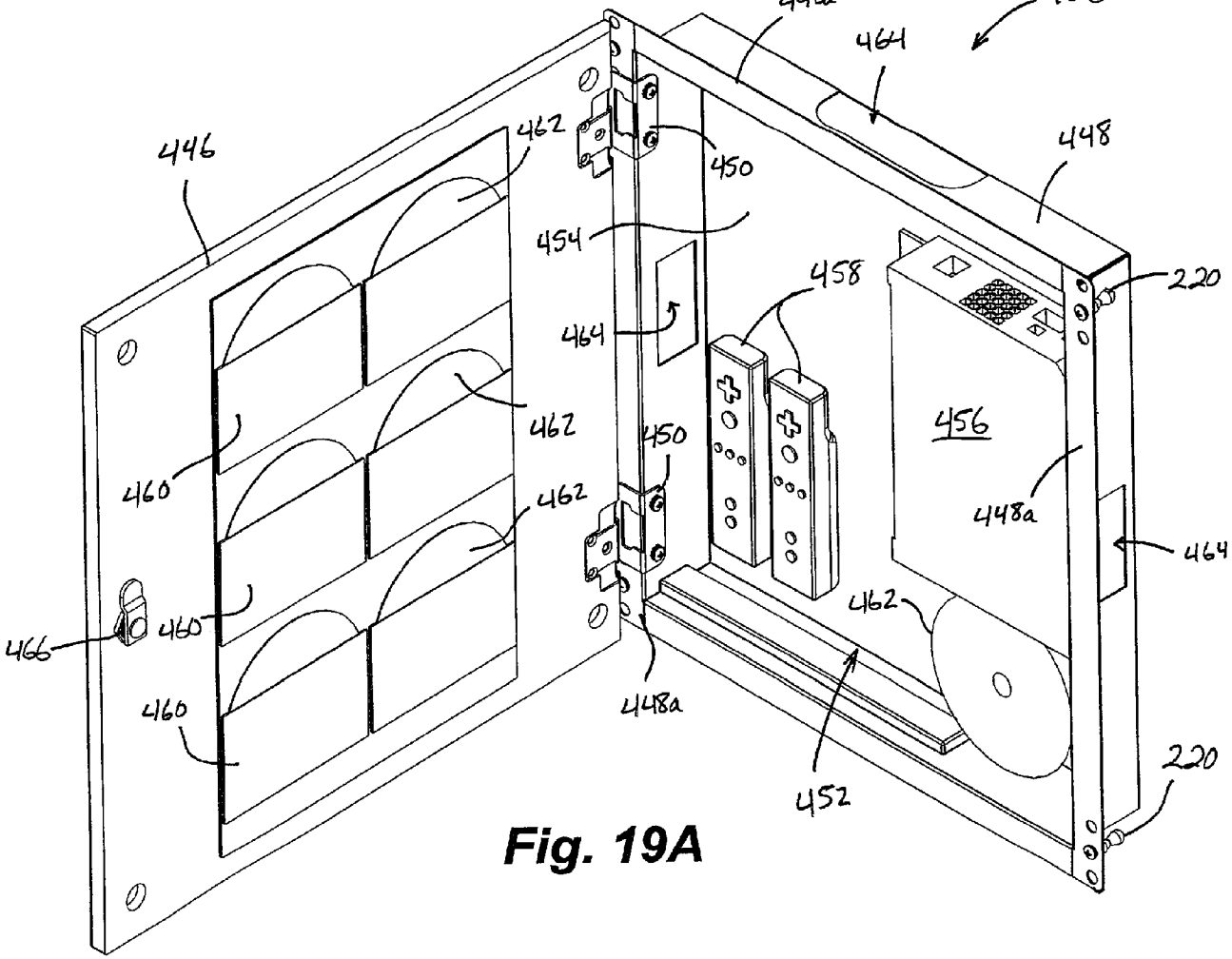
FIG. 19A is a front perspective view of a video game module.
Figure 20:
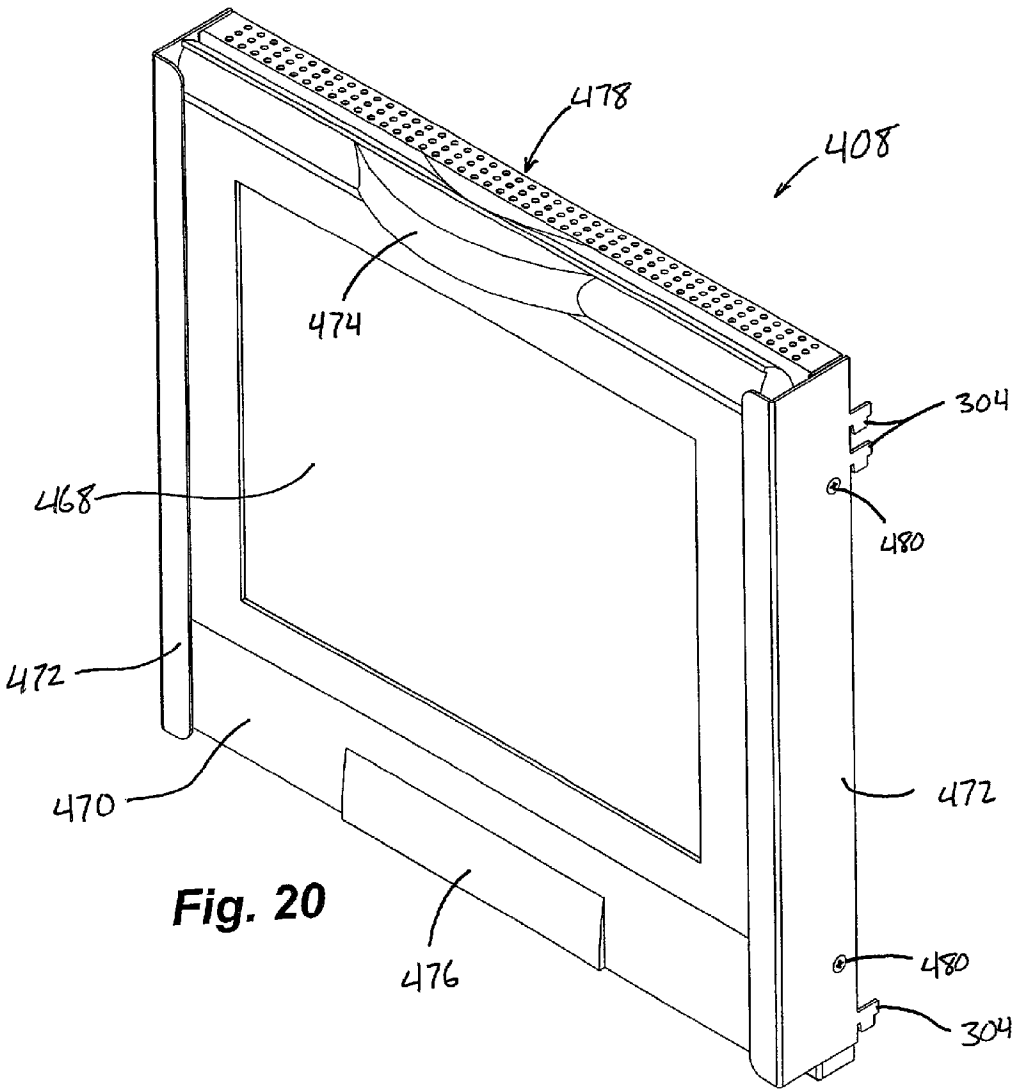
FIG. 20 is a front perspective view of a video conferencing module.

Many different types of functional modules 104 are possible, which install on framework 124 in substantially the same manner as square decorative panels 102*a* and functional panels 218, 226 using pin members 220. For example, functional modules 104 may include lockable storage module 114 (FIGS. 11A-11C), file storage module 112 (FIG. 12), clock module 110 (FIGS. 13A and 13B), a power module 237 (FIGS. 14A-15), an entertainment module 364 (FIGS. 16A and 16B), a lighted module 366 (FIGS. 17A and 17B), a workstation module 404 (FIG. 18A), a video game module 406 (FIG. 19A), and a video conferencing module 408 (FIG. 20). Optionally, functional modules 104 may be equipped with slot-engaging projections 304 that engage vertical slots 166*a* in one or more of vertical intermediate frame members 136*a-c* and left and right members 128*a*, 128*b*, which would allow at least some functional modules to be installed over other panels 102, such as will be described below.

Lockable storage module 114 (FIGS. 11A-11C) includes an outer frame portion 238, a housing 240 defining a cavity 242, and a pivotable door or cover 244. Housing 240 may be made from stamped sheet metal or the like, and includes a perimeter or flange 240*a* for engagement with a back surface of outer frame portion 238. A back wall 246 of housing 240 includes a series of raised engaging members 248 for engagement by repositionable shelves 250 (FIG. 11B), the shelves 250 having downwardly projecting tabs 250*a* (FIG. 11C) for engagement with raised engaging members 248 in order to support the shelves 250 inside cavity 242. Housing 240 may be fastened to the back surface of outer frame portion 238 by pin members 220 which extend through holes in the perimeter flange 240*a* and are threadably received in outer frame portion 238.

Figure 11A:
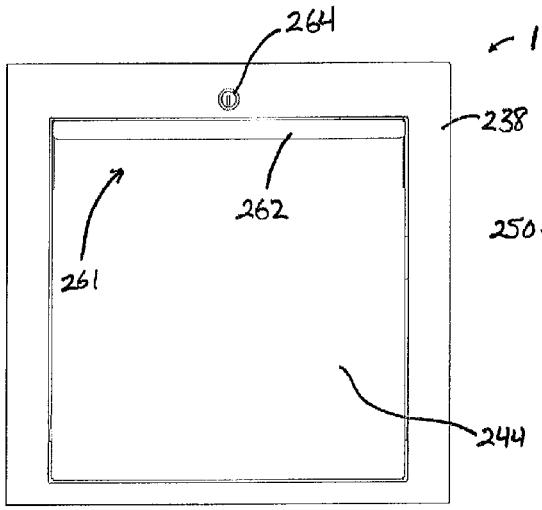
FIG. 11A is a front plan view of a lockable storage module, with the door in a closed position.
Figure 11B:
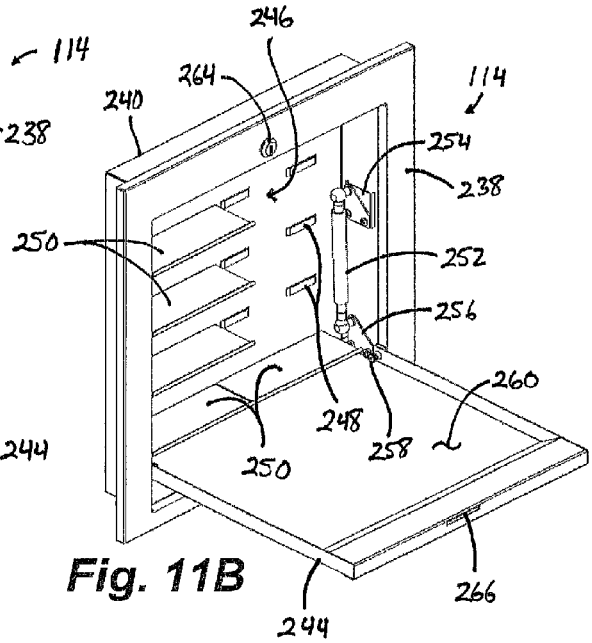
FIG. 11B is a front perspective view of the lockable storage module of FIG. 11A, with the door in an open position.
Figure 11C:
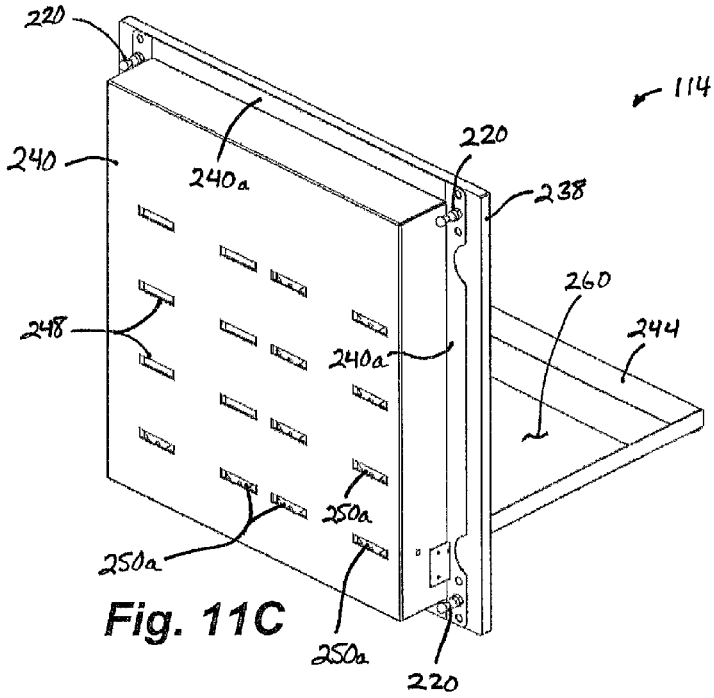
FIG. 11C is a rear perspective view of the lockable storage module of FIG. 11B.
Figure 11D:
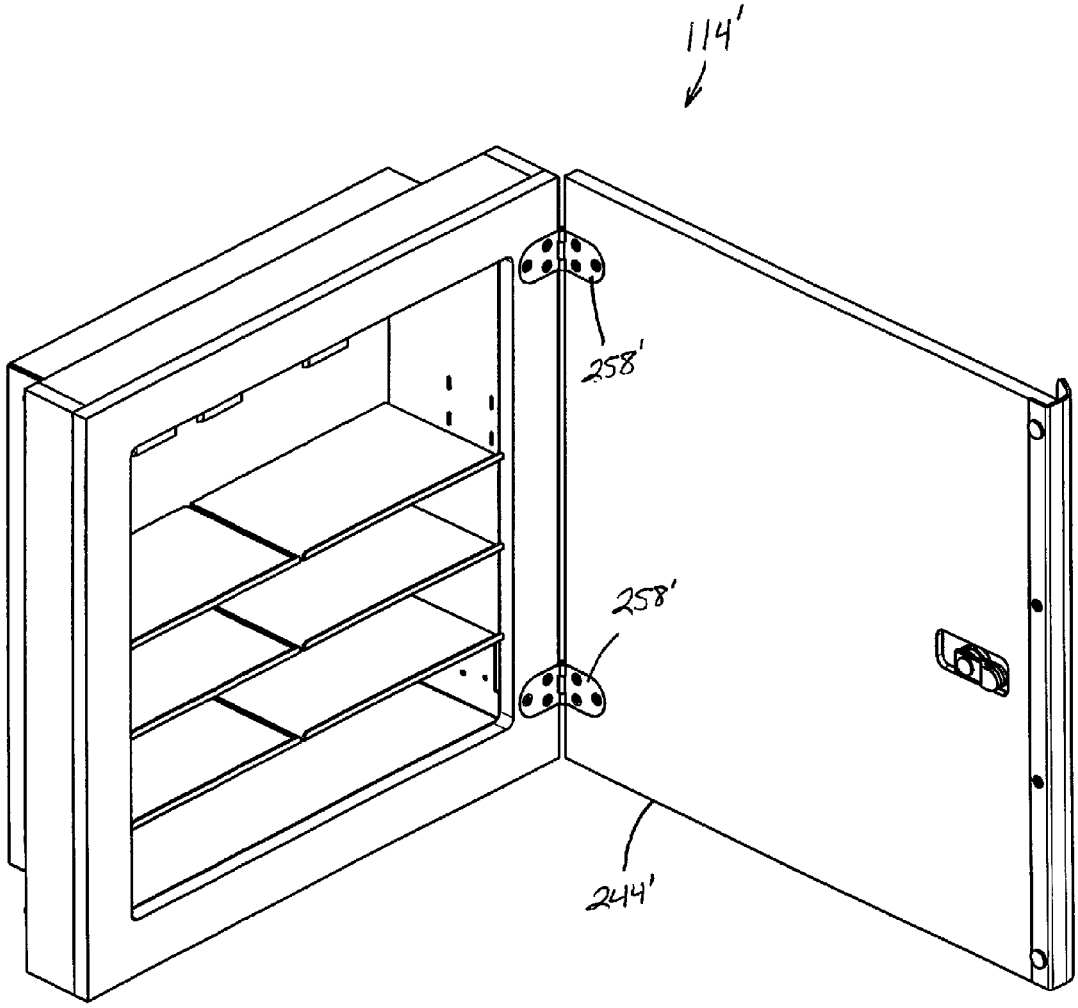
FIG. 11D is a front perspective view of another lockable storage module, with the door in an open position.

Optionally, a gas spring 252 is coupled between bracket 254 on housing 240 and a bracket 256 at a lower portion of pivotable door 244 near a hinge member 258 that attaches door 244 to housing 240. Preferably, gas spring 252 provides a slow-open feature for door 244, and holds door 244 in a substantially horizontal position (FIGS. 11B and 11C) to provide a work surface or temporary storage surface 260 on the back side of door 244. Door 244 includes a recess 261 with a handle 262 (FIGS. 1A, 1B, and 11A) to aid in opening the door, and an optional lock 264 is operable to engage a slot 266 (FIG. 11B) along an upper edge of door 244 in order to lock the door in the closed position (FIG. 11A). Lockable storage module 114 can thus be used for secure storage of medicines or other small valuable objects upon shelves 250 within housing 240, and door 244 may be used for temporary storage or organization while the door is in its open position. Optionally, a lockable storage module 114' (FIG. 11D) is substantially similar to module 114, except that module 114' is equipped with a pair of side-mounted hinges 258' so that its door 244' opens about a vertical axis defined by the hinges 258'.

File storage module 112 (FIG. 12) includes a housing 268, such as a stamped metal housing similar to housing 240 of lockable storage module 114, the housing 268 defining an interior cavity 270 for storing documents or other thin or small articles. A partial wall or fence 272 is mounted to a lower region of an outer frame portion 274 and spaced from a back wall 275 of housing 268 for retaining documents in the cavity 270. Housing 268 may be coupled to outer frame portion 274 using pin members 220 (not shown in FIG. 12), in a similar manner to lockable storage module 114, with pin members 220 positioned for engagement at different locations along framework 124.

Clock module 110 (FIG. 13A-13B) includes a panel or an outer frame portion 276 having an aperture 278 for exposing the face of a clock 280. Clock 280 is held in place by a bracket member 282 (FIG. 13B) that urges clock 280 toward outer frame portion 276 and aperture 278 from behind, using fasteners 284 that threadably engage outer frame portion 276.

Power module 237 (FIGS. 14A-15) includes a housing 286, which may be a stamped metal housing similar to housing 240 of lockable storage module 114. Housing 286 defines an interior cavity 288, and a door or panel 290 is pivotally mounted to a lower portion of housing 286 via a pair of hinges 292. Positioned along interior surfaces of housing 286 is a pair of wire storage boxes 294 for containing bundled wires, wire conduits 296 for routing wires through cavity 288, and power and/or data outlets 298. Wire conduits 296 receive wiring 182 from outside power module 237 and route it safely through cavity 288 to power/data outlets 298, where power and/or data couplers may be engaged or plugged in to access electrical power and data signals provided at outlets 298. Housing 286 includes a plurality of apertures 300 for receiving wiring 182 therethrough and/or to ventilate cavity 288. Optionally, a finger pull 302 is provided to facilitate opening door 290. Housing 286 includes a perimeter flange 286*a* with holes for threadably receiving pin members 220 for engagement with the framework.

Figure 16C:
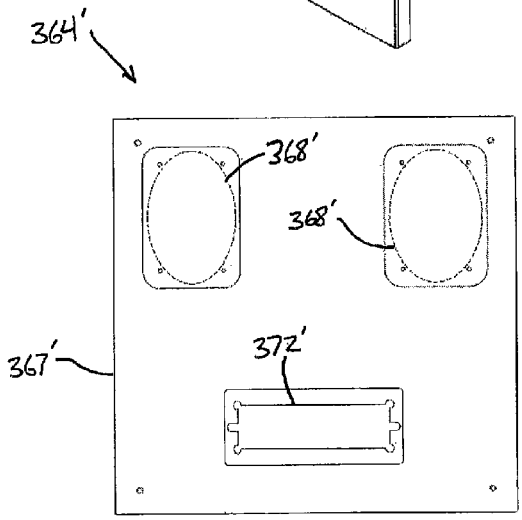
FIG. 16C is a rear elevation of a panel portion of another entertainment module.

Entertainment module 364 (FIGS. 16A and 16B) includes a panel or outer frame portion 367 having a round aperture 368 for receiving a speaker 370 and a rectangular aperture 372 for receiving a docking and power unit 374. Speaker 370 is representative of substantially any sound-producing device, such as two or more stereo speakers or the like that are in electronic communication with docking and power unit 374, such as via wired or wireless transmission. Docking and power unit 374 is held in place by a bracket member 376 (FIG. 16B) that urges docking and power unit 374 toward outer frame portion 367 and rectangular aperture 372 from behind, using fasteners 378 that threadably engage outer frame portion 367. Docking and power unit 374 includes grounded power outlets 380 and a docking station 382 with an electrical/mechanical coupler 384 for mechanically and electronically coupling to a digital music player (such as an Apple IPOD® or the like). Docking and power unit 374 receives electrical power via wiring 182 (not shown in FIGS. 16A and 16B) and may provide a battery-charging function for a digital music player in addition to amplifying and conveying sound signals to speaker 370. Optionally, another entertainment module 364' (FIG. 16C) having an outer frame portion 367' may include two or more speaker apertures 368' for producing stereo or "surround" sound effects using multiple speakers (not shown) in wired or wireless communication with a docking and power unit in a rectangular aperture 372'. Optionally, it is envisioned that entertainment module 364 may include a display screen for showing still photos, movies, or other images supplied by an electronic data device coupled to docking station, or may send sound and/or image or video signals to a remote speaker or monitor located elsewhere on the modular accessory system, such as television or monitor 118.

Lighted module 366 (FIGS. 17A and 17B) includes an outer frame portion 386 with a translucent panel 388, and a housing 390 for supporting a tube-light strand or light source 392 behind translucent panel 388. Translucent panel 388 is supported at frame portion 386 using brackets 394 in a similar manner as translucent panel 228 of functional panel 226, described above. Housing 390 may be a stamped metal housing that is fastened to a back surface of outer frame portion with pin members 220. Tube-light strand 392 or other light source (such as incandescent, fluorescent, or LED bulbs) is positioned along an inner perimeter surface of housing 386 (FIG. 17B) and supplied with electrical power via a wire 396 that passes through an aperture in the back wall of housing 390, and an electrical coupler 398 at the end of the wire. With tube-light strand 392 illuminated, the emitted light passes through translucent panel 388 and into the room or area in which lighted module 366 is installed. Housing 390 includes a perimeter flange 390*a* with holes for threadably receiving pin members 220 for engagement with the framework.

Another lighted module 366' (FIGS. 17C and 17D) includes a pair of translucent panels 388*a*', 388*b*' for transmitting light that is emitted from inside the module. The outer or front translucent panel 388*a*' is generally decorative in nature, and may include different colors, textures, or patterns to provide visual interest. The inner or rear translucent panel 388*b*' is a light diffuser (e.g. having a "frosted" appearance)

that causes light to be distributed more evenly through the front translucent panel 388*a*'. Translucent panels 388*a*', 388*b*' may be coupled to a housing 386' via fasteners 387' that may double as aesthetic covers to obscure apertures 389' in front translucent panel 388*a*'.

Figure 17A:
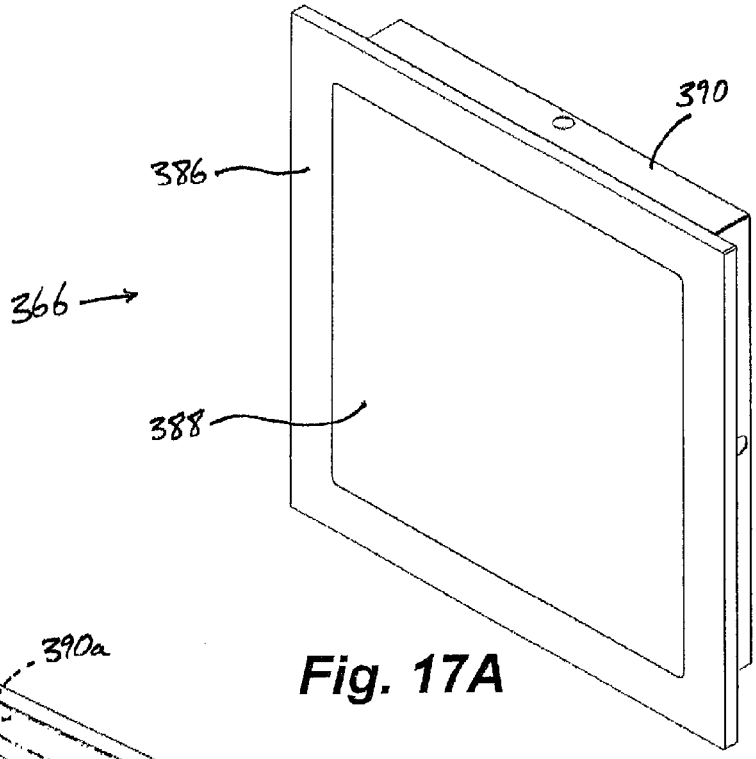
FIG. 17A is a front perspective view of a lighted module.
Figure 17B:
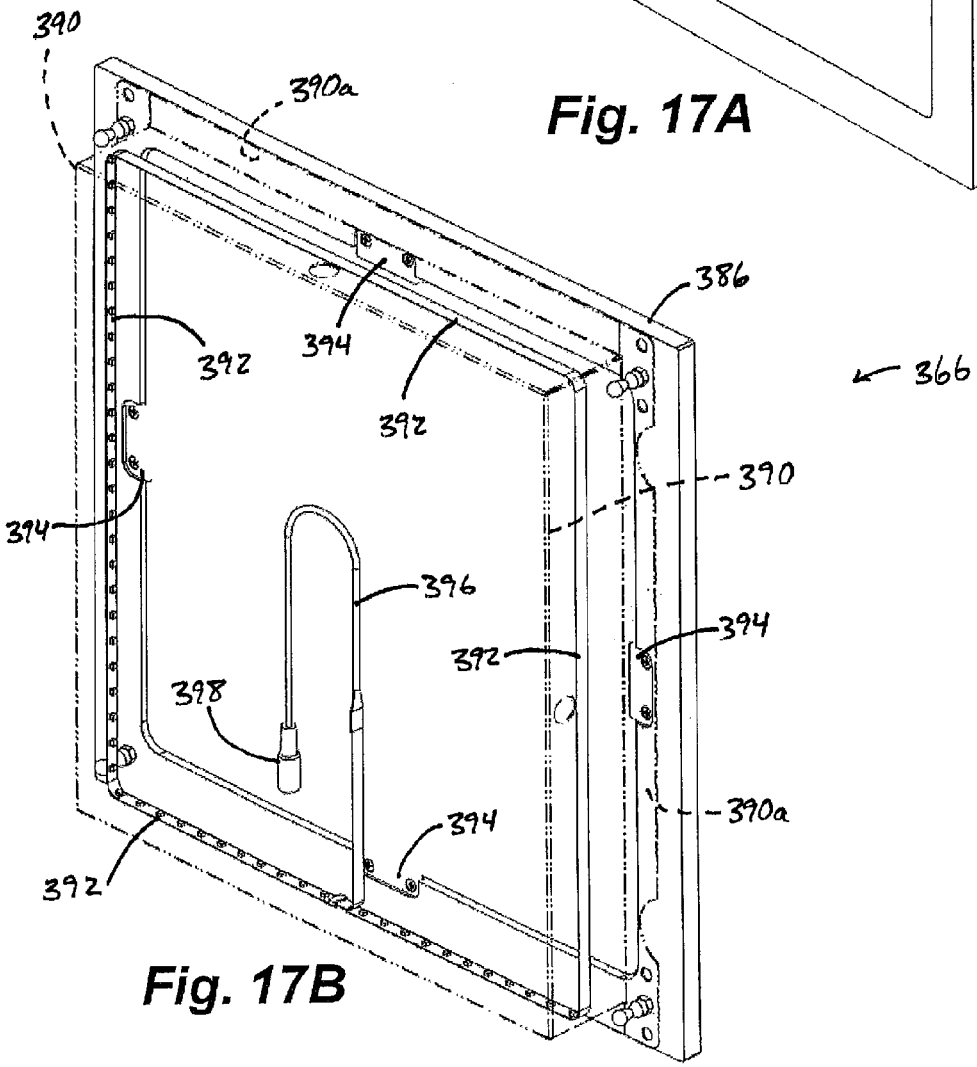
FIG. 17B is a rear perspective view of the lighted module of FIG. 17A.
Figure 17C:
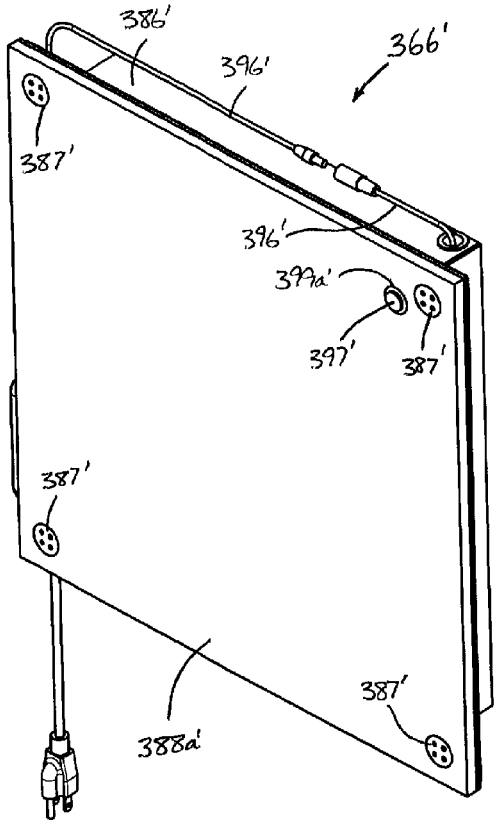
FIG. 17C is a front perspective view of another lighted module.
Figure 17D:
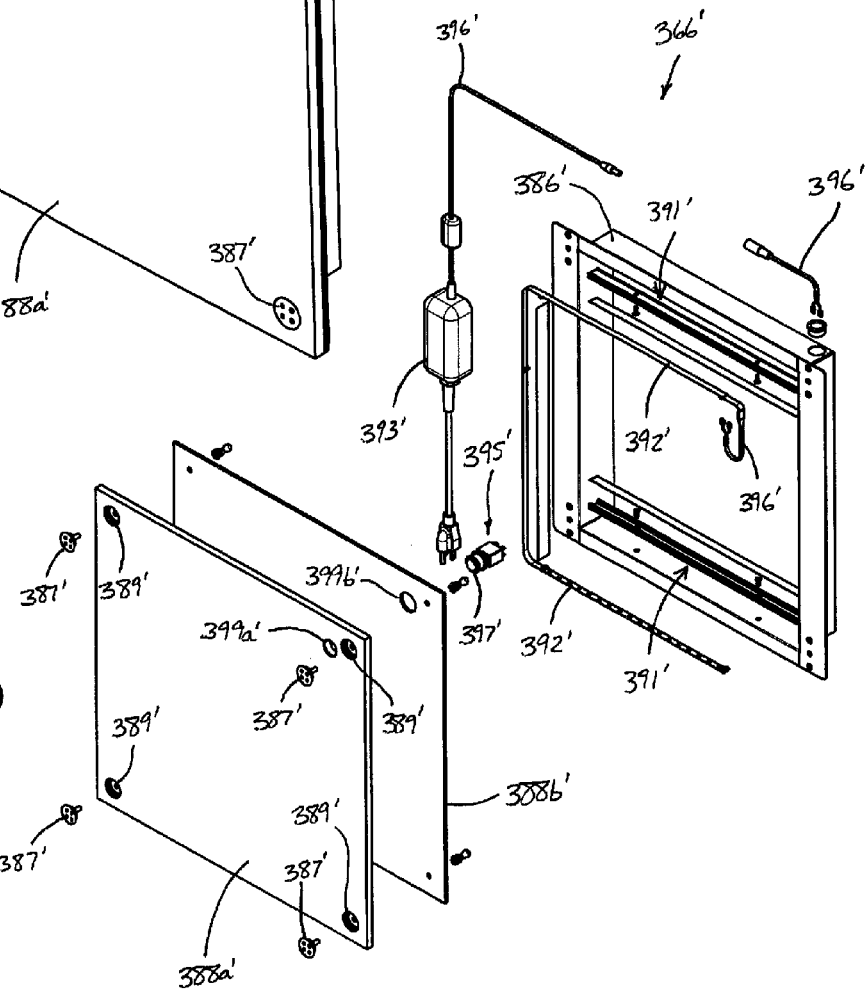
FIG. 17D is an exploded front perspective view of the lighted module of FIG. 17C.

A light strand 392' is positioned along brackets 391' and/or an inner perimeter surface of the housing 386' and is supplied with electrical power via a wire 396' in electrical communication with a DC transformer 393', which in turn may be coupled to an AC power source, such as at power module 237. A switch 395' including an on/off push button 397' may be electrically coupled in-line along wire 396' to selectively energize light strand 392'. Respective openings 399*a*', 399*b*' in translucent panels 388*a*', 388*b*' receive a portion of switch 395' and permit a user to actuate push button 397' from the front of module 366'. Lighted module 366' is substantially similar to lighted module 366 in other respects, so that a more complete understanding of the components and operation of module 366' may be understood with reference to module 366 (FIGS. 17A and 17B).

Workstation module 404 (FIG. 18A) includes a front panel 410 defining a work surface 412, the front panel 410 pivotally connected to a generally vertical and planar base member 414 via a pair of hinges 416. A pair of pivotable and extendable lock-arms 418 extend through respective slots or apertures 420 in base member 414, have distal ends that pivotably couple to work surface 412 at respective lower brackets 422*a*, and have proximal ends that pivotably couple to respective housings along a back side of planar base member 414 at upper brackets 422*b*. Lock-arms 418 include upper members 418*a* and lower members 418*b*, the upper members 418*a* being coupled to lower members 418*b* at pivots 424 located at approximately mid-span of the lock-arms. Front panel 410 is pivotable between a lowered or in-use position (shown) in which front panel 410 is supported by lock-arms 418 substantially perpendicular to planar base member 414 with work surface 412 facing base member 414, and a raised or storage position in which front panel 410 is substantially parallel to planar base member 414. In the lowered position, upper and lower members 418*a*, 418*b* of lock-arms 418 are substantially parallel and collinear so as to prevent front panel 410 from being accidentally raised. To raise front panel 410, upper and lower members 418*a*, 418*b* of lock-arms 418 are moved so as to be non-parallel (such as by pulling outwardly at pivots 424), after which front panel 410 may be pivoted upwardly with lock-arms 418 receding into apertures 420 as the front panel is fully closed.

Workstation module 404 includes a housing 425 along a back portion of base member 414, the housing 425 defining an interior cavity 426 (similar to cavity 270 of file storage module 112) for storing documents or other thin or small articles, and also for supporting upper bracket 422*b* and housing the corresponding lock-arm 418 when front panel 410 is in its raised position. A partial wall or fence 428 is mounted at an opening 430 in base member 414, the opening 430 providing access to interior cavity 426, and the partial wall or fence 428 being spaced from a back wall 432 of housing 425 for retaining documents in the cavity 426. A second housing 433 is provided along a back portion of base member 414 for receiving an upper bracket (not shown) for pivotably supporting the corresponding lock-arm 418 and housing the lock-arm when front panel 410 is in its raised position.

Workstation module 404 further includes a docking and power unit 434 mounted in a generally rectangular aperture 436 in base member 414. Docking and power unit 434 includes grounded power outlets 438 and a retractable docking station 440 with an electrical/mechanical coupler 442 for mechanically and electronically coupling to a digital music player (such as an Apple IPOD® or the like). Docking and power unit 436 is substantially similar in mounting and power/data connections as docking and power unit 374 of entertainment module 364 such that these details need not be repeated herein. Workstation module 404 may further include data ports or jacks, such as Internet or intranet couplings, for connecting computers or other electronic devices to various data sources. Optionally, it is envisioned that workstation module 404 may include a display screen 444 for showing still photos, movies, or other images supplied by an electronic data device coupled to docking station 440, and may also include one or more speakers (or may be in communication with external speakers) to provide sound output. Optionally, the docking and power unit 434 is capable of sending data, sound, or video signals to a remote television or computer monitor (such as monitor 118) or to another location.

The workstation module may be coupled to a framework using engaging members or pin members such as pin members 220 in substantially the same manner as described above. In the illustrated embodiment, however, workstation module 404 may be coupled to framework 124 via slot-engaging projections 304 that engage vertical slots 166*a* in one or more of vertical intermediate frame members 136*a-c* and left and right members 128*a*, 128*b*, for example, in a manner that will be described below.

Figure 19B:
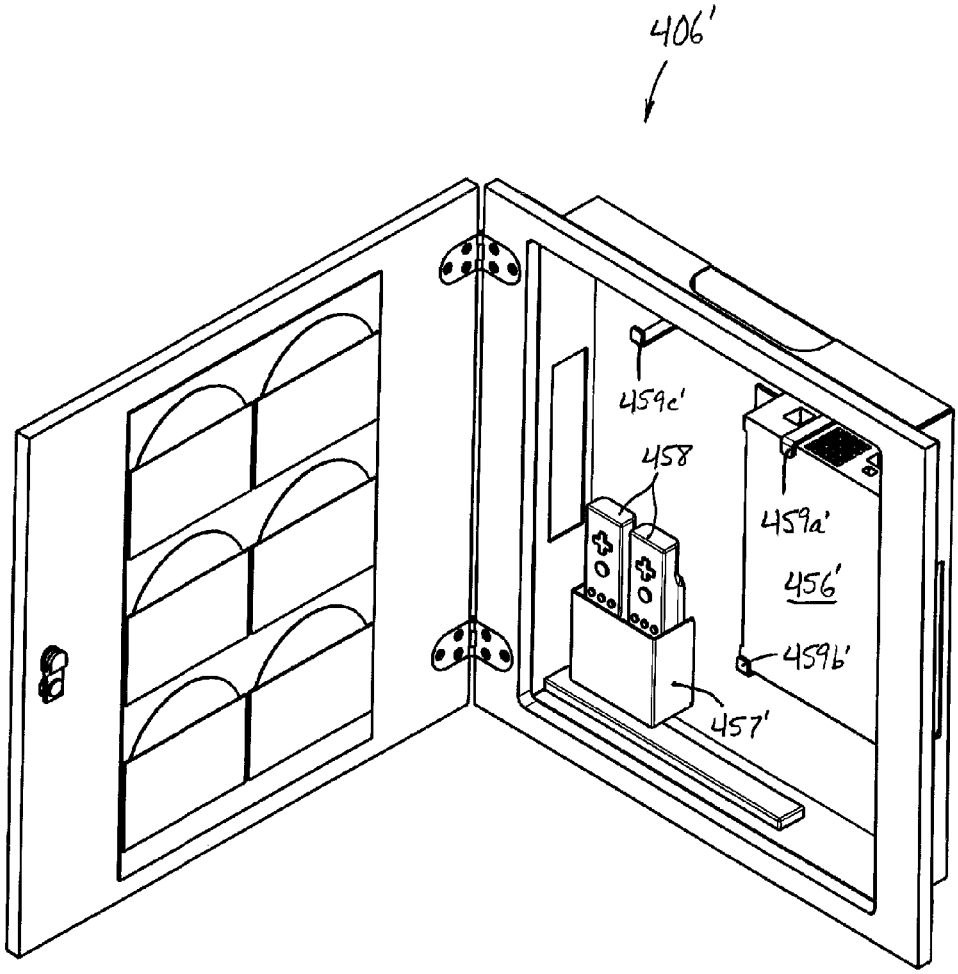
FIG. 19B is a front perspective view of another video game module.

Another workstation module 404' (FIG. 19B) includes a front panel 410' defining a work surface 412', similar to panel 410 of module 404. The front panel 410' is pivotally connected to a generally vertical and planar base member 414' via a set of hinges 416'. A pair of pivotable and extendable lock-arms 418' support front panel 410' in its open position in substantially the same manner as lock-arms 418 described above. A handle or gripping portion 419' is disposed along an outer/upper edge of front panel 410' to assist a user in opening and closing (i.e. lowering and raising) the front panel 410'. Attached to work surface 412' is a keyboard mount 421' that is movably supported between a pair of rails coupled to the work surface 412' so that the position of a computer keyboard supported on mount 421' may be adjusted by a user for comfort. A storage bracket 423' is provided in an interior cavity 426' along a recessed back wall 432' and may be used to store a wired or wireless computer mouse when the mouse is not in use. A partial wall or fence 428' is mounted in the cavity 426', also along the back wall 432', for storage of paper documents, clipboards, and the like.

Figure 18B:
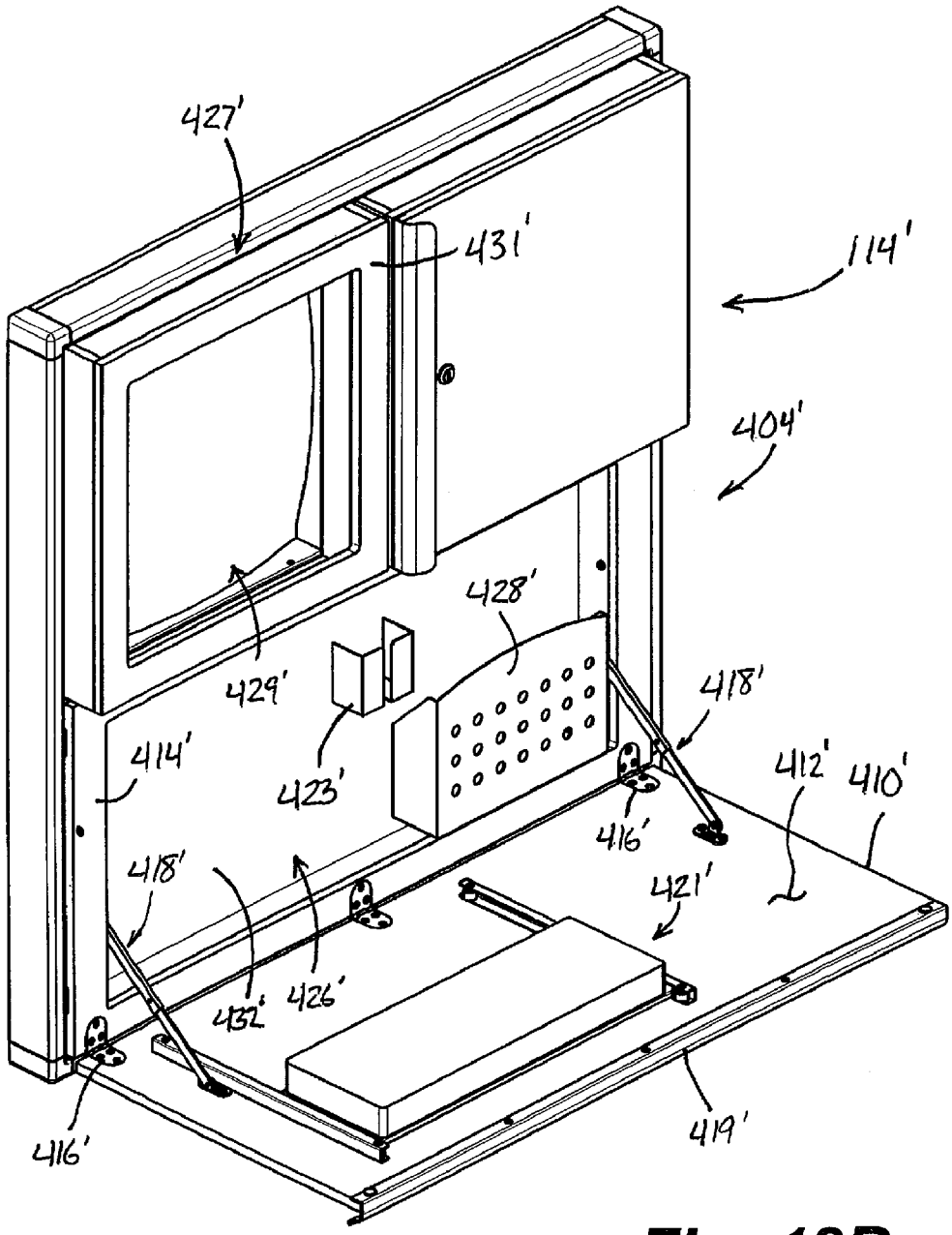
FIG. 18B is a front perspective view of another workstation module.

In the illustrated embodiment of FIG. 18B, located above workstation module 404' are a lockable storage module 114' and a computer monitor-mounting module 427' for supporting a computer monitor (not shown). Computer monitor-mounting module 427' defines an opening or recess 429' within a frame 431' for receiving and framing a flat-screen computer monitor or the like. Accordingly, workstation module 404' and monitor-mounting module 427' may be used together, with a computer in communication with a monitor in the monitor-mounting module 427', a keyboard supported at the keyboard mount 421', and a computer mouse that may be removed from bracket 423' for use on work surface 412'.

Video game module 406 (FIG. 19A) includes a front panel or door 446 that is pivotally connected to a housing 448 via a pair of hinges 450. Housing 448 defines a cavity 452 and includes a back wall 454 on which an electronic video game unit 456 and wired or wireless controllers 458 are stored. The inner surface of door 446 supports a plurality of sleeves or pockets 460 for receiving game cartridges or discs 462 for use in game unit 456. Optionally, game unit 456 may be capable of running or displaying games located remotely from the unit, such as via a wired or wireless data connection. Power and/or data wiring may be routed into cavity 452 via one or more apertures 464 in housing 448. Optionally, door 446 includes a lock 466 for engaging a corresponding slot (not shown) in a sidewall of housing 448 when door 446 is pivoted to a closed position, such as may be used to secure the contents of video game module 406 when its use is not authorized. Housing 448 includes a perimeter flange 448*a* with engaging members or pin members 220 extending rearward therefrom, to engage the framework 124 at one of various locations in the manner described above.

Video game module 406 sends video and audio output signals to a video display and/or speakers located remotely from module, such as on a television or computer monitor 118 supported elsewhere on the framework. Optionally, video game module 406 includes video and/or audio output devices so that game module 406 is generally capable of acting as a stand-alone unit with only an electrical power supply needed. For example, it is envisioned that cavity 452 could contain one or more audio speakers while door 446 could support or house a flat-screen video monitor at its outer surface that is viewable when the door is closed or only partially open.

Another video game module 406' (FIG. 19B) is substantially similar to module 406 such that the above discussion of its main components is incorporated here. However, it will be appreciated that video game module 406' includes a cradle or storage bin 457' for storing controllers 458, mounting brackets 459*a*', 459*b*' for supporting game unit 456, and another mounting bracket 459*c*' for supporting another game controller (not shown), such as a steering wheel or control yoke or the like.

Video conferencing module 408 (FIG. 20) includes a video display 468 in a housing 470 that is held between a pair of generally parallel, vertical supports 472 that extend along either side of housing 470. A sensor panel 474 houses a video camera and microphone (not shown) while a control panel 476 house various controls (e.g. volume, picture, and network controls) for operating the module. Optionally, a wired or wireless remote controller may be provided for controlling the various functions of video conferencing module 408 that, in addition to video display 468 and the video camera and microphone at sensor panel 474, may include one or more speakers. An open grille or mesh 478 along a top surface of housing 470 permits air flow through the housing interior to cool the electronic components and, optionally, to better conduct sound (such as voices) from outside the video conferencing module 408 to the microphone or from speakers located inside of housing 470. Fasteners 480 couple supports 472 to the housing 470 of video conferencing module 408, which includes power and data cables that are routed to power and data sources in a manner described above. Each support 472 includes slot-engaging projections 304 that engage vertical slots 166*a* in one or more of vertical intermediate frame members 136*a-c* and left and right members 128*a*, 128*b*, for example, in a manner that will be described below. Thus, video conferencing module 408 may be placed over another panel, or even over certain modules, by coupling to vertical slots 166*a* that are accessible between panels or certain modules. Optionally, video conferencing module 408 may be coupled to a framework using engaging members or pin members, such as pin members 220, in substantially the same manner as described above.

Figure 21A:
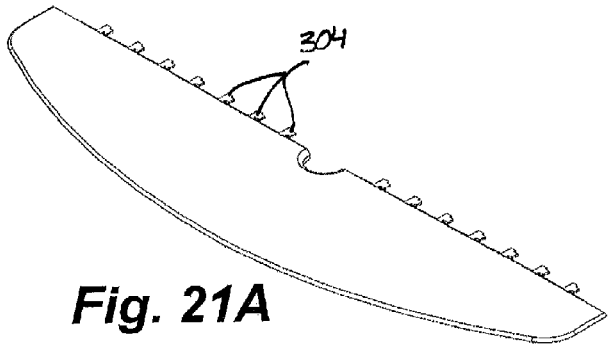
FIG. 21A is a front-top perspective view of a shelf accessory that is useful with the present invention.
Figure 21B:
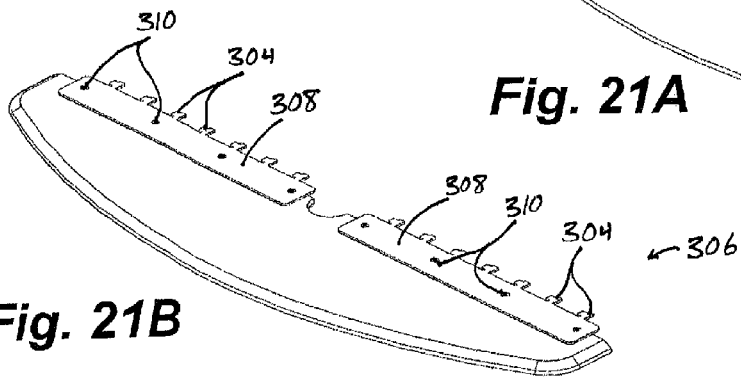
FIG. 21B is a front-bottom perspective view of the shelf of FIG. 21A.
Figure 22A:
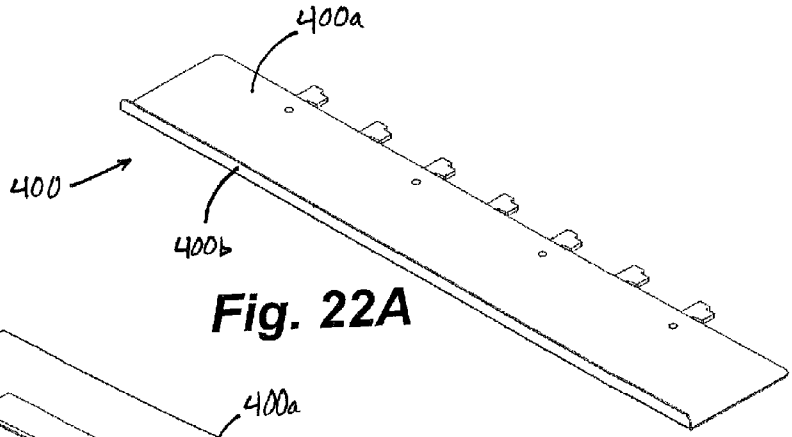
FIG. 22A is a front-top perspective view of a marker tray accessory that is useful with the present invention.
Figure 22B:
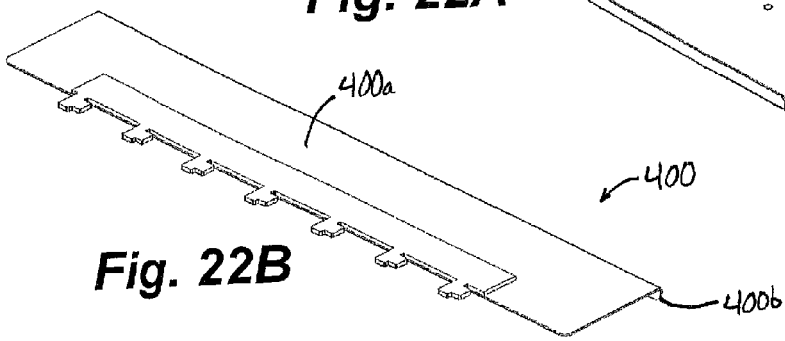
FIG. 22B is a rear-bottom perspective view of the marker tray of FIG. 22A.
Figure 23A:
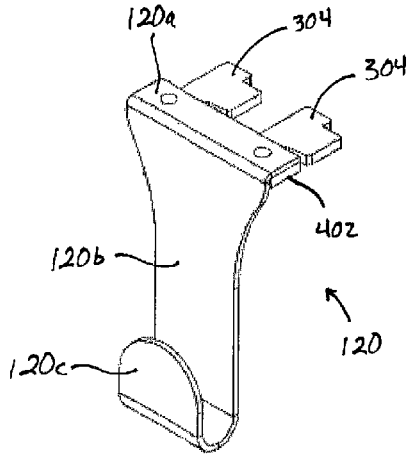
FIG. 23A is a front perspective view of a coat hook accessory that is useful with the present invention.
Figure 23B:
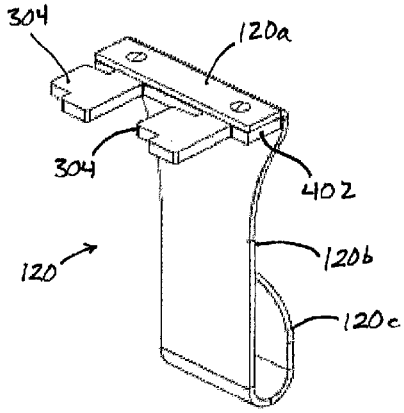
FIG. 23B is a rear perspective view of the coat hook accessory of FIG. 23A.
Figure 24A:
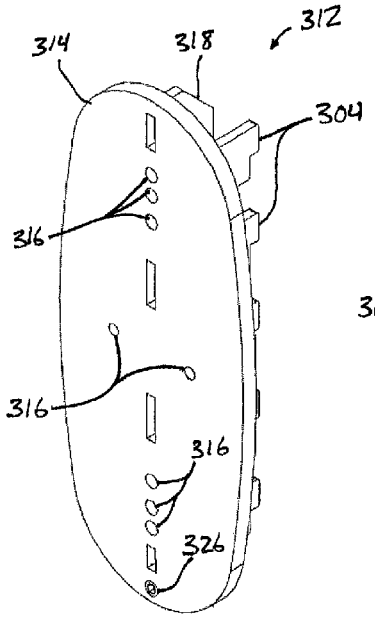
FIG. 24A is a front perspective view of a bracket useful with the present invention.
Figure 24B:
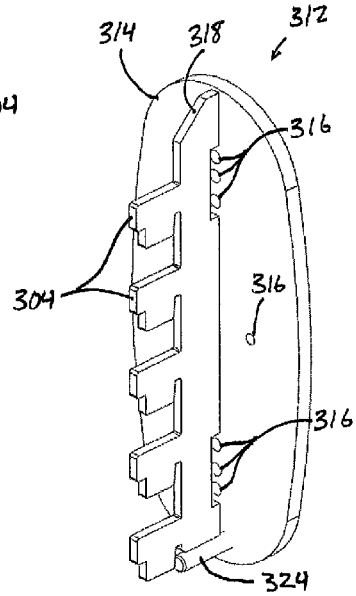
FIG. 24B is a rear perspective view of the bracket of FIG. 24A.
Figure 24C:
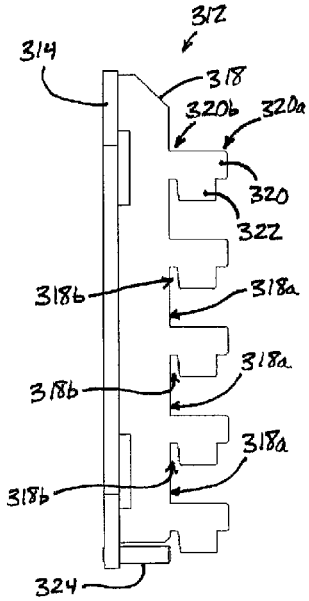
FIG. 24C is a side plan view of the bracket of FIGS. 24A and 24B.

Various bracket-mountable accessories 106 may be coupled to framework 124 at vertical slots 166*a* and horizontal slots 166*b* using a plurality of substantially identical slot-engaging projections 304 (FIGS. 21A-24C, 28, and 29C) on different types of brackets that will be described in greater detail below. For example, shelf accessory 122 (FIGS. 1A, 1B, 21A, and 21B) is provided with flat, elongate bracket members 308, each bracket member 308 including a plurality of slot-engaging projections 304, as more fully described below. Projections 304 engage horizontal slots 166*b* in framework 124 to support shelf 122 in horizontal alignment (as in FIGS. 1A and 1B), and engage horizontal slots 166*b* in a manner described below. Bracket members 308 are fastened to a lower or bottom surface of shelf accessory 122 via a plurality of fasteners 310 (FIG. 21B). A marker tray accessory 400 (FIGS. 1A, 1B, 22A, and 22B) is similarly fitted with an elongate bracket member 308' with slot-engaging projections 304, and may be positioned below marker board 108 as in FIGS. 1A and 1B for holding markers or other writing instruments while not in use. Marker tray accessory 400 includes a flat planar portion 400*a* for supporting writing instruments or other relatively small objects, and an upwardly-extending lip 400*b* at a distal end of planar portion 400*a* for retaining writing instruments or other round cylindrical objects on the planar portion.

Coat hook accessory 120 (FIGS. 1A, 1B, 23A, and 23B) includes a flat planar portion 120*a* at an upper end thereof for engaging a bracket member 402 having a pair of slot-engaging projections 304 extending therefrom in horizontal arrangement. A drop portion 120*b* of coat hook accessory 120 extends downward from flat planar portion 120*a* and terminates at an upwardly-turned hook end 120*c* for supporting articles of clothing, bags, etc.

Another bracket assembly 312 (FIGS. 24A-24C) includes a planar accessory-mounting plate 314 having a plurality of thru holes 316 (such as threaded holes or rivet holes or the like) for attachment of certain accessories 106 using fasteners (not shown). Extending perpendicularly from a back side of planar accessory mounting plate 314 is a frame-engaging plate 318 having a plurality of slot-engaging projections 304 extending therefrom. Frame-extending plate 318 is rigidly joined to planar accessory mounting plate 314 by welding or other fastening or attachment means.

Slot-engaging projections 304 include a generally rectangular portion 320 having a distal end 320*a* and a proximal end 320*b*, the proximal end attaching to frame-engaging plate 318 (or flat elongate bracket members 308 of shelf 30*b*, or the like). Distal end portion 320*a* is configured for extension through vertical slots 166*a* and horizontal slots 166*b* in the frame members of framework 124. Side projection 322 extends substantially perpendicularly away from rectangular portion 320, and is coplanar with rectangular portion 320 so that each slot-engaging projection 304 is a generally flat plate. Frame-engaging plate 318 has a plurality of linear portions 318*a* spanning between projections 304. A slot 318*b* is defined between each side projection 322 and corresponding linear portions 318*a*. A threaded cylindrical projection 324 extends through a threaded aperture 326 in planar accessory mounting plate 314 and is generally aligned in the same plane as frame-engaging plate 318, from which it is slightly spaced. Projection 324 may be engaged by a tool (such as a hex wrench or the like) to extend and retract the projection 324 relative to mounting plate 314 to retain bracket along a frame member, as will be described below. Bracket 312 is configured for receiving numerous different accessories such as, for example, soap dispensers 116, articulated arms 328, such as for supporting televisions or computer monitors 118 (FIGS. 1A and 1B), keyboards, or lamps; sharps containers; towel dispensers; hand sanitizers; or substantially any other accessory useful in a hospital or office environment.

Figure 25:
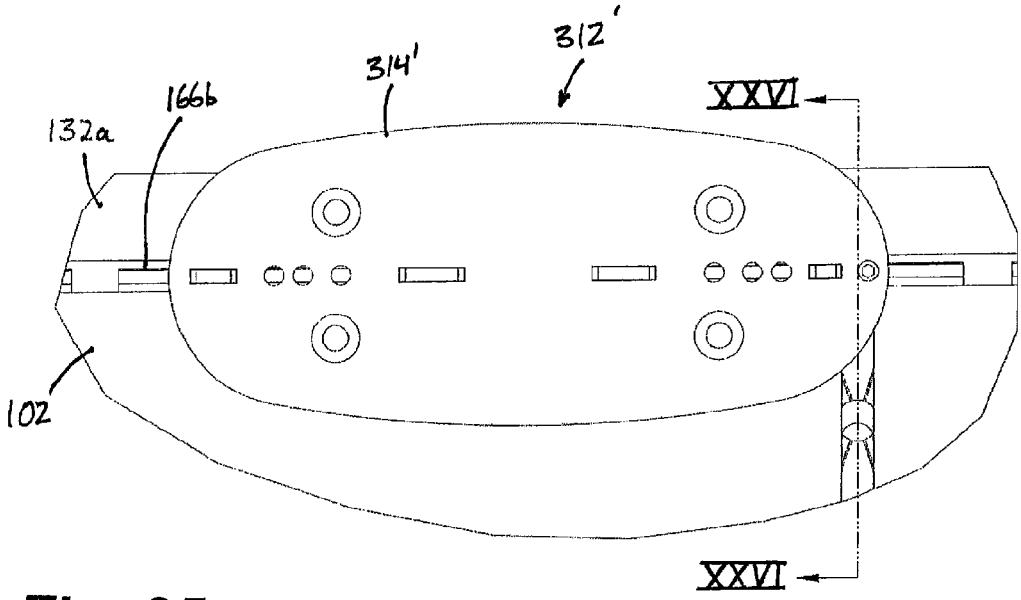
FIG. 25 is a front plan view of another bracket, installed along a horizontal frame member.

Slot-engaging projections 304 are configured to support brackets 312, 308 (or substantially any other bracket utilizing slot-engaging projections 304) while arranged in either vertical slots 166*a* or horizontal slots 166*b*, and can support gravitational loads regardless of the orientation of slot-engaging projections 304 (i.e., either vertical or horizontal orientations). Referring now to the illustrative embodiments of FIGS. 25 and 26, bracket 312' supports vertical loads even when mounted in a horizontal orientation. To support brackets 312' (and accessories 106 positioned thereon) in a horizontal orientation, slot-engaging projections 304 are aligned with horizontal slots 166*b* in top or bottom frame member 126*a*, 126*b* or horizontal intermediate frame member 138 and inserted until linear portions 318*a* of frame-engaging plate 318 contact the frame member such as top frame member 126*a* in FIG. 26. Brackets 312' are then slid laterally so that side projections 322 and linear portions 318*a* engage the respective frame member with slots 318*b* receiving portions of the frame member adjacent horizontal slots 166*b*.

As best seen in FIG. 26, top frame member 126*a* defines a cavity 332 that is normally covered by top trim piece 132*a*. A horizontal base portion 334 of top frame member 126*a* includes a plurality of apertures or thru holes 336 for receiving fasteners 338. An elongate spacer plate 340 has approximately the same thickness as slot-engaging projections 304 and includes a plurality of thru holes that are alignable with thru holes 336 of horizontal base portion 334 of top frame member 126*a*. An elongate L-shaped member 342 includes a substantially horizontal portion 342*a* and an upwardly projecting portion 342*b* closest to the horizontal slots 166*b* with an approximately ninety degree bend 342*c* between the horizontal portion 342*a* and vertical portion 342*b*. Horizontal portion 342*a* includes a plurality of thru holes that align with corresponding thru holes in elongate spacer plate 340 and in horizontal base portion 334 of top frame member 126*a*. Elongate spacer plate 340 and elongate L-shaped member 342 are positioned in cavity 332 of top frame member 126*a* and aligned above horizontal base portion 334. Plate 340 and L-shaped member 342 are held in place with fasteners 338 (such as threaded bolts) engaging corresponding fasteners 344 (such as threaded nuts) aligned with thru holes 336 along a lower surface of horizontal base portion 334. Elongate L-shaped member 342 is held in spaced arrangement above horizontal base portion 334 so as to define a channel or slot 346 between a portion of horizontal portion 342*a* and angle portion 342*c* of the elongate L-shaped member 342, and an upper surface of horizontal base portion 334. Slot 346 is recessed or spaced behind slots 166*b* of top frame member 126*a*. It will be appreciated that bottom frame member 126*b* is configured in a similar manner, in substantially a mirror-image to that described above for top frame member 126*a*.

When slot-engaging projections 304 are fully inserted into horizontal slots 166*b*, distal end portions 320*a* of rectangular portions 320 are at least partially received in channel 346. Slots 318*b* of frame-engaging plate 318 are fully engaged with top frame member 126*a* in the vicinity of horizontal slots 166*b* by lateral sliding motion of bracket 312' once projections 304 are inserted. Bracket 312' is substantially prevented from being pulled straight out of horizontal slots 166*b* by side projections 322 of slot-engaging projections 304. To disengage bracket 312' from top frame member 126*a*, bracket 312' is slid in a direction opposite to the engagement direction (e.g. slid left as viewed in FIG. 25 to disengage), which disengages slots 318*b* from top frame member 126*a* so that slot-engaging projections 304 may be removed from horizontal slots 166*b*.

Bracket 312' resists downward bending moments (such as caused by gravity acting upon bracket 312' and any accessory mounted thereto) by elongate L-shaped member 342 holding distal end portions 320*a* of slot-engaging projections 304 tightly against horizontal base portion 334. Excessive downward force acting upon bracket 312' may cause a lower portion of planar accessory mounting plate 314' to contact panel 102 upon bending of frame-engaging plate 318. Any such bending would be limited by such contact, however, and would likely be elastic in nature to avoid any permanent bending of frame-engaging plate 318 and/or top frame member 126*a*.

For brackets that are to be installed at horizontal intermediate frame member 138, horizontal slots 166*b* in backing plate 139 (FIGS. 2A and 2D) receive distal end portions 320*a* of rectangular portion 320 of slot-engaging projections 304, in a similar manner as elongate spacer plate 340 and horizontal base portion 324 of top frame member 126*a*, to resist downward bending moments on the installed brackets. Otherwise, engagement and disengagement of brackets with horizontal intermediate frame member 138 is substantially the same as that described above with respect to top frame member 126*a*.

Figure 27:
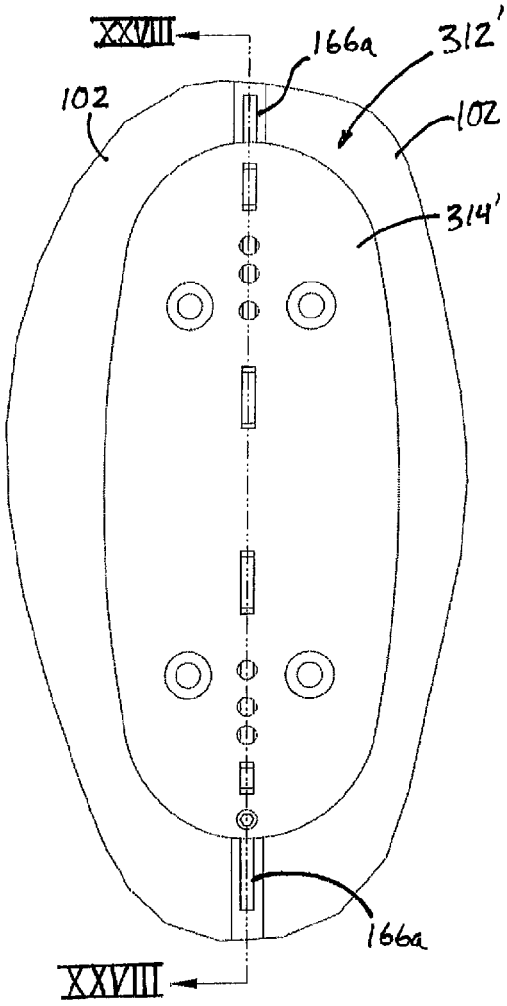
FIG. 27 is a front plan view of the bracket of FIG. 25, shown positioned at a vertical frame member.
Figure 28:
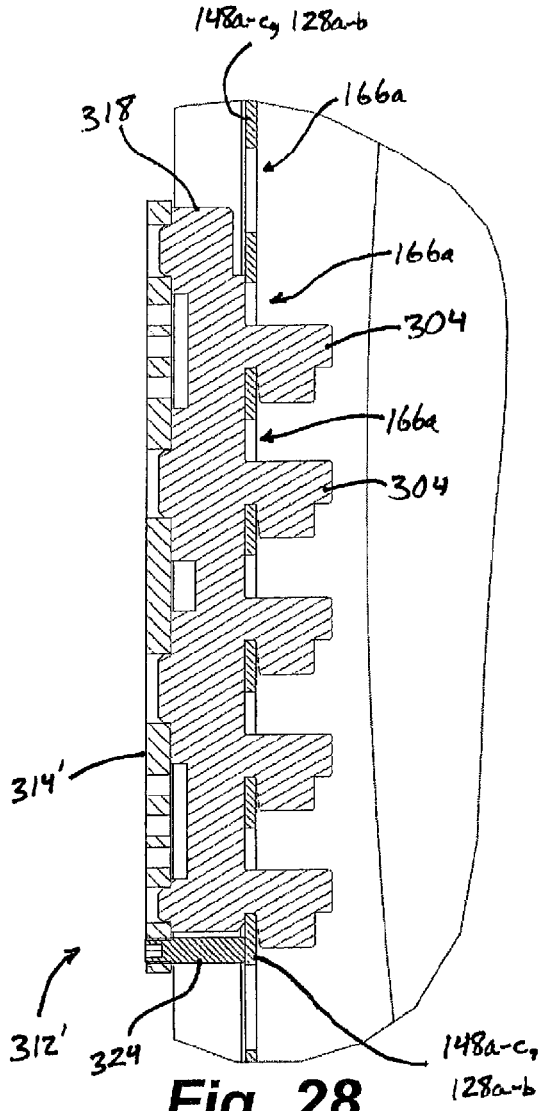
FIG. 28 is a side sectional view taken along line XXVIII-XXVIII of FIG. 27.

Bracket 312' may be oriented vertically and installed at vertical slots 166*a* (which are accessible between panels 102 in FIG. 27), in a substantially conventional manner, as shown in FIGS. 27 and 28. Slot-engaging projections 304 are spaced to be received simultaneously in vertical slots 166*a*. Slot-engaging projections 304 are inserted so that side projections 322 extend fully through and past vertical slots 166*a*. Bracket 312' is then lowered to engage channels 318*b* between side projections 322 and linear portions 318*a* of frame-engaging plate 318 to prevent inadvertent removal of bracket 312' from framework 124.

Optionally, threaded cylindrical projection 324 may be rotated to urge it in the direction of slot-engaging projections 304, until it engages and tightens against the frame member to which bracket 312, 312' is attached (FIG. 28). With threaded cylindrical projection 324 tightened against the vertical frame member, side projections 322 of slot-engaging projections 304 are tightened against a back surface of the frame member, holding bracket 312' in place on the frame member until such time as threaded cylindrical projection 324 is loosened.

Figure 29A:
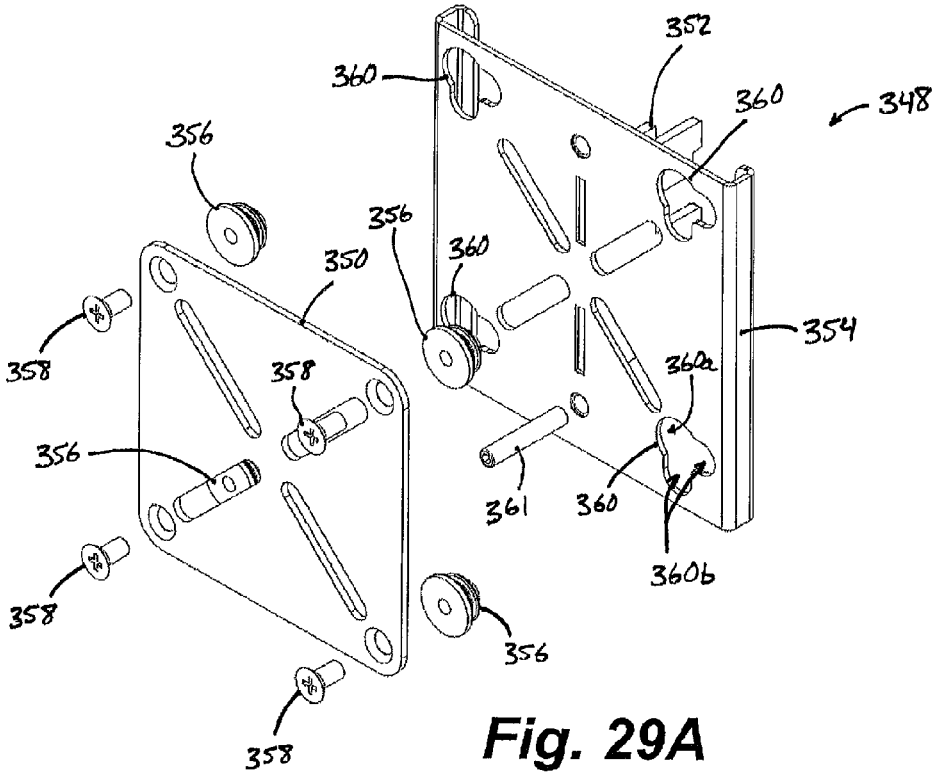
FIG. 29A is an exploded front perspective view of another bracket useful with the present invention.
Figure 29B:
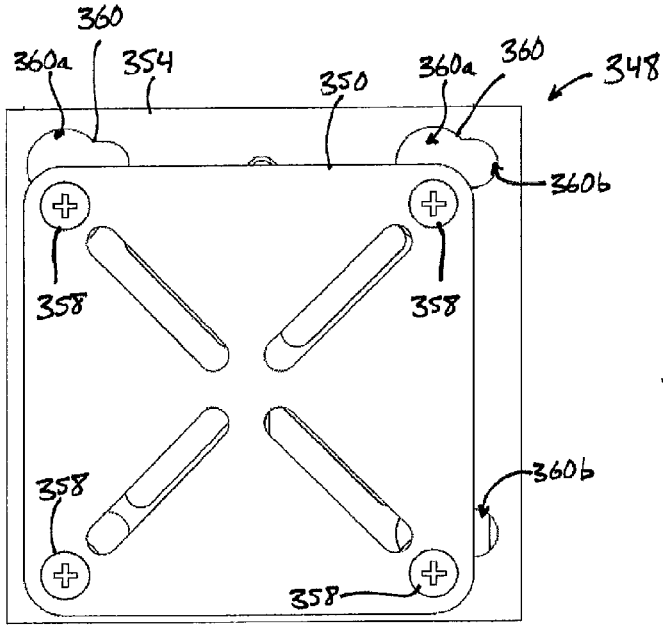
FIG. 29B is a front plan view of the bracket of FIG. 29A.
Figure 29C:
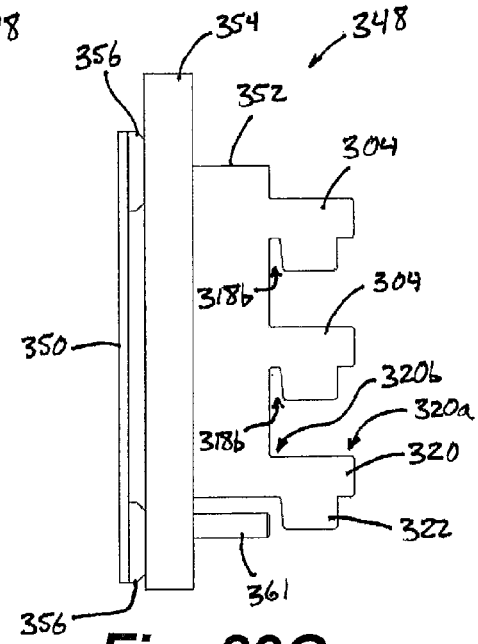
FIG. 29C is a side plan view of the bracket of FIGS. 29A and 29B.

Another bracket 348 incorporates a quick-connect plate 350 (FIGS. 29A-29C). Bracket 348 includes a frame-engaging plate 352 that is substantially similar to plate 318 of bracket 312. A universal mounting plate 354 is attached to frame-engaging plate 352, and is configured to receive quick-connect plate 350 (or other plates or mounting surfaces) using retainer buttons 356 coupled to a back surface of quick-connect plate 350 by threaded fasteners 358. Retainer buttons 356 are spaced to align with bi-directional apertures 360 in universal mounting plate 354. A threaded cylindrical projection 361 is provided for retaining bracket 348 at a frame member.

Bi-directional apertures 360 include large partial-circular openings 360*a* for receiving large diameter portions of retainer buttons 356, with a pair of smaller partial-circular openings 360*b* of reduced diameter for receiving reduced-diameter portions of retainer buttons 356. Smaller partial-circular openings 360*b* intersect large partial-circular openings 360*a* and are adapted to hold retainer buttons 356 after insertion of the retainer buttons into large partial circular openings 360*a*. Each bi-directional aperture's smaller partial circular opening 360*b* is located approximately ninety degrees from the other smaller partial circular opening of bi-directional aperture 360 to permit mounting of bracket 348 in either horizontal or vertical configurations while using gravity to hold retainer buttons 356 in one of smaller partial circular openings 360*b* of each bi-directional aperture 360, such as shown in FIG. 29B. A threaded cylindrical projection 362 (similar to projection 324 of brackets 312, 312') may be used to securely retain bracket 348 at one of the frame members of frame 124.

Figure 30A:
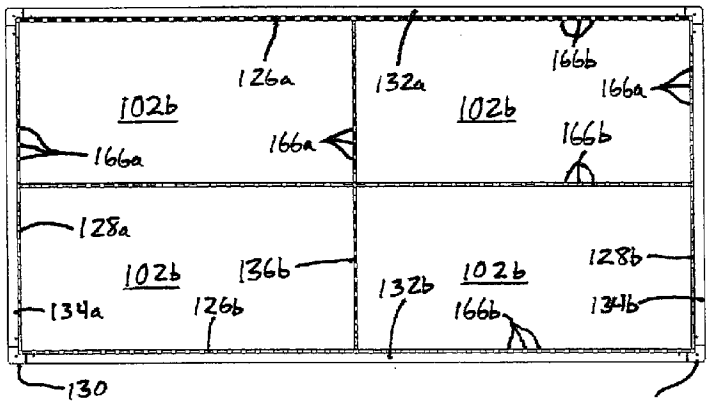
FIGS. 30A-E are front plan views of a horizontal rectangular accessory system having four rectangular panels in five optional positions and orientations.
Figure 30B:
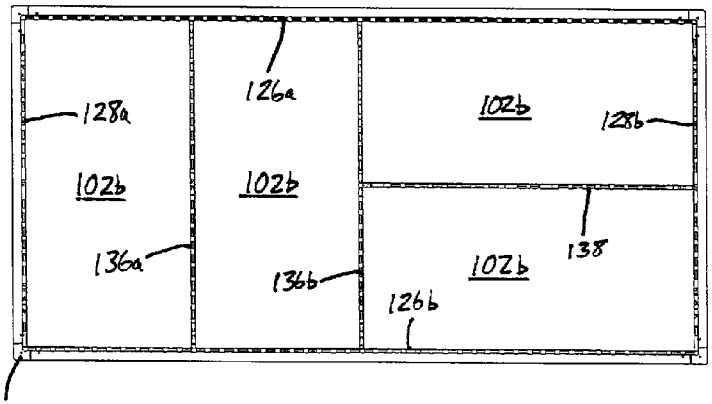
Figure 30C:
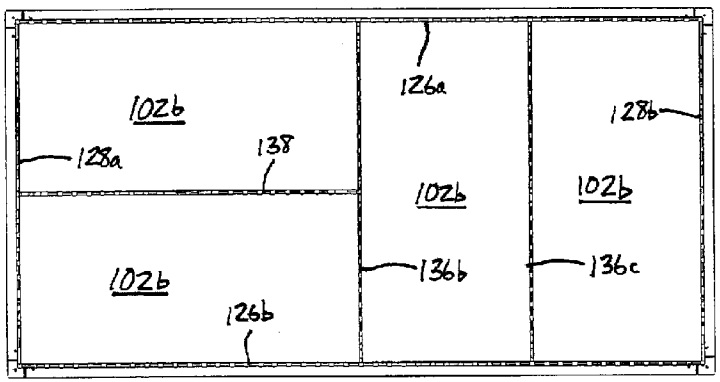
Figure 30D:
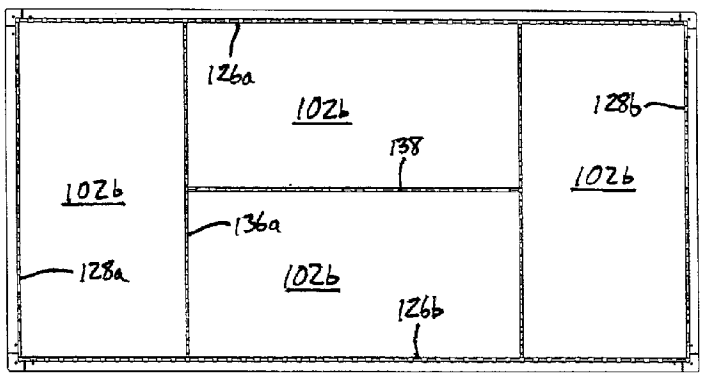
Figure 30E:
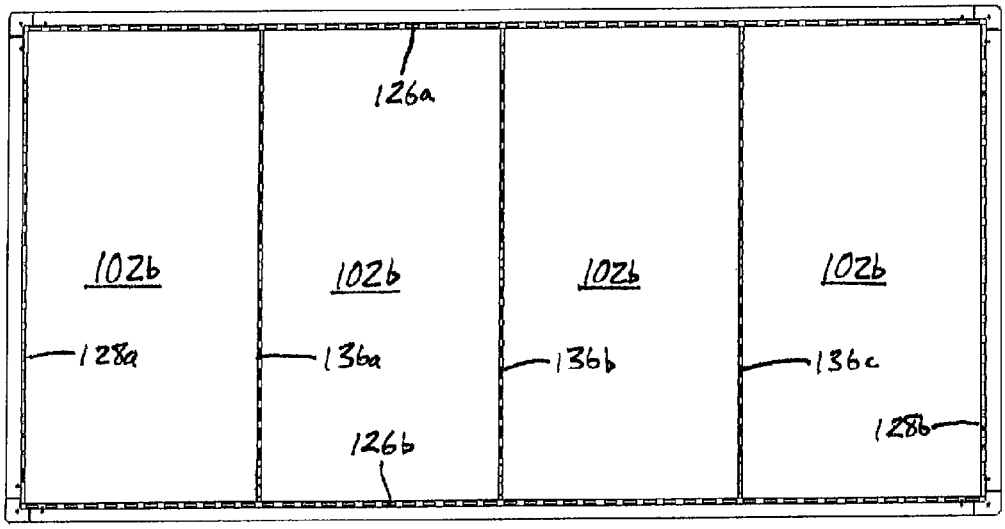
Figure 30F:
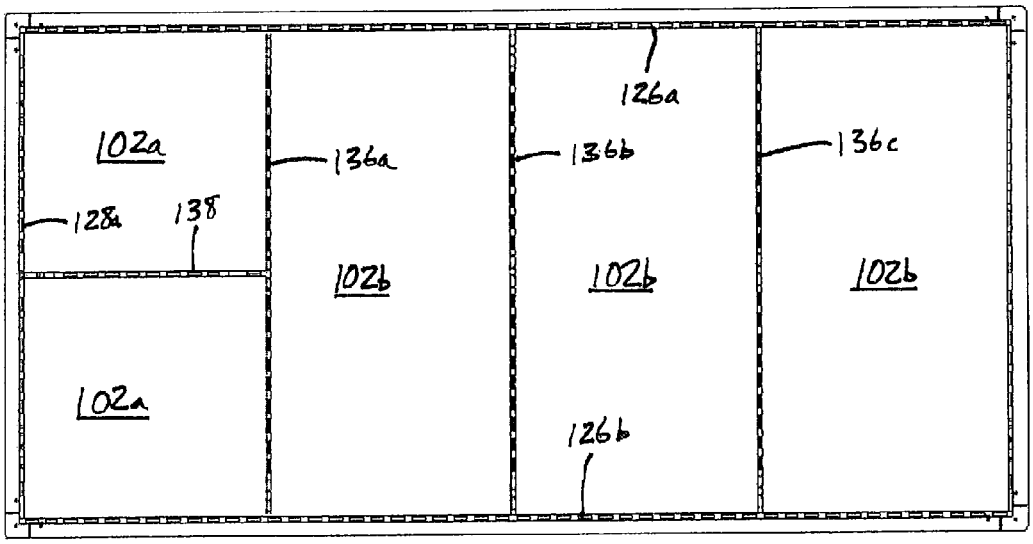
FIG. 30F is a front plan view of the accessory system of FIGS. 30A-E, including two square panels replacing one of the rectangular panels of FIG. 30E.

Referring now to FIGS. 30A-F, framework 124 supports four rectangular decorative panels 102*b* in several different orientations or configurations (FIGS. 30A-E), and one optional configuration using three of rectangular panels 102*b* and two of square panels 102*a* (FIG. 30F). Vertical slots 166*a* on left and right frame members 128*a*, 128*b* and vertical intermediate frame members 136*a-c* are accessible between panels 102*b* and between panels 102*b* and left and right frame members 128*a*, 128*b*. Horizontal slots 166*b* are similarly accessible between individual panels 102*b*, and between panels 102*b* and top and bottom frame members 126*a*, 126*b*. Additional horizontal slots 166*b* on horizontal intermediate frame member 138 may be exposed by using two square panels 102*a* in place of one rectangular panel 102*b*, as in FIG. 30F.

Framework 124 may be fitted with four rectangular panels 102*b* which have long dimensions that are twice as long as their width dimensions, in five different configurations. These are all horizontal (FIG. 30A), two vertical on the left and two horizontal on the right (FIG. 30B), two horizontal on the left and two vertical on the right (FIG. 30C), one vertical on the left, two horizontal in the middle, and one vertical on the right (FIG. 30D); and all vertical (FIG. 30E). Any of the rectangular panels 102*b* in FIGS. 30A-E may be replaced by two square panels 102*a* as in FIG. 30F, in which the left-most rectangular panel 102*b* of FIG. 30E is replaced by two square panels 102*a*. Because functional modules 104 are typically square in shape, functional modules 104 may be placed substantially anywhere that a square panel 102*a* could be placed on framework 124.

Figure 31:
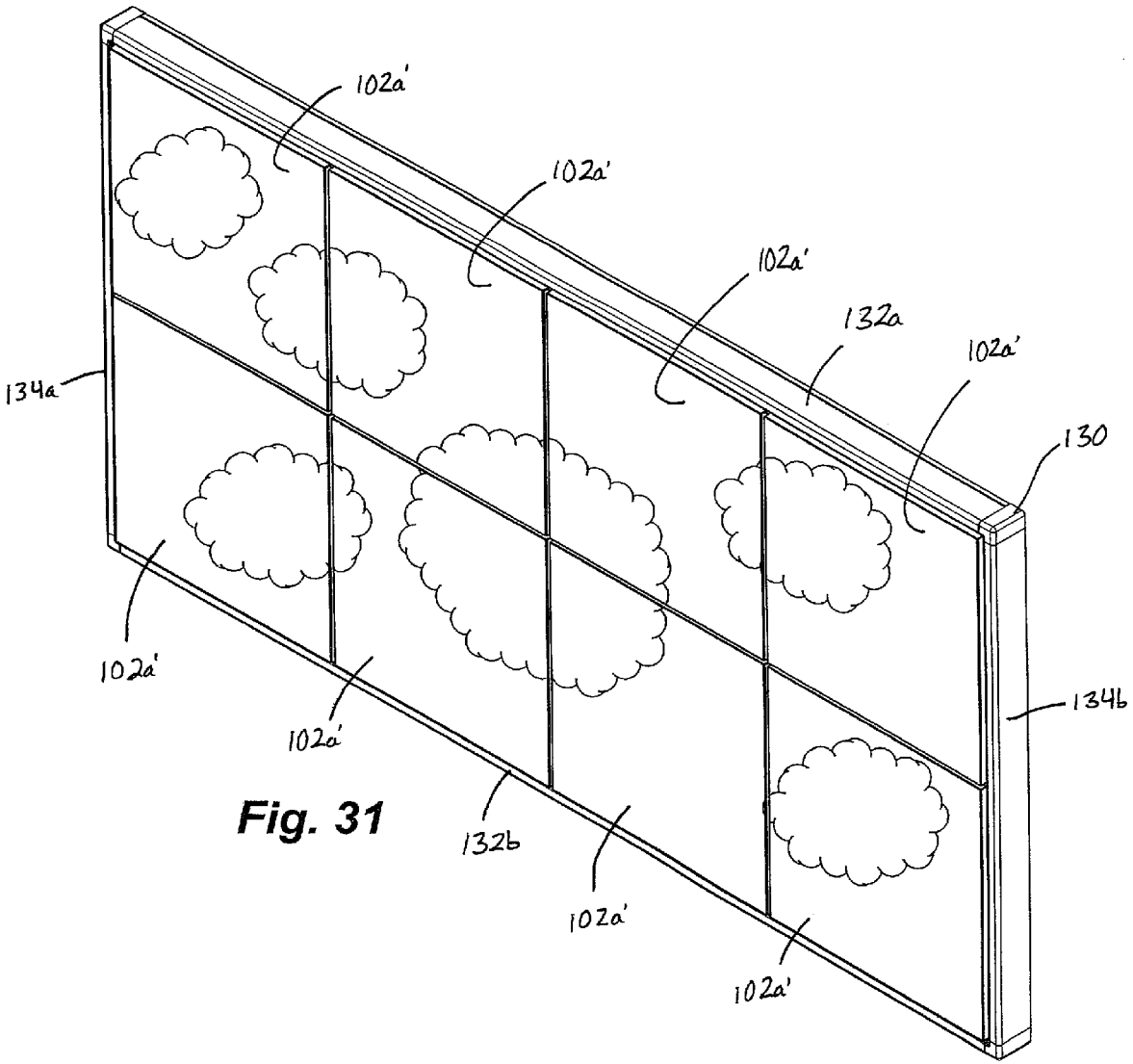
FIG. 31 is a front perspective view of another wall-mounted modular accessory system in accordance with the present invention, including eight square panels cooperatively forming a composite image.

Multiple square panels 102*a*' may also be used to present changeable scenes or artwork or photographs, such as in FIG. 31, in which eight square panels 102*a*' each display a portion of a scene such that, when square panels 102*a*' are assembled in the proper positions relative to one another, they form a composite image on the framework 124. It will be appreciated that the same effect may be achieved with rectangular panels or panels of substantially any other shape. Optionally, a given framework may have a portion of its available space filled with two or more panels forming a composite image, while the remaining space is occupied by other panels or functional modules. In this way, a desired mood or feeling or message may be projected by the wall-mounted modular accessory system using images or patterns on panels, either in conjunction with functional modules or as a stand-alone visual display. For example, a modular accessory system for an area typically occupied by children may contain a composite playful scene along a portion of the framework while another portion is occupied by a video game module.

Accordingly, it can now be more fully appreciated that square panels 102*a*, rectangular panels 102*b*, functional modules 104 (such as clock module 110, file storage module 112, and lockable storage module 114), functional panels such as marker board 108, and various accessories (such as, for example, shelf accessory 306, soap dispenser 116, television 118 (with articulated arm 328), and coat hook 120, may be positioned at substantially any location along the wall-mounted modular accessory system 100 in order to provide a desired configuration, as shown in FIGS. 1A and 1B. Wiring 182, such as for televisions 118, may be routed between panels and/or functional modules and into the framework via pass-throughs and grommets along the various frame members.

Wall-mounted modular accessory system 100 is readily supported on a wall, partition, or other substantially vertical surface by first mounting hanger rail 192, which is relatively lightweight and easy to handle, and then supporting framework 124 and the remainder of modular accessory system 100 upon the hanger rail. Aesthetic panels, functional panels, and functional modules are repositionable, reorientable, and replaceable, in order to permit customization of the modular accessory system to current needs. A reorientable bracket system permits the use of brackets in both horizontal and vertical orientations while supporting gravitational loads on the brackets. The brackets permit the mounting of accessories mounted directly to frame members of the framework such as between various panels and modules already attached to the framework.

Changes and modifications in the specifically described embodiments can be carried out without departing from the principles of the present invention, which is intended to be limited only by the scope of the appended claims, as interpreted according to the principles of patent law including the doctrine of equivalents.

The invention claimed is:

1. A modular accessory system for mounting on a vertical surface such as a wall or an office divider, said system comprising:

a framework comprising vertically-spaced top and bottom frame members and horizontally-spaced left and right frame members, said frame members cooperating to form a rectangular frame supportable at a substantially vertical surface;

at least one panel comprising a surface, said panel comprising a first plurality of engaging members in spaced arrangement;

at least one functional module insert, said module insert adapted to perform a function for a user and comprising a second plurality of engaging members in spaced arrangement;

a third plurality of engaging members for releasably engaging said first and second pluralities of engaging members, said third plurality of engaging members in spaced arrangement along at least two of said frame members; and wherein said at least one panel is fully supportable at said framework at at least two orientations via engagement of said first plurality of engaging members with said third plurality of engaging members, wherein a first of said orientations is at least about ninety degrees of rotation different from a second of said orientations.

2. The modular accessory system of claim 1, further comprising at least one intermediate vertical frame member between said left and right frame members and at least one intermediate horizontal frame member spaced between said top and bottom frame members, wherein said intermediate frame members comprise substantially coplanar support surfaces that are generally parallel to and spaced from the substantially vertical surface when said framework is supported thereat.

3. The modular accessory system of claim 2, wherein said top and bottom frame members, said left and right frame members, said intermediate vertical frame members, and said intermediate horizontal frame members comprise substantially coplanar support surfaces, and wherein said frame members are adapted to receive brackets for supporting an accessory therefrom.

4. The modular accessory system of claim 3, wherein said accessory comprises one chosen from a soap dispenser, an articulated arm, a television, a computer keyboard, a coat hook, and a shelf.

5. The modular accessory system of claim 1, wherein said first plurality of engaging members corresponding to each of said panels is in evenly-spaced arrangement, and said second plurality of engaging members corresponding to each of said functional modules is in evenly-spaced arrangement.

6. The modular accessory system of claim 1, wherein said at least one panel comprises at least one chosen from a writing surface, a tack board, a translucent panel, and a decorative surface.

7. The modular accessory system of claim 1, wherein said at least one functional module insert comprises at least one chosen from a clock module, a lockable storage module, a file storage module, an entertainment module, a lighted module, a power module, a workstation module, a video game module, and a video conferencing module.

8. The modular accessory system of claim 7, wherein said at least one functional module insert comprises a power module, said power module comprising:

a housing defining an interior cavity;

a movable cover at said housing, said movable cover forming an outer surface of said power module;

at least one electrical coupler at said interior cavity of said housing; and wherein said housing of said power module is at least partially insertable and removable from a cavity defined by said rectangular frame, and is repositionable at said rectangular frame.

9. The modular accessory system of claim 1, further comprising:

an accessory;

a bracket adapted to support said accessory and to engage at least one of said frame members; and wherein at least one of said frame members is adapted to receive said bracket for supporting said accessory.

10. The modular accessory system of claim 9, wherein said accessory comprises one chosen from a soap dispenser, an articulated arm, a television, a computer keyboard, a coat hook, and a shelf.

11. The modular accessory system of claim 9, further comprising:

slot-engaging projections extending outwardly from said bracket, said slot-engaging projections comprising distal and proximal end portions;

a side projection extending from each of said slot-engaging projections between said distal and proximal end portions;

a first plurality of slots in said at least one frame member for receiving said slot-engaging projections of said bracket;

recessed slots at said frame members, said recessed slots spaced from and substantially aligned with said first plurality of slots and configured to engage said distal end portions of said slot-engaging projections; and wherein said slot-engaging projections extend through said first plurality of slots and said distal end portions of said slot-engaging projections engage said recessed slots to thereby substantially resist bending moments applied to said bracket.

12. The modular accessory system of claim 11, wherein said bracket is configured to support said accessory in a horizontal orientation when said first plurality of slots and said recessed slots are arranged horizontally, and wherein said bracket is configured to support said accessory in a vertical orientation when said first plurality of slots and said recessed slots are arranged vertically.

13. The modular accessory system of claim 1, further comprising a support member for mounting to the substantially vertical surface, said support member for supporting said frame system at the substantially vertical surface.

14. The modular accessory system of claim 13, further comprising:

an intermediate vertical frame member between said left and right frame members;

an intermediate horizontal frame member spaced between said top and bottom frame members; and wherein said intermediate vertical frame member and said intermediate horizontal frame member comprise recessed rear surfaces that define spaces between said rear surfaces and the substantially vertical surface for passing wiring through said spaces.

15. The modular accessory system of claim 14, wherein said intermediate vertical frame member includes a notch for receiving a portion of said intermediate horizontal frame member, and wherein said intermediate horizontal frame member includes a notch for receiving a portion of said vertical frame member, said notches engaging one another when said frame members are assembled together.

16. The modular accessory system of claim 14, wherein said intermediate vertical frame member includes wire notches along said recessed rear surfaces for passing the wiring through said wire notches, and wherein said wire notches are configured to support the wiring at the wire notches.

17. The modular accessory system of claim 1, wherein said rectangular frame defines a plane that is substantially parallel to the substantially vertical surface when said rectangular frame is installed thereat, and wherein said panels and said module inserts are attachable to said framework by aligning said first and second pluralities of engaging members with corresponding ones of said third plurality of engaging members, and urging said panels and said module inserts solely perpendicularly to said plane defined by said rectangular frame.

18. The modular accessory system of claim 17, wherein said first and second pluralities of engaging members comprise non-cylindrical pins, and wherein said third plurality of engaging members comprises clips for engaging portions of said pins.

19. The modular accessory system of claim 1, wherein said frame members comprise pass-throughs for conducting wiring from outside said framework into an interior cavity of said framework.

20. A modular accessory system for mounting on a vertical surface such as a wall or an office divider, said system comprising:

a framework comprising vertically-spaced top and bottom frame members and horizontally-spaced left and right frame members, said frame members cooperating to form a rectangular frame supportable at a substantially vertical surface, and said frame members comprising pass-throughs for conducting wiring from outside said framework into an interior cavity of said framework;

at least one panel comprising a surface, said panel comprising a first plurality of engaging members in spaced arrangement;

at least one functional module insert, said module insert adapted to perform a function for a user and comprising a second plurality of engaging members in spaced arrangement;

a third plurality of engaging members for releasably engaging said first and second pluralities of engaging members, said third plurality of engaging members in spaced arrangement along at least two of said frame members;

wherein said at least one panel is repositionable at said framework at at least two orientations via engagement of said first plurality of engaging members with said third plurality of engaging members, wherein a first of said orientations is at least about ninety degrees of rotation different from a second of said orientations; and a trim piece at at least one of said frame members and at least one chosen from (i) a flexible flange at said at least one of said frame members, said flexible flange adapted to be displaced to create a gap between said flexible flange and said trim piece for routing a wire through the gap and into at least one of said pass-throughs of said frame members, and (ii) a wiring pass-through in said trim piece for routing a wire through said wiring pass-through and into at least one of said pass-throughs of said frame members.

21. A modular accessory system for mounting on a vertical surface such as a wall or an office divider, said system comprising:

a framework comprising vertically-spaced top and bottom frame members and horizontally-spaced left and right frame members cooperating to form a rectangular frame defining a cavity, and at least one intermediate frame member in said cavity and coupled to said top and bottom frame members or to said left and right frame members, said rectangular frame being supportable at a substantially vertical surface;

at least one power module insert, said power module insert comprising (i) a housing defining an interior cavity, (ii) a movable cover at said housing, said movable cover being movable between open and closed positions and forming an outer surface of said power module insert when in the closed position, and (iii) at least one electrical coupler at said interior cavity of said housing, wherein said electrical coupler is accessible to a user only when said movable cover is in the open position; and wherein said housing of said power module insert is at least partially insertable and removable from said cavity of said rectangular frame, and is repositionable at different locations along said rectangular frame.

22. The wall-mounted modular accessory system of claim 21, wherein said power module insert comprises a conduit in said housing for conducting high-voltage wiring to said at least one electrical coupler.

23. The wall-mounted modular accessory system of claim 22, wherein said electrical coupler comprises at least one of a 110-volt and a 220-volt outlet.

24. The wall-mounted modular accessory system of claim 21, wherein said power module comprises a wiring retainer for retaining wires in said housing.

25. The wall-mounted modular accessory system of claim 21, wherein said electrical coupler comprises an electronic data connector.

26. The wall-mounted modular accessory system of claim 21, wherein said movable panel comprises a door pivotably coupled to said housing by a hinge.

27. The wall-mounted modular accessory system of claim 21, further comprising:

a first plurality of engaging members in spaced arrangement at said power module insert;

a second plurality of engaging members for releasably engaging said first plurality of engaging members, said second plurality of engaging members in spaced arrangement along said frame members; and wherein said power module insert is repositionable at said framework in different portions of said cavity via coupling of said first plurality of engaging members with different ones of said second plurality of engaging members.

28. The wall-mounted modular accessory system of claim 27, wherein said rectangular frame defines a plane that is substantially parallel to the substantially vertical surface when said rectangular frame is installed thereat, and wherein said power module is attachable to said framework by aligning said first plurality of engaging members with corresponding ones of said second plurality of engaging members and urging said power module solely perpendicularly to said plane defined by said rectangular frame.

29. A modular accessory system for mounting on a vertical surface such as a wall or an office divider, said system comprising:

a framework comprising vertically-spaced top and bottom frame members and horizontally-spaced left and right frame members, said frame members cooperating to form a rectangular frame supportable at a substantially vertical surface;

at least one of an intermediate vertical frame member between said left and right frame members or an intermediate horizontal frame member spaced between said top and bottom frame members, wherein said at least one intermediate frame member and said top, bottom, left, and right frame members comprise substantially coplanar support surfaces that are generally parallel to and spaced from the vertical surface when said framework is supported thereat;

at least one functional module insert, said module insert adapted to perform a function for a user and comprising a first plurality of engaging members in spaced arrangement for mounting at said framework;

a second plurality of engaging members for releasably engaging said first plurality of engaging members, said second plurality of engaging members in spaced arrangement along at least one of said frame members and along at least one of said intermediate frame members;

at least one panel comprising a surface, said panel comprising a third plurality of engaging members in spaced arrangement, said third plurality of engaging members for engaging said second plurality of engaging members;

wherein said frame members and said intermediate frame members comprise slots for receiving brackets for supporting an accessory therefrom; and wherein said at least one intermediate frame member comprises a recessed rear surface that defines a space between said rear surface and the vertical surface for passing wiring through said space.

30. The modular accessory system of claim 29, wherein said accessory comprises one chosen from a soap dispenser, an articulated arm, a television, a computer keyboard, a coat hook, and a shelf.

31. The modular accessory system of claim 29, wherein said at least one panel comprises at least one chosen from a writing surface, a tack board, a translucent panel, and a decorative surface.

32. The modular accessory system of claim 29, wherein said at least one functional module insert comprises at least one chosen from a clock module, a lockable storage module, a file storage module, an entertainment module, a lighted module, a power module, a workstation module, a video game module, and a video conferencing module.

33. The modular accessory system of claim 29, further comprising:

a bracket adapted to support said accessory and engage at least one of said frame members; and wherein at least one of said frame members is adapted to receive said bracket for supporting said accessory.

34. The modular accessory system of claim 33, further comprising:

slot-engaging projections extending outwardly from said bracket, said slot-engaging projections comprising distal and proximal ends;

a side projection extending from each of said slot-engaging projections between said distal and proximal ends;

a first plurality of slots in said at least one frame member for receiving said slot-engaging projections of said bracket;

recessed slots at said frame members, said recessed slots spaced from and substantially aligned with said first plurality of slots and configured to engage distal ends of said slot-engaging projections; and wherein said slot-engaging projections extend through said first plurality of slots and said distal ends of said slot-engaging projections engage said recessed slots to thereby substantially resist bending moments applied to said bracket.

35. The modular accessory system of claim 34, wherein said bracket is configured to support said accessory in a horizontal orientation when said first plurality of slots and said recessed slots are arranged horizontally, and wherein said bracket is configured to support said accessory in a vertical orientation when said first plurality of slots and said recessed slots are arranged vertically.

* * * * *

UNITED STATES PATENT AND TRADEMARK OFFICE

CERTIFICATE OF CORRECTION

PATENT NO. : 8,327,589 B2
APPLICATION NO. : 12/713547
DATED : December 11, 2012
INVENTOR(S) : Todd A. Sutton et al.

It is certified that error appears in the above-identified patent and that said Letters Patent is hereby corrected as shown below:

In the Specification

Column 3
Line 7, insert --at-- after "at"

Column 11
Line 55, "210," should be --210b,--

Signed and Sealed this
Eighth Day of July, 2014

Michelle K. Lee

Michelle K. Lee
*Deputy Director of the United States Patent and Trademark Office*